US005385814A

United States Patent [19]

Uchida et al.

[11] Patent Number: 5,385,814

[45] Date of Patent: Jan. 31, 1995

[54] SILVER HALIDE COLOR PHOTOGRAPHIC LIGHT-SENSITIVE MATERIAL

[75] Inventors: Minoru Uchida; Toshio Kawagishi; Yasuhiro Yoshioka, all of Minami-Ashigara, Japan

[73] Assignee: Fuji Photo Film Co., Ltd., Kanagawa, Japan

[21] Appl. No.: 982,430

[22] Filed: Nov. 27, 1992

[30] Foreign Application Priority Data

Nov. 28, 1991 [JP] Japan ..... 3-337878
May 6, 1992 [JP] Japan ..... 4-139665

[51] Int. Cl.[6] ..... G03C 7/36; G03C 7/38; G03C 7/18

[52] U.S. Cl. ..... 430/504; 430/544; 430/549; 430/557

[58] Field of Search ..... 430/544, 556, 557, 549, 430/505, 504

[56] References Cited

U.S. PATENT DOCUMENTS

| | | | |
|---|---|---|---|
| Re. 27,848 | 12/1973 | Weissberger et al. | 430/557 |
| 2,184,303 | 12/1939 | Jennings | 430/556 |
| 4,268,591 | 5/1981 | Tschopp | 430/556 |
| 4,404,274 | 9/1983 | Arai et al. | 430/557 |
| 4,782,012 | 11/1988 | DeSelms et al. | 430/544 |
| 5,112,730 | 5/1992 | Ohkawa et al. | 430/549 |
| 5,118,599 | 6/1992 | Lau et al. | 430/557 |
| 5,250,406 | 10/1993 | Yamamoto et al. | 430/544 |
| 5,258,271 | 11/1993 | Haijima et al. | 430/557 |
| 5,273,868 | 12/1993 | Sakurazawa et al. | 430/556 |
| 5,314,797 | 5/1994 | Yoshioka et al. | 430/544 |

*Primary Examiner*—Richard L. Schilling

[57] ABSTRACT

A silver halide color photographic light-sensitive material having blue-, green-, and red-sensitive silver halide emulsion layers contains a pyrazoloazole-type compound which releases a development inhibitor in at least one layer and contains an acylacetamide-type yellow coupler having a novel acyl group in at least one layer.

21 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material and, more particularly, to a silver halide color photographic light-sensitive material in which sharpness, color reproduction, and storage stability are improved, and dye stability after development is significantly improved, by using a combination of a pyrazoloazoletype compound excellent in storage stability and hue and a novel acylacetamide-type yellow coupler.

2. Description of the Related Art

As a silver halide color photographic light-sensitive material, a material is generally used which contains three types of color couplers which couple with the oxidized form of an aromatic primary amine-based color developing agent to form three colors of yellow, magenta, and cyan.

As the yellow coupler, an acylacetamide coupler represented by a benzoylacetanilide coupler or a pivaloylacetanilide coupler is generally used. The benzolyacetamide-type coupler generally has a high coupling activity with an aromatic primary amine developing agent during development and can form a yellow dye having a large molecular absorptivity coefficient. However, the benzoylacetamide-type coupler is low in dye stability when stored in a dark place. The pivaloylacetamide-type coupler, on the other hand, has a high dye stability but is low in coupling reactivity during development and has only a small molecular absorptivity coefficient. To obtain a sufficient dye density, therefore, a large amount of color-forming couplers must be used, resulting in disadvantages in both image quality and cost.

Studies have been made on an acyl group of the acylacetamide-type yellow coupler, and, for example, U.S. Pat. No. Re 27,848 discloses couplers having a 7,7-dimethylnorbornane-1-carbonyl group or a 1-methylcyclohexane-1-carbonyl group as a modification of a pivaloyl group. These couplers, however, are low in coupling activity and can produce only dyes having small molecular absorptivity coefficients; i.e., these couplers are not sufficiently satisfactory.

JP-A-47-26133 ("JP-A" means Published Unexamined Japanese Patent Application) discloses couplers having a cyclopropane-1-carbonyl group or a cyclohexane-1-carbonyl group. However, these couplers are still unsatisfactory because dyes produced by these couplers are low in stability and the couplers are poor in spectral absorption characteristics.

For this reason, a demand has arisen for a yellow coupler having good color forming properties (a high coupling reactivity of the coupler and a large molecular absorptivity coefficient of the produced dye) and a high dye stability and also having excellent absorption characteristics in which the edge of spectral absorption on the long-wavelength side is cut sharply and an amount of unnecessary absorption in a green region is small.

A silver halide color photographic light-sensitive material, on the other hand, is required to have a high sharpness, a good color reproduction, and a high storage stability and is also required to have a high dye stability after development. Especially in recent years, it has become necessary to further improve the image quality with decreases in format and size. However, the above requirements cannot be satisfactorily met only by improving the sharpness by decreasing the thickness of layers by using couplers having good color forming properties to reduce the amount of couplers or high-boiling organic solvents, or only by improving the saturation of colors without increasing the amount of couplers (without degrading the sharpness) by using couplers having good color forming properties.

The use of development inhibitor-releasing compounds (DIR compounds) for the purpose of improving the photographic performance, such as sharpness and color reproduction, is proposed in, e.g., JP-A-2-154256, JP-A-1-105947, JP-A-63-210927, JP-A-62-228151, JP-A-62-166334, JP-A-61-286852, JP-A-53-15136, and JP-A-50-36125. Since, however, these patents do not use the compounds of the present invention, the results obtained by these patents are unsatisfactory in color reproduction and poor in dye stability after development. Magenta-forming pyrazoloazole-type compounds which are chemically stable and capable of improving color reproduction are disclosed in, e.g., JP-A-61-28947, JP-A-62-24252, and JP-A-3-142447. However, these couplers are still unsatisfactory in sharpness when used singly and, when used in combination with conventional yellow couplers, cannot satisfactorily meet the requirements in color reproduction and dye stability.

SUMMARY OF THE INVENTION

It is an object of the present invention to provide a light-sensitive material excellent in sharpness, color reproduction, and storage stability.

It is another object of the invention to provide a light-sensitive material also significantly excellent in dye stability after development.

The above objects have been achieved according to the invention by a silver halide color photographic light-sensitive material comprising at least one light-sensitive silver halide emulsion layer on a support, wherein at least one of the light-sensitive silver halide emulsion layers contains at least one compound represented by Formula (MI) below, and at least one layer of the silver halide color photographic light-sensitive material contains at least one acylacetamide-type yellow coupler having an acyl group represented by Formula (YI) below:

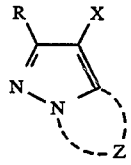

Formula (MI)

where R represents a hydrogen atom or a substituent, and Z represents a nonmetallic atomic group required to form a 5-membered azole ring which contains two to four nitrogen atoms, and may have a substituent.

X represents a group which is split off upon a coupling reaction with the oxidized form of a developing agent to form a development inhibitor or a precursor of a development inhibitor, or a group which reacts with another molecular of the oxidized form of a developing agent after split off and forms a development inhibitor or a precursor of a development inhibitor.

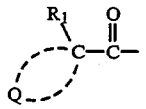

Formula (YI)

where $R_1$ represents a monovalent group, and Q represents a nonmetallic atomic group required to form, together with C, a 3- to 5-membered hydrocarbon ring or a 3- to 5-membered heterocyclic ring having at least one heteroatom selected from N, O, S, and P in its ring. Note that $R_1$ is not a hydrogen atom and does not combine with Q to form a ring.

DETAILED DESCRIPTION OF THE PREFERRED EMBODIMENTS

A compound represented by Formula (MI) used in the present invention will be described in detail below. Of coupler skeletons represented by Formula (MI), preferable skeletons are 1H-imidazo[1,2-b]pyrazole, 1H-pyrazolo[1,5-b][1,2,4]triazole, 1H-pyrazolo[5,1-c][1,2,4]triazole, and 1H-pyrazolo[1,5-d]tetrazole. These skeletons are represented by Formulas (P-1), (P-2), (P-3), and (P-4), respectively:

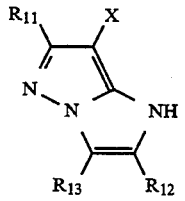

(P-1)

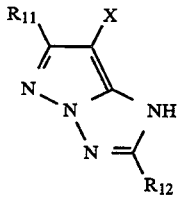

(P-2)

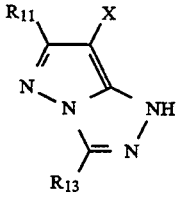

(P-3)

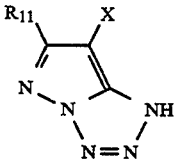

(P-4)

Substituents $R_{11}$, $R_{12}$, and $R_{13}$, and X in these formulas will be described in detail below.

$R_{11}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxycarbonylamino group, an imido group, a heterocyclicthio group, a sulfinyl group, a phosphonyl group, an aryloxycarbonyl group, an acyl group, or an azolyl group. $R_{11}$ may be a divalent group to form a bis-form of the compound.

More specifically, $R_{11}$ represents a hydrogen atom; a halogen atom (e.g., chlorine or bromine atom); an alkyl group (e.g., a straight-chain or branched alkyl group, an aralkyl group, an alkenyl group, an alkinyl group, a cycloalkyl group, or a cycloalkenyl group, having 1 to 32 carbon atoms, such as methyl, ethyl, propyl, isopropyl, t-butyl, tridecyl, 2-methanesulfonylethyl, 3-(3-pentadecylphenoxy)propyl, 3-{4-{2-4-(4-hydroxyphenylsulfonyl)phenoxy]dodecanamido} phenyl}propyl, 2-ethoxytridecyl, trifluoromethyl, cyclopentyl, or 3-(2,4-di-t-amylphenoxy)propyl); aryl group (e.g., phenyl, 4-t-butylphenyl, 2,4-di-t-amylphenyl, or 4-tetradecanamidophenyl); a heterocyclic group (e.g., 2-furyl, 2-thienyl, 2-pyrimidinyl, or 2-benzothiazolyl); a cyano group; a hydroxyl group; a nitro group; a carboxyl group; an amino group; an alkoxy group (e.g., methoxy, ethoxy, 2-methoxyethoxy, 2-dodecylethoxy, or 2-methanesulfonylethoxy); an aryloxy group (e.g., phenoxy, 2-methylphenoxy, 4-t-butylphenoxy, 3-nitrophenoxy, 3-t-butyloxycarbamoylphenoxy, or 3-methoxycarbamoylphenoxy); an acylamino group (e.g., acetamido, benzamido, tetradecanamido, 2-(2,4-di-t-amylphenoxy)butanamido, 4-(3-t-butyl-4-hydroxyphenoxy)-butanamido, or 2-{4-(4-hydroxyphenylsulfonyl)phenoxy}dodecanamido); an alkylamino group (e.g., methylamino, butylamino, dodecylamino, diethylamino, or methylbutylamino), an anilino group (e.g., phenylamino, 2-chloroanilino, 2-chloro-5-tetradecaneamineanilino, 2-chloro-5-dodecyloxycarbonylanilino, N-acetylanilino, or 2-chloro-5-{α-(3-t-butyl-4-hydroxyphenoxy) dodecaneamido}anilino); a ureido group (e.g., phenylureido, methylureido, or N,N-dibutylureido); a sulfamoylamino group (e.g., N,N-dipropylsulfamoylamino or N-methyl-N-decylsulfamoylamino), an alkylthio group (e.g., methylthio, octylthio, tetradecylthio, 2-phenoxyethylthio, 3-phenoxypropylthio, or 3-(4-t-butylphenoxy)propylthio); an arylthio group (e.g., phenylthio, 2-butoxy-5-t-octylphenylthio, 3-pentadecylphenylthio, 2-carboxyphenylthio, or 4-tetradecanamidophenylthio); an alkoxycarbonylamino group (e.g., methoxycarbonylamino or tetradecyloxycarbonylamino); a sulfonamido group (e.g., methanesulfonamido, hexadecanesulfonamido, benzenesulfonamido, p-toluenesulfonamido, octadecanesulfonamido, or 2-methyloxy-5-t-butylbenzenesulfonamido); a carbamoyl group (e.g., N-ethylcarbamoyl, N,N-dibutylcarbamoyl, N-(2-dodecyloxyethyl)carbamoyl, N-methyl-N-dodecylcarbamoyl, or N-{3-(2,4-di-t-amylphenoxy)-propyl}carbamoyl); a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl); a sulfonyl group (e.g., methanesulfonyl, octanesulfonyl, benzenesulfonyl, or toluenesulfonyl); an alkoxycarbonyl group (e.g., methoxycarbonyl, butyloxycarbonyl, dodecyloxycarbonyl, or octadecyloxycarbonyl); a heterocyclic oxy group (e.g., 1-phenyltetrazole-5-oxy or 2-tetrahydropyranyloxy); an azo group (e.g., phenylazo, 4-methoxyphenylazo, 4-pivaloylaminophenylazo, or 2-hydroxy-4-propanoylphenylazo); an acyloxy group (e.g., acetoxy); a carbamoyloxy group (e.g., N-methylcarbamoyloxy or N-phenylcarbamoyloxy); a silyloxy group (e.g., trimethylsilyloxy or dibutylmethylsilyloxy); an aryloxycarbonylamino group (e.g., phenoxycarbonylamino); an imido group (e.g., N-succinimido, N-phthalimido, or 3-octadecenylsuccinimido); a heterocyclic thio group (e.g., 2-benzothiazolylthio, 2,4-di-phenoxy-1,3,5-triazole-6-thio, or 2-pyridylthio); a sulfinyl group (e.g., dodecanesulfinyl, 3-pentadecylphenylsulfinyl, or 3-phenoxypropylsulfinyl); a phosphonyl group (e.g., phenoxyphosphonyl, octyloxyphosphonyl, or phenylphosphonyl); an aryloxycarbonyl group (e.g., phenoxycarbonyl); an acyl group (e.g., acetyl, 3-phenylpropanoyl, benzoyl, or 4-dodecyloxybenzoyl); or an azolyl group (e.g., imidazolyl, pyrazolyl, 3-chloro-pyrazol-1-yl, or triazolyl). Of these substituents, a group capable of further having a substituent may further have an organic substituent which is bonded at the carbon atom, the oxygen atom, the nitrogen atom or the sulfur atom, or may have a halogen atom.

Of these substituents, preferable examples of $R_{11}$ are a hydrogen atom, an alkyl group, an aryl group, an alkoxy group, an aryloxy group, an alkylthio group, a ureido group, and an acylamino group.

$R_{12}$ represents groups similar to the substituents enumerated above for $R_{11}$ and is preferably a hydrogen atom, an alkyl group, an aryl group, a heterocyclic group, an alkoxycarbonyl group, a carbamoyl group, a sulfamoyl group, a sulfinyl group, an acyl group, or a cyano group.

$R_{13}$ represents groups having the same meanings as the substituents enumerated above for $R_{11}$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio group.

X is preferably a group represented by Formula (X-1) below:

$$-\{(L_1)_a-(B)_m\}_p-(L_2)_n-DI \qquad \text{Formula (X-1)}$$

where $L_1$ represents a group which cleaves the bond on the right side (the bond with $(B)_m$) of $L_1$ in Formula (X-1) after the bond on the left side is cleaved, B represents a group which reacts with the oxidized form of a developing agent to cleave the bond on the right side of B in Formula (X-1), $L_2$ represents a group which cleaves the bond on the right side (the bond with DI) of $L_2$ in Formula (X-1) after the bond on the left side is cleaved, DI represents a development inhibitor, each of a, m, and n represents 0 or 1, and p represents an integer from 0 to 2. If p is the plural number, the p number of $(L_1)_a$-$(B)_m$'s may be identical or different.

The reaction in which a compound represented by Formula (X-1) releases DI upon development is represented by, for example, the following reaction formula, for p=1:

$$A-(L_1)_a-(B)_m-(L_2)_n-DI \xrightarrow{QDI^+} (L_1)_a-(B)_m-(L_2)_n-DI \longrightarrow$$

-continued $$(B)_m-(L_2)_n-DI \xrightarrow{QDI^+} (L_2)_n-DI \longrightarrow DI$$

where $L_1$, a, B, m, $L_2$, n, and DI represent the same meanings as explained above for Formula (X-1), DQI+ represents the oxidized form of a developing agent, and A represents the pyrazoloazole magenta coupler moiety described above, i.e., a part of Formula (MI) other than X.

Examples of the linking groups represented by $L_1$ and $L_2$ in Formula (X-1) are a group described in U.S. Pat. Nos. 4,146,396, 4,652,516, or 4,698,297, which uses a cleavage reaction of hemiacetal; a timing group described in U.S. Pat. No. 4,248,962, which causes a cleavage reaction by using an intramolecular nucleophilic reaction; a timing group described in U.S. Pat. Nos. 4,409,323 or 4,421,845, which causes a cleavage reaction by using an electron transfer reaction; a group described in U.S. Pat. No. 4,546,073, which causes a cleavage reaction by using hydrolysis of iminoketal; and a group described in West German Patent 2,626,317, which causes a cleavage reaction by using hydrolysis of ester. Each of $L_1$ and $L_2$ combines with A or $A-(L_1)_a-(B)_m$ at the heteroatom, preferably an oxygen atom, a sulfur atom, or a nitrogen atom, contained in it.

Preferable examples of groups represented by $L_1$ and $L_2$, if present, are as follows.

(1) Group using cleavage reaction of hemiacetal

Examples of this group are described in U.S. Pat. No. 4,146,396, JP-A-60-249148, and JP-A-60-249149, and the group is represented by Formula (T-1) below. In Formula (T-1), a symbol * represents a free valency to be bonded to the left side of $L_1$ or $L_2$ of the group represented by Formula (X-1), and a symbol ** represents a free valency to be bonded to the right side of $L_1$ or $L_2$ of the group represented by Formula (X-1):

Formula (T-1)

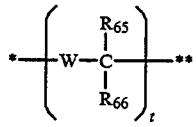

where W represents an oxygen atom, a sulfur atom, or an $-NR_{67}-$ group, each of $R_{65}$ and $R_{66}$ represents a hydrogen atom or a substituent, $R_{67}$ represents a substituent, and t represents 1 or 2. If t is 2, two $-W-CR_{65}(R_{66})-$'s may be identical or different. Representative examples of substituents represented by $R_{65}$ and $R_{66}$, when they represent substituents, and those of $R_{67}$ are an $R_{69}$ group, an $R_{69}CO-$group, an $R_{69}SO_2-$group, an $R_{69}NR_{70}CO-$group, and an $R_{69}NR_{70}SO_2-$group, wherein $R_{69}$ represents an aliphatic group, an aromatic group, or a heterocyclic group, and $R_{70}$ represents an aliphatic group, an aromatic group, a heterocyclic group, or a hydrogen atom. $R_{65}$, $R_{66}$, and $R_{67}$ may represent divalent groups and combine to form a cyclic structure. Practical examples of a group represented by Formula (T-1) are as follows.

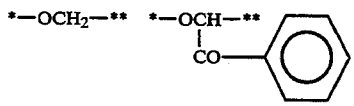

-continued

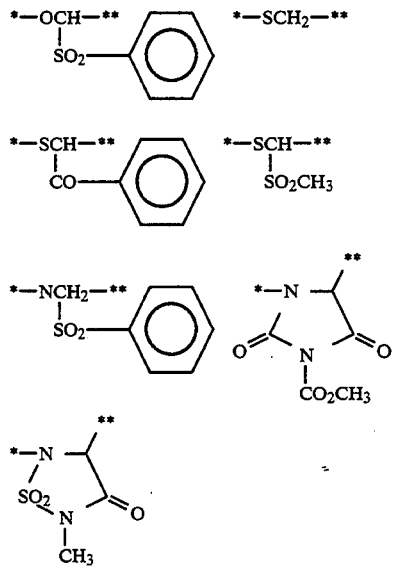

(2) Group causing cleavage reaction by using intramolecular nucleophilic substitution reaction An example of this group is a timing group described in U.S. Pat. No. 4,248,962, and the group is represented by Formula (T-2) below:

*-Nu-Link-E-** Formula (T-2)

where symbols * and  represent the same meanings as explained above for Formula (T-1), and Nu represents a nucleophilic group. Examples of a nucleophilic species are an oxygen atom and a sulfur atom. E represents an electrophilic group which can cleave the bond with the symbol  upon nucleophilic attack by Nu. Link represents a linking group which sterically connects Nu with E so that they can undergo an intramolecular nucleophilic substitution reaction. Practical examples of a group represented by Formula (T-2) are as follows.

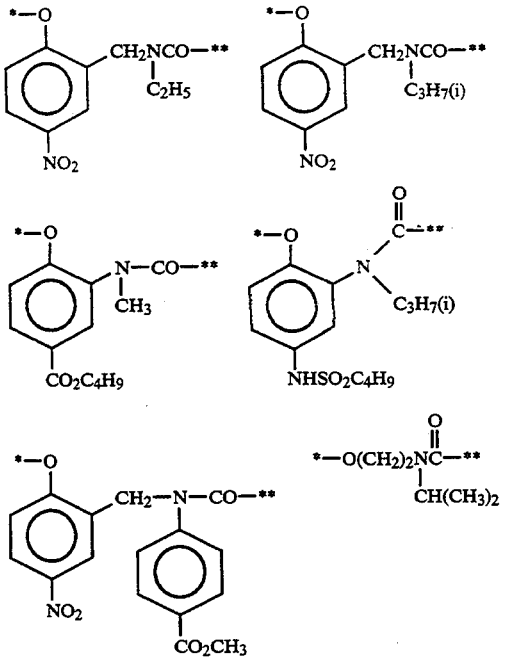

-continued

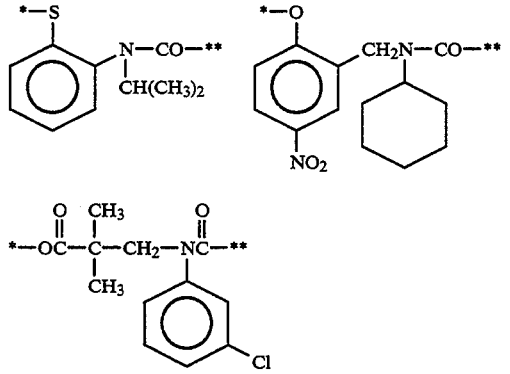

(3) Group causing cleavage reaction by using electron transfer reaction along conjugated system Examples of this group are described in U.S. Pat. Nos. 4,409,323 and 4,421,845, and the group is represented by Formula (T-3) below:

$$*-W-(V_1=V_2)_t-CH_2-** \qquad \text{Formula (T-3)}$$

where each of $V_1$ and $V_2$ represents $=CR_{65}-$ or a nitrogen atom, and symbols * and **, W, $R_{65}$, and t represent the same meanings as explained above for Formula (T-1). Practical examples of the group are as follows.

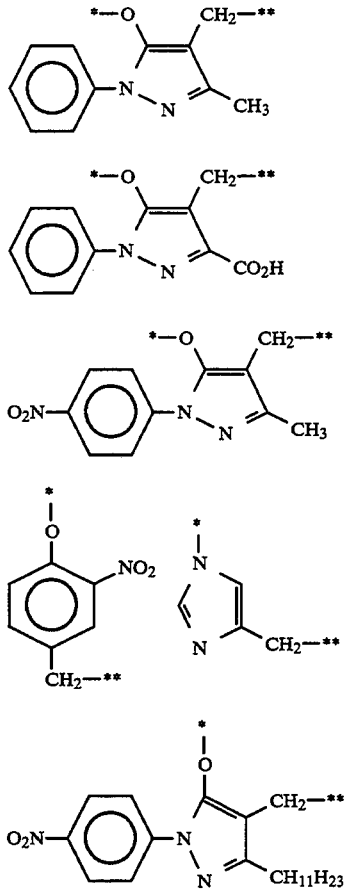

(4) Group using cleavage reaction caused by hydrolysis of ester

An example of this group is a coupling group described in West German Patent 2,626,315, and the group is represented by Formula (T-4) or (T-5) below. In these formulas, symbols * and ** represent the same meanings as explained above for Formula (T-1):

$$*\text{—O—CO—}** \qquad \text{Formula (T-4)}$$

$$*\text{—S—CS—}** \qquad \text{Formula (T-5)}$$

(5) Group using cleavage reaction of iminoketal

An example of this group is a linking group described in U.S. Pat. No. 4,546,073, and the group is represented by Formula (T-6) below:

$$*\text{—W—C(=NR}_{68}\text{)—}** \qquad \text{Formula (T-6)}$$

where symbols * and ** and W represent the same meanings as explained above for Formula (T-1), and $R_{68}$ represents the same meaning as $R_{67}$. Practical examples of a group represented by Formula (T-6) are as follows.

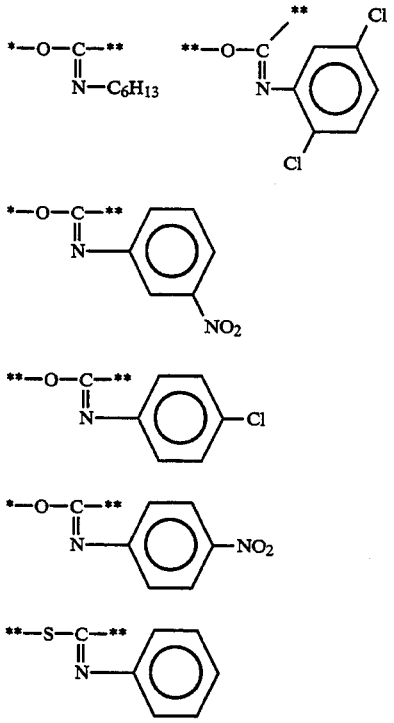

A group represented by B in Formula (X-1) described above is more specifically represented by Formula (B-1), (B-2), (B-3), or (B-4) below:

$$*\text{—}X_1\text{—}(X_2 \rightleftharpoons X_3)_b\text{—}X_4\text{—H} \qquad \text{(B-1)}$$

where a symbol * represents the bonding position on the left side of B in Formula (X-1), a symbol  represents the bonding position on the right side of B in Formula (X-1), each of $X_1$ and $X_4$ represents an oxygen atom or —N—($SO_2R_{71}$)—(wherein $R_{71}$ represents an aliphatic group, an aromatic group, or a heterocyclic group), each of $X_2$ and $X_3$ represents a methine group or a nitrogen atom, and b represents an integer from 1 to 3. At least one of b $X_2$'s and b $X_3$'s represents a methine group having the free valency represented by the symbol . If b is the plural number, the b number of $X_2$'s may be identical or different, and the b number of $X_3$'s may be identical or different. If $X_2$ and $X_3$ represent methine groups having substituents, they may or may not combine to form a cyclic structure (e.g., a benzene ring or a pyridine ring). After cleaved at the bond indicated by the symbol *, a group represented by Formula (B-1) forms a compound according to a Kendall-Pelz rule (see T. H. James, "The Theory of the Photographic Process," 4th ed., Macmillan Publishing Col., Inc., p. 299) and is oxidized upon reacting with the oxidized form of a developing agent.

Practical examples of a group represented by Formula (B-1) are as follows.

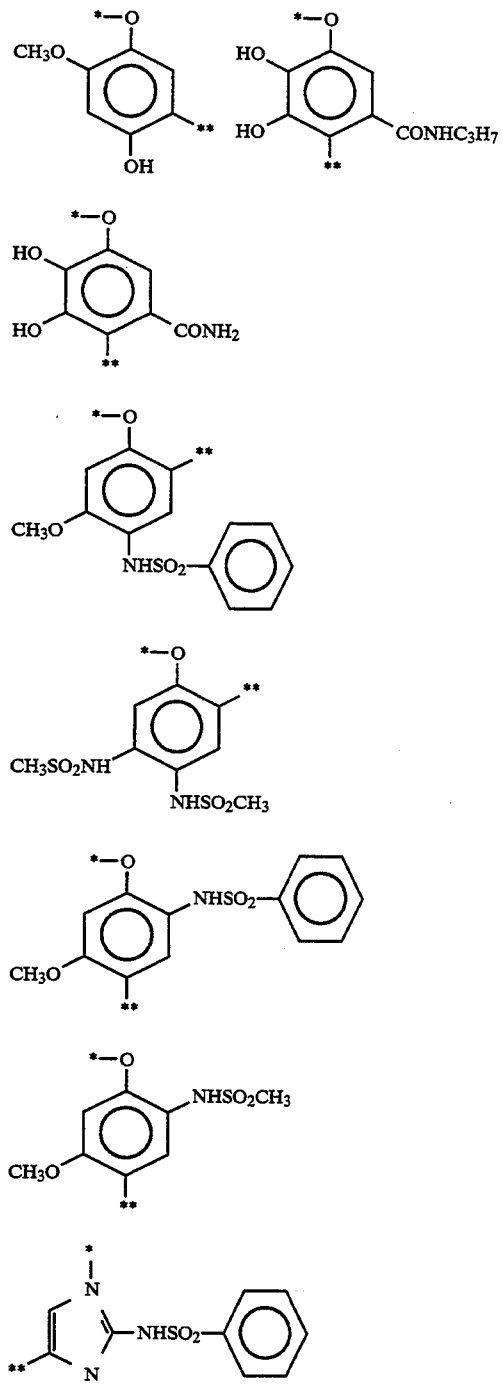

-continued

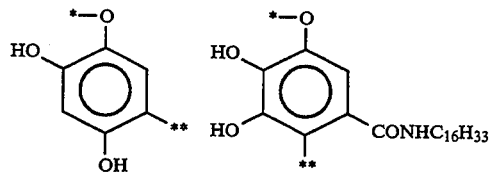

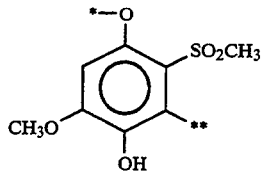

Formula (B-2)

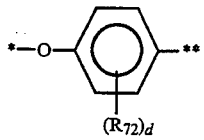

Formula (B-3)

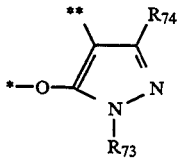

where symbols * and  represent the same meanings as explained above for (B-1), each of $R_{72}$, $R_{73}$, and $R_{74}$ represents a group which enables a group represented by (B-2) or (B-3) to function as a coupler having a coupling split-off group at the symbol  after cleaved at the symbol *, and d represents an integer from 0 to 4. If d is the plural number, a plurality of $R_{72}$'s may be identical or different or may combine to form a cyclic structure (e.g., a benzene ring). Examples of $R_{72}$ are an acylamino group, an alkyl group, and a halogen atom, examples of $R_{74}$ are an acylamino group, an alkyl group, an anilino group, an amino group, and an alkoxy group, and examples of $R_{73}$ are a phenyl group and an alkyl group.

Practical examples of groups represented by (B-2) and (B-3) are as follows.

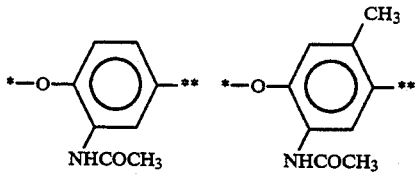

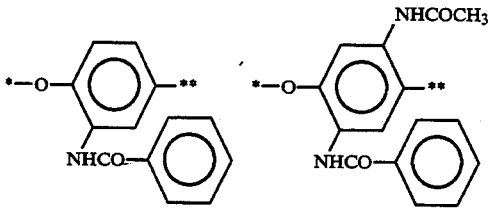

-continued

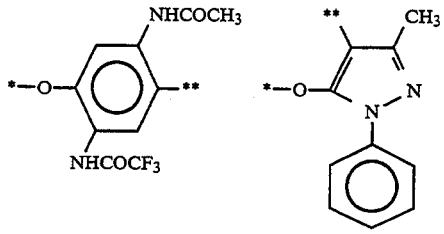

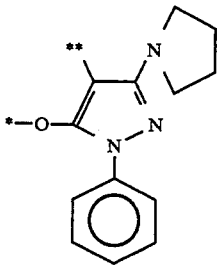

Formula (B-4)

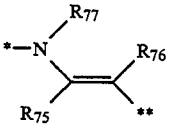

where symbols * and ** represent the same meanings as explained above for (B-1), and each of $R_{75}$, $R_{76}$, and $R_{77}$ represents a substituent. $R_{77}$ and $R_{76}$ may combine to form a nitrogen-containing heterocyclic ring, or $R_{77}$ and $R_{75}$ may combine to form a nitrogen-containing heterocyclic ring. After cleaved at the symbol *, a group represented by (B-4) functions as a coupler having a coupling split-off group at the symbol **.

Practical examples of a group represented by (B-4) are as follows.

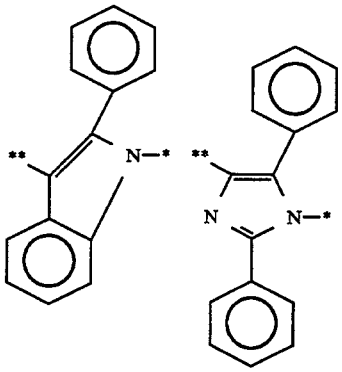

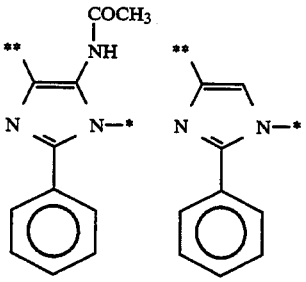

-continued

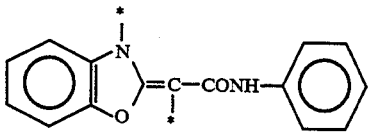

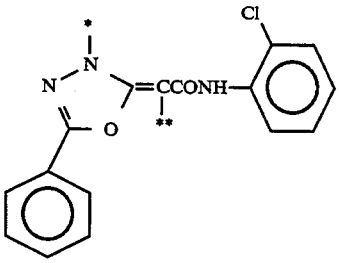

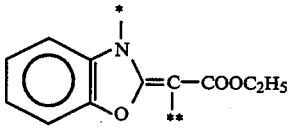

Examples of the group indicated by DI in Formula (X-1) are a tetrazolylthio group, a thiadiazolylthio group, an oxadiazolylthio group, a triazolylthio group, a benzimidazolylthio group, a benzthiazolylthio group, a tetrazolylseleno group, a benzoxazolylthio group, a benzotriazolyl group, a triazolyl group, and a benzoimidazolyl group. These groups are described in, e.g., U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563, and 4,782,012, and British Patent 1,450,479.

Practical examples of the group indicated by DI are as follows. In the following formulas, a symbol * represents the position to be bonded to the left side of the group indicated by DI in Formula (X-1).

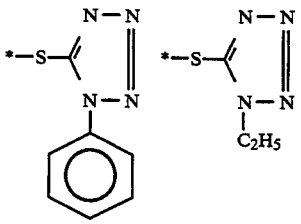

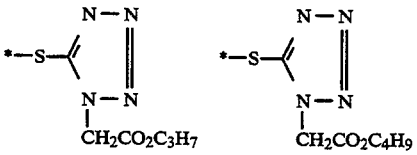

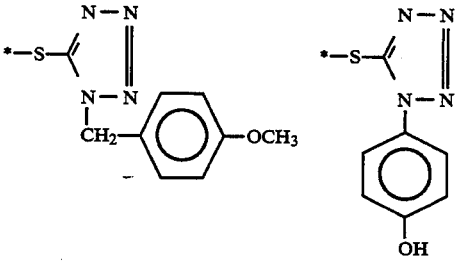

-continued

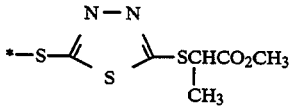

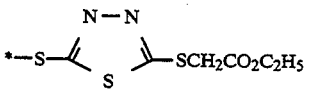

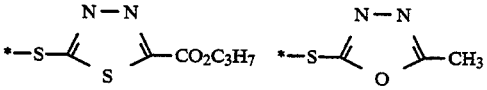

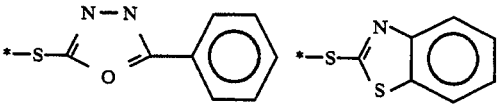

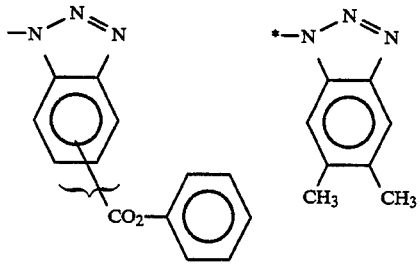

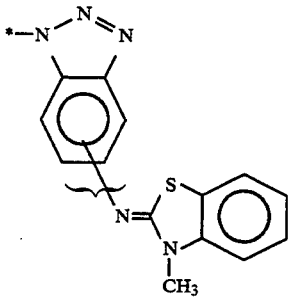

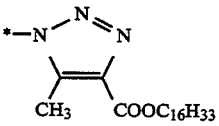

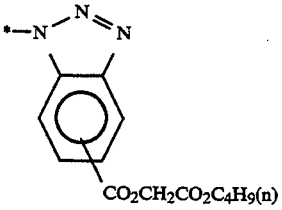

Note that in the above formulas, "{" means that the substituent connects to 5- or 6-position of the benzimidazole group.

Of the above-mentioned groups represented by Formula (X-1), most preferable groups are those represented by Formulas (X-2), (X-3), and (X-4) below:

$-(L_1)-(B)-DI$ Formula (X-2)

$-(L_2)-DI$ Formula (X-3)

—DI Formula (X-4)

where $L_1$, $L_2$, B, and DI have the same meanings as $L_1$, $L_2$, B, and DI in Formula ( X-1).

In a compound represented by Formula (MI) of the present invention, if X is a group which splits off at an oxygen atom, R is preferably a hydrogen atom, an alkyl group, or an aryl group in terms of a coupling reaction speed with the oxidized form of a developing agent. In particular, if X splits off at a group represented by Formula (B-1), it is most preferable that a substituent having a Hammett'$\sigma_p$ value of 0.3 or more be contained in that split-off group in order to improve storage stability in a light-sensitive material.

Examples of the substituent having a Hammett's $\sigma_p$ value of 0.3 or more are an alkyl halide group (e.g., trichloromethyl, trifluoromethyl, or heptafluoropropyl), a cyano group, an acyl group (e.g., formyl, acetyl, or benzoyl), an alkoxycarbonyl group (e.g., methoxycarbonyl or propyloxycarbonyl), an aryloxycarbonyl group (e.g., phenoxycarbonyl), a carbamoyl group (e.g., N-methylcarbamoyl or N-propylcarbamoyl), a sulfamoyl group (e.g., N,N-dimethylsulfamoyl), a sulfonyl group (e.g., methanesulfonyl or benzenesulfonyl), a thiocyanato group, nitro group, a phosphinyl group (e.g., diethylphosphinyl or dimethylphosphinyl), and a heterocyclic group (e.g., 1-pyrrolyl or 2-benzoxazolyl).

A list of practical examples of the group having a Hammett's $\sigma_p$ value of 0.3 or more is given below, but the present invention is not limited to these examples. Note that the number in parentheses following each substituent indicates the $\sigma_p$ value of that substituent. These $\sigma_p$ values are cited from "Structural Activity Correlation of Chemicals" (Extra Number of The Domain of Chemistry, Vol. 122, NanKo Do).

| | | | |
|---|---|---|---|
| $-CO_2C_2H_5$ | (0.45) | $-CONHCH_3$ | (0.36) |
| $-CF_2CF_2CF_2CF_3$ | (0.52) | $-C_6F_5$ | (0.41) |
| $-COCH_3$ | (0.50) | $-COC_6H_5$ | (0.43) |
| $-P(O)(OCH_3)_2$ | (0.53) | $-SO_2NH_2$ | (0.57) |
| $-SCN$ | (0.52) | $-CO_2C_6H_5$ | (0.44) |
| $-CO_2CH_3$ | (0.45) | $-CONH_2$ | (0.36) |
| $-(CF_2)_3CF_3$ | (0.52) | $-CN$ | (0.66) |

In a compound represented by Formula (MI), if X is a group which splits off at a nitrogen atom or a sulfur atom, R is preferably an alkoxy group or an aryloxy group. More preferably, a hydrogen atom, an alkyl group, an aryl group, or a heterocyclic group, and most preferably an aryl group is contained as a substituent for an azole ring portion indicated by Z in order to improve storage stability in a light-sensitive material.

Of compounds represented by Formulas (P-1), (P-2), (P-3), and (P-4) enumerated above as preferable examples of (MI), examples more preferable in terms of the hue of the produced magenta dyes are those represented by Formulas (P-1), (P-2), and (P-3), and those represented by Formulas (P-2) and (P-3) are most preferable.

A compound represented by Formula (MI) can also form a dimer or a polymer of a higher order at the substituent of the azole ring represented by the substituent R or Z through a divalent group or a group of a higher order.

When a compound represented by Formula (MI) forms a polymer, a typical example of the polymer is a homopolymer or a copolymer of an addition-polymerizable ethylenically unsaturated compound having the above compound moiety (color-forming monomer). In this case, the polymer has a repeating unit represented by Formula (V) below. The polymer may contain two or more types of the color-forming repeating units. Also, the copolymer may contain two or more types of non-color-forming ethylenic monomers.

Formula (V)

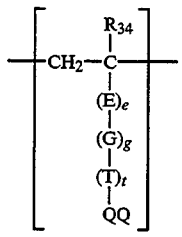

where $R_{34}$ represents a hydrogen atom, an alkyl group having 1 to 4 carbon atoms, or a chlorine atom, E represents —CONH—, $—CO_2—$, or a substituted or unsubstituted phenylene group, G represents a substituted or unsubstituted alkylene, phenylene or aralkylene group, T represents —CONH—, NHCONH—, $—NHCO_2—$, NHCO—, —OCONH—, —NH—, $—CO_2—$, —OCO—, —CO—, —O—, $—SO_2—$, $—NHSO_2—$, or $—SO_2NH—$. Each of e.g. and t represents 0 or 1, with the proviso that they are not simultaneously 0. QQ represents a compound moiety obtained after a hydrogen atom is split off from a compound represented by Formula (I).

Preferable examples of the polymer are copolymers of compound monomers which provide a compound unit represented by Formula (V) with the non-color-forming ethylenic monomers to be described below.

Examples of the non-color-forming ethylenic monomer which does not couple with the oxidized form of an aromatic primary amine developing agent are acrylic acid, α-chloroacrylic acid, α-alkylacrylic acid (for example, methacrylic acid), esters or amides derived from these acrylic acids (for example, acrylamide, methacrylamide, n-butylacrylamide, t-butylacrylamide, diacetoneacrylamide, methylenebisacrylamide, methylacrylate, ethylacrylate, n-propylacrylate, n-butylacrylate, t-butylacrylate, iso-butylacrylate, 2-ethylhexylacrylate, n-octylacrylate, laurylacrylate, methylmethacrylate, ethylmethacrylate, n-butylmethacrylate, and β-hydroxymethacrylate), vinyl esters (for example, vinyl acetate, vinyl propionate, and vinyl laurate), acrylonitrile, methacrylonitrile, aromatic vinyl compounds (for example, styrene and its derivatives, such as vinyl toluene, divinyl benzene, vinyl acetophenone, and sulfostyrene), itaconic acid, citraconic acid, crotonic acid, vinylidene chloride, a vinyl alkyl ether (e.g., vinyl ethyl ether), maleate, N-vinyl-2-pyrrolidone, and N-vinyl pyridine.

In particular, acrylates, methacrylates, and maleates are preferable. The non-color-forming ethylenic monomers herein used can be used in combination of two or more types of them. Examples of the combination are methylacrylate and butylacrylate, butylacrylate and styrene, butylmethacrylate and methacrylic acid, and methylacrylate and diacetoneacrylamide.

In synthesizing a polymer coupler containing a repeating unit represented by Formula (V), as is well known in the field of polymer couplers, a non-color-forming ethylenic monomer to be copolymerized with an ethylenic monomer having the coupler moiety of the present invention can be so selected as to produce good effects on the physical properties and/or the chemical properties of the formed copolymer, for example, solubility, compatibility with a binder, such as gelatin, of a photographic colloidal composition, flexibility, and thermal stability.

A polymer compound for use in the present invention (a lipophilic polymer compound obtained by polymerization of a vinyl-based monomer which provides a compound unit represented by Formula (V)) may be emulsified and dispersed by dissolving it in an organic solvent and emulsifying and dispersing the solution in an aqueous gelatin solution in the form of a latex. Alternatively, the polymer compound may be directly prepared by emulsion polymerization.

The method described in U.S. Pat. No. 3,451,820 can be used as the method of emulsion-dispersing a lipophilic polymer compound in an aqueous gelatin solution in the form of a latex, and the methods described in U.S. Pat. Nos. 4,080,211 and 3,370,952 can be used for the emulsion polymerization.

Practical examples of a compound represented by Formula (MI) used in the present invention are presented below, but the present invention is not limited to these examples.

(1)

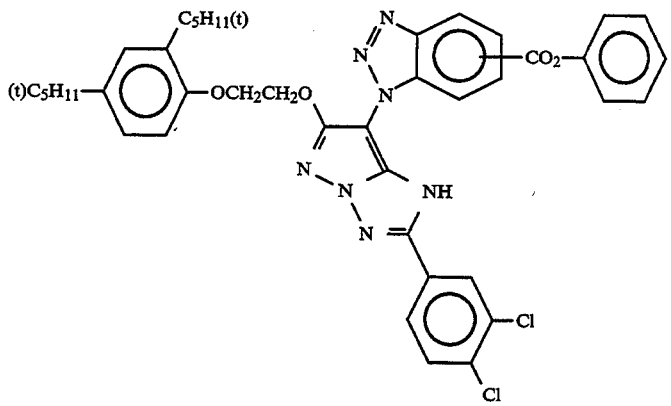

(2)

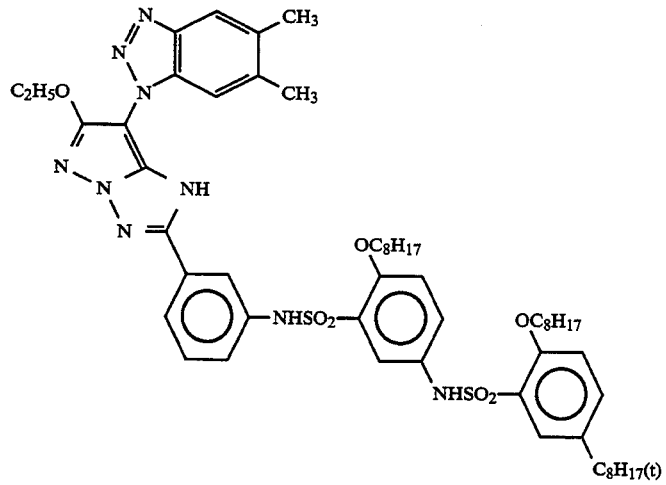

(3)

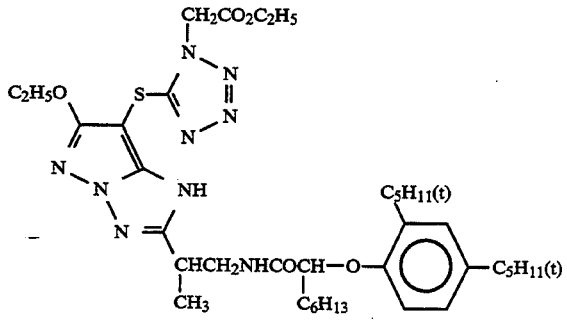

-continued
(4)
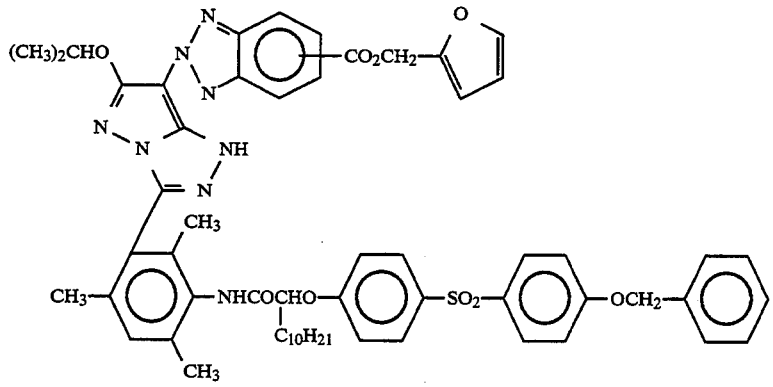
(5)
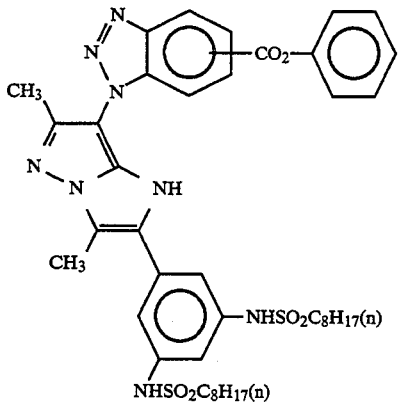
(6)
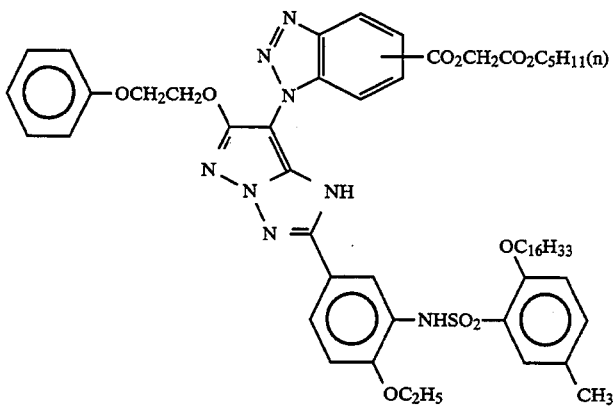
(7)
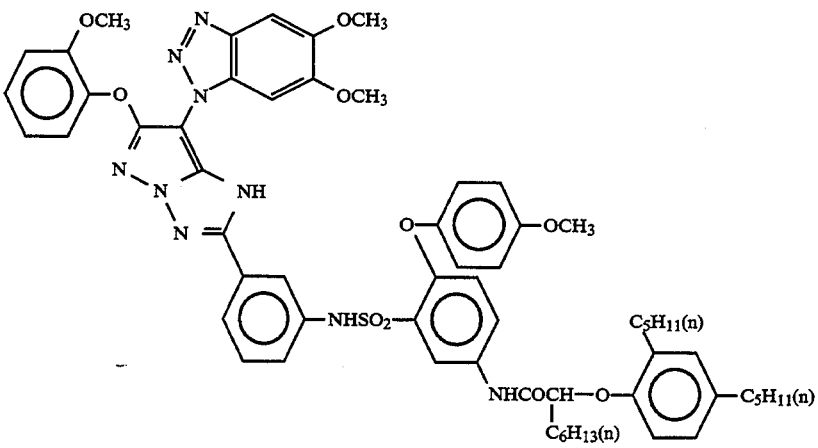

-continued
(8)
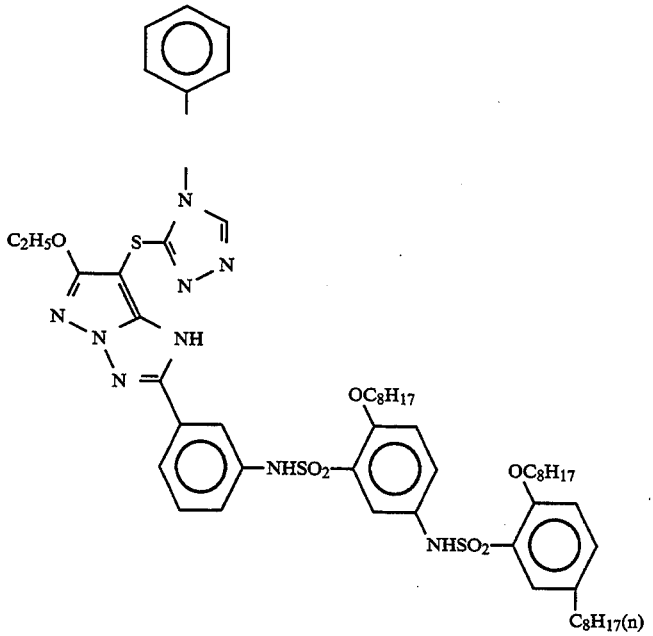
(9)
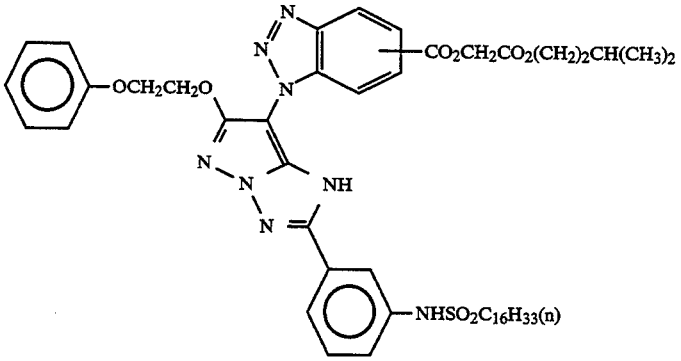
(10)
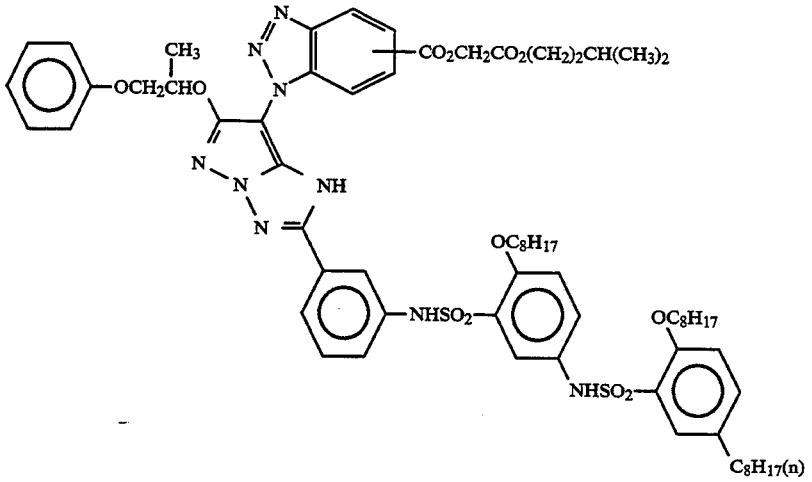

-continued
(11)
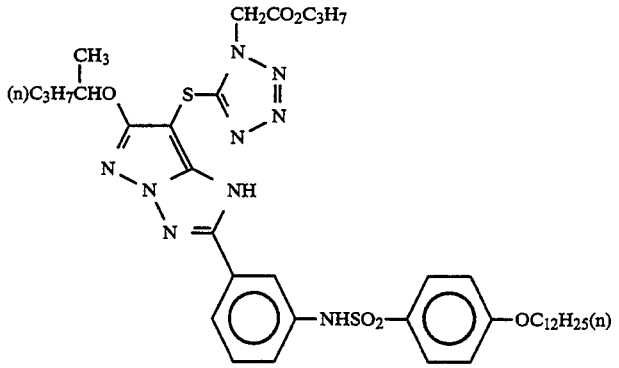
(12)
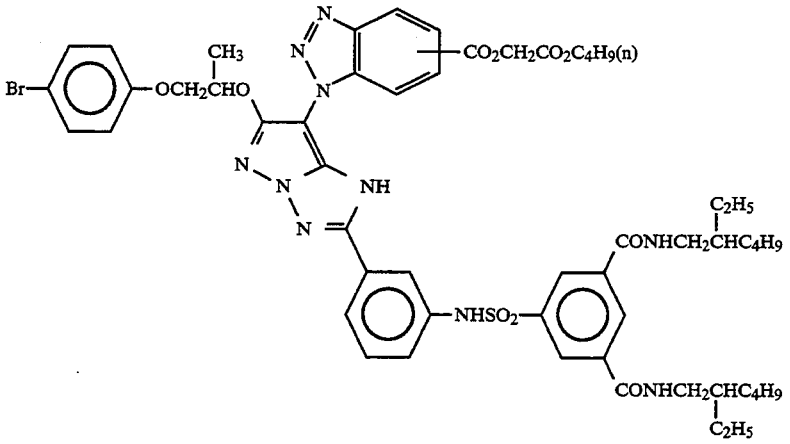
(13)
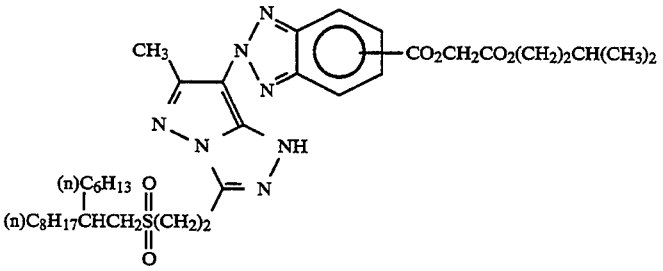
(14)
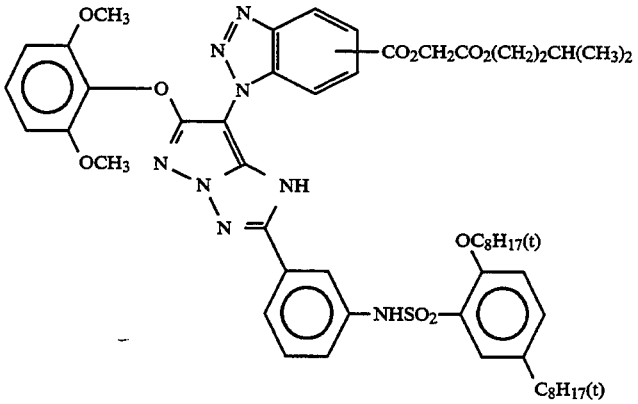

-continued
(15)
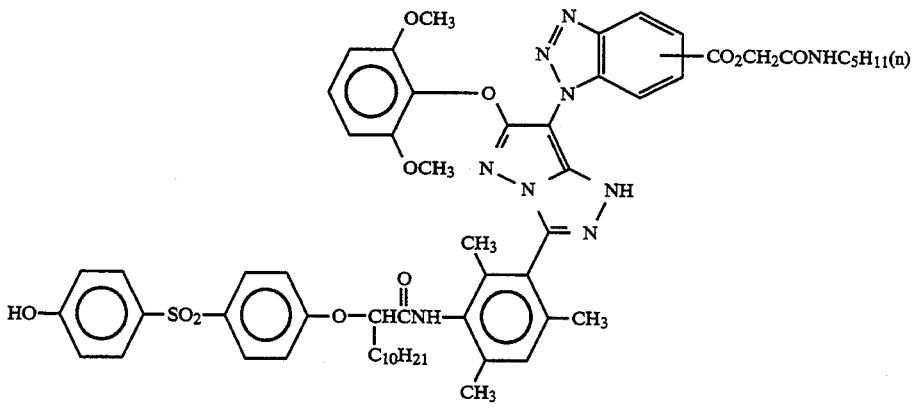
(16)
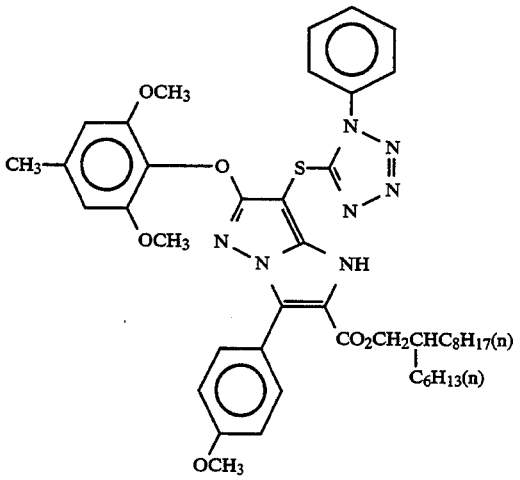
(17)
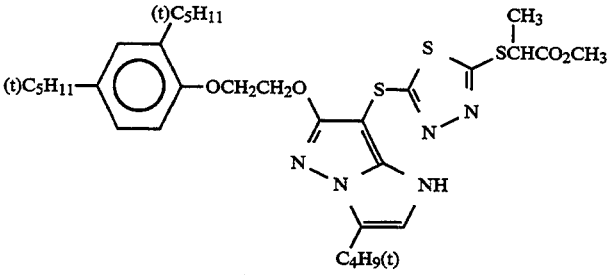
(18)
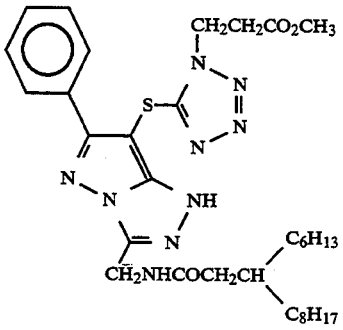

-continued
(19)
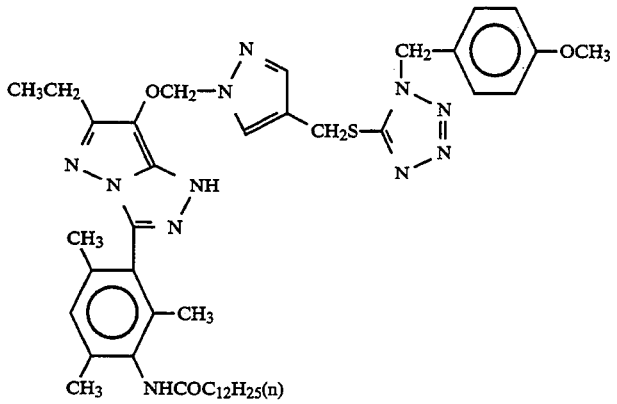
(20)
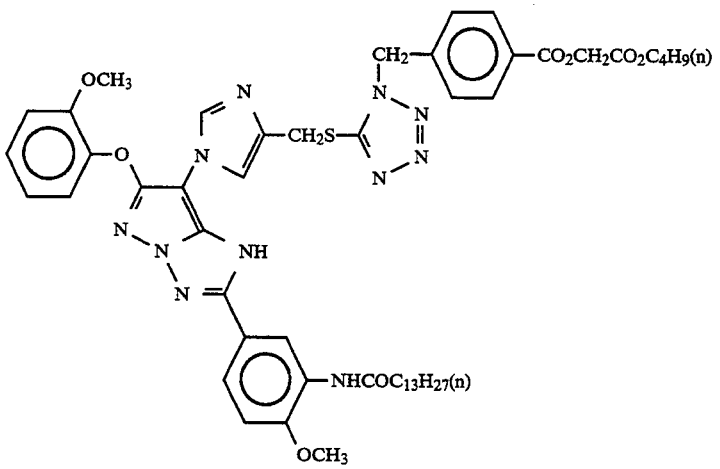
(21)
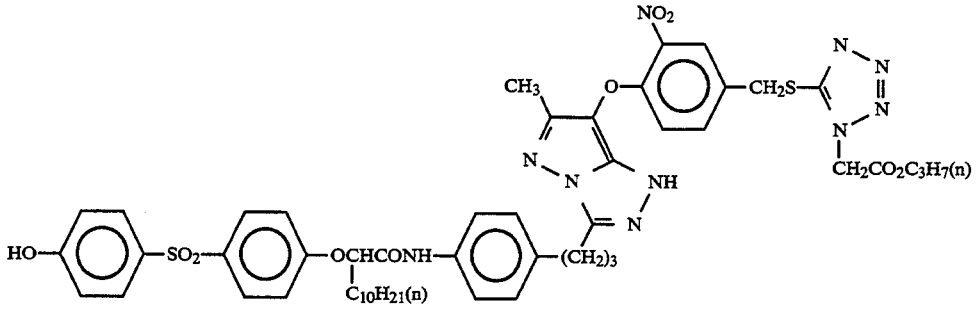
(22)
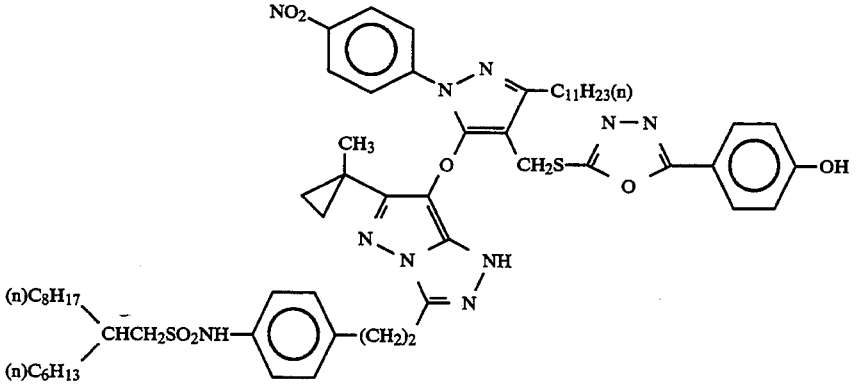

-continued
(23)
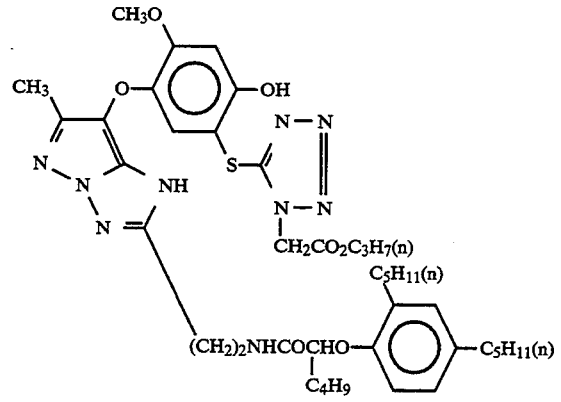
(24)
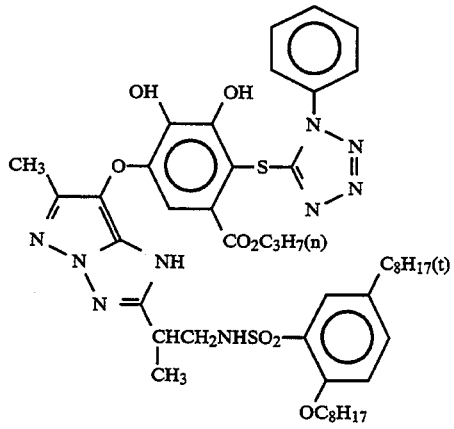
(25)
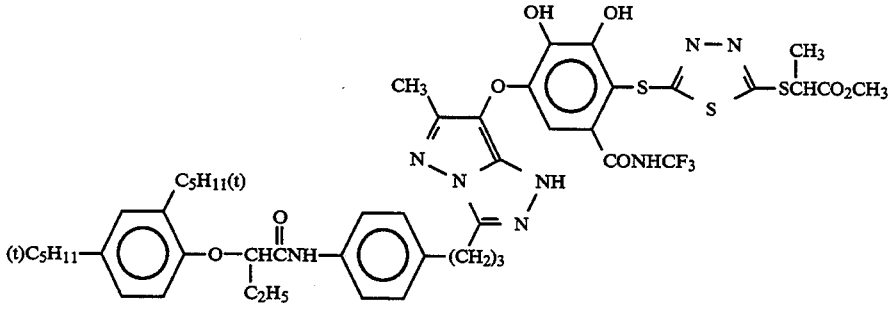
(26)
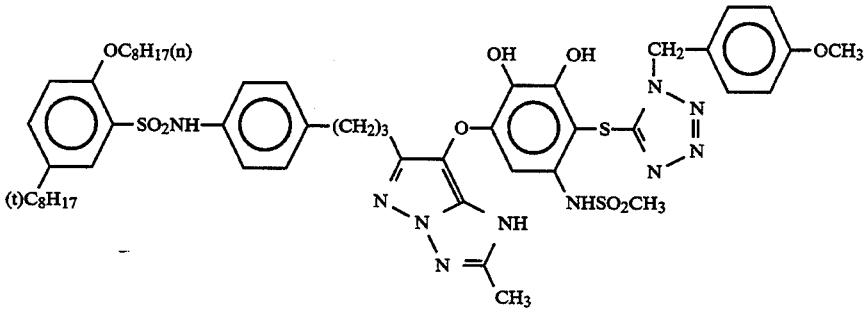

-continued
(27)
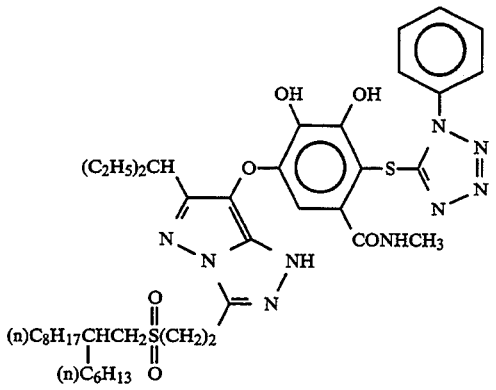
(28)
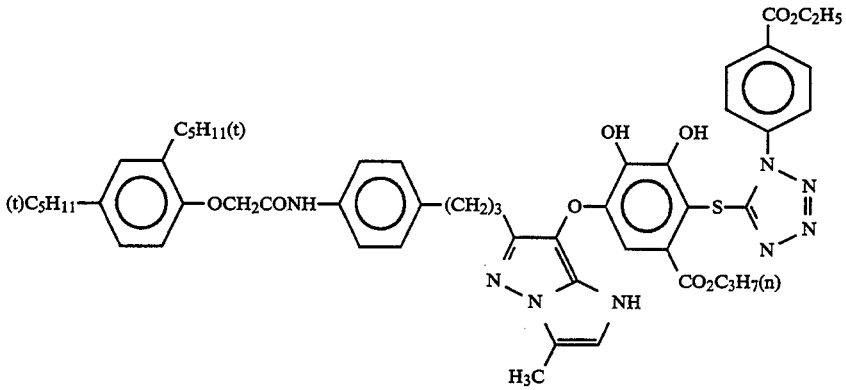
(29)
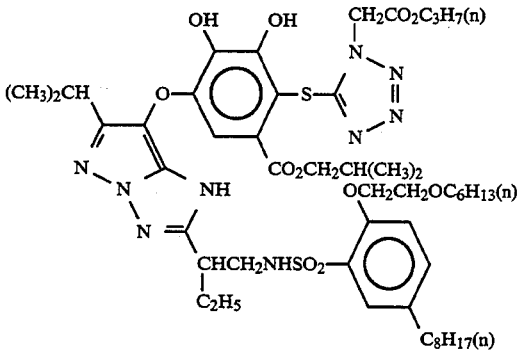
(30)
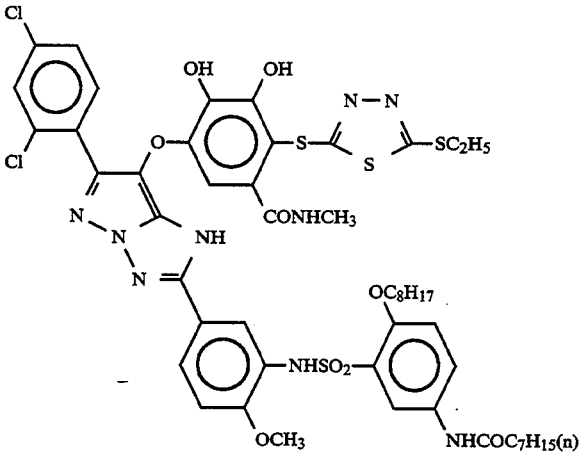

-continued
(31)
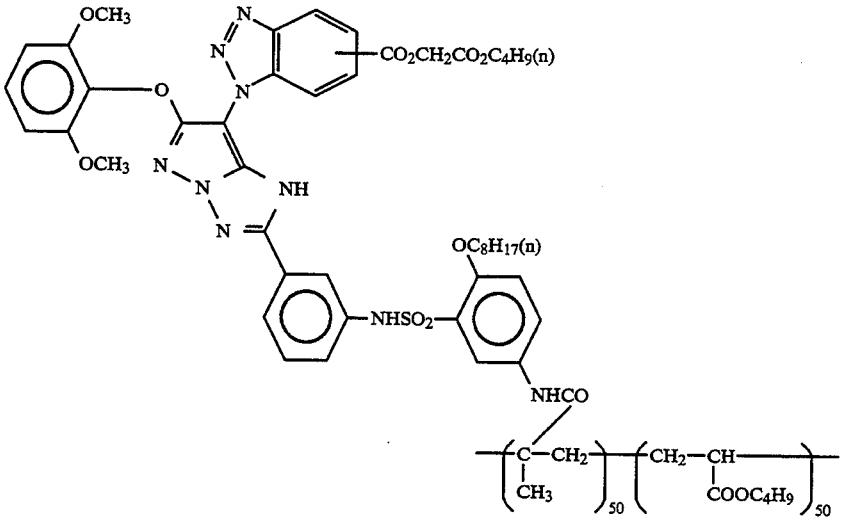
(32)
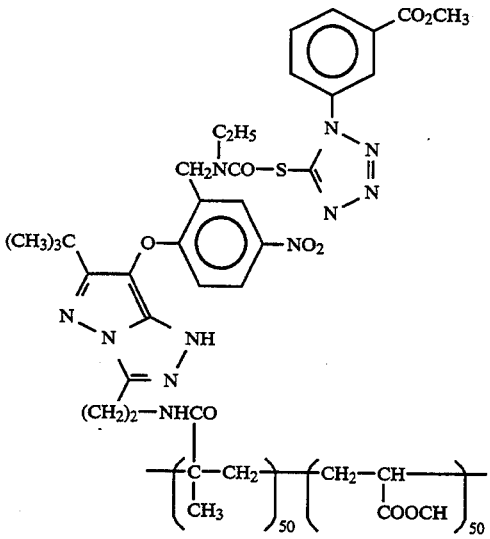
Compounds represented by Formula (MI) can be synthesized by the methods described in, e.g., U.S. Pat. Nos. 4,500,630, 4,540,654, and 4,705,863, JP-A-61-65245, JP-A-62-209457, JP-A-62-249155, U.S. Pat. No. 3,725,067, JP-A-60-33552, JP-A-61-28947, JP-A-63-584159, JP-A-2-59584, and U.S. Pat. Nos. 4,659,652, and methods according to these methods.
Synthesis examples of compounds according to the present invention will be described below.
Synthesis Example 1 [Synthesis of exemplified compound (2)]
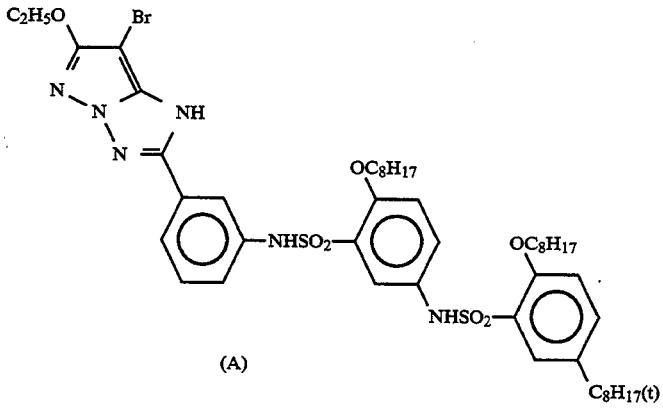
(A)

-continued

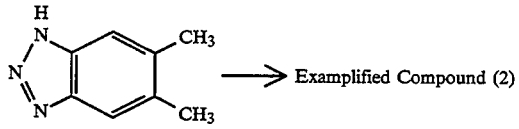

1.95 g (0.049 mol) of sodium hydride were added to 100 ml of 1,3-dimethylimidazolidin-2-one, and the mixture was stirred under cooling in an ice-water bath. 7.18 g (0.049 mol) of 5,6-dimethylbenzotriazole were added in portions to the resultant solution several times over 20 minutes. After stirred for 10 minutes, the resultant solution was added with 19.2 g (0.020 mol) of a compound (A), and the mixture was stirred at 80° C. for 40 minutes. The resultant solution was cooled, added with 300 ml of ethylacetate, 300 ml of water and 8 ml of concentrated hydrochloric acid, and was subjected to extraction. The organic layer was washed with water, a saturated aqueous sodium bicarbonate solution, and saturated aqueous sodium chloride solution in sequence and dried over anhydrous magnesium sulfate. The resultant organic layer was concentrated, and the obtained oily product was developed through a silica gel column chromatography (eluent: chloroform/ethylacetate) to obtain 14.1 g (yield 69%) of the exemplified compound (2) as a glassy solid. The obtained glassy solid was dissolved in 20 ml of ethylacetate under heating, the resultant solution was added with 80 ml of hexane, and the mixture was left to stand. The precipitated crystals were filtered out to obtain 10.9 g of the exemplified compound (2) as colorless crystals. The melting point was 131° to 133° C.

$^1$H-NMR spectrum (200 MHz, $CDCl_3$) δ12.92 (brs, 1H), 7.67 (d, 1H, J=2.2 Hz), 7.5–7.3 (m, 4H), 7.26 (s, 1H), 7.08 (brs, 1H), 6.90 (d, 1H, J=8.7 Hz), 6.81 (d, 1H, J=8.8 Hz), 5.66 (brs, 1H), 4.39 (q, 2H, J=7.1 Hz), 4.15 (t, 2H, J=6.7 Hz), 4.00 (brs, 2H), 3.4–3.1 (m, 3H), 2.36 (s, 3H), 2.30 (s, 3H), 2.0–1.8 (m, 5H), 1.60 (s, 2H), 1.5–1.2 (m, 32H), 0.85 (m, 6H), 0.51 (s, 9H).

Synthesis Example 2 [Synthesis of exemplified compound (8)]

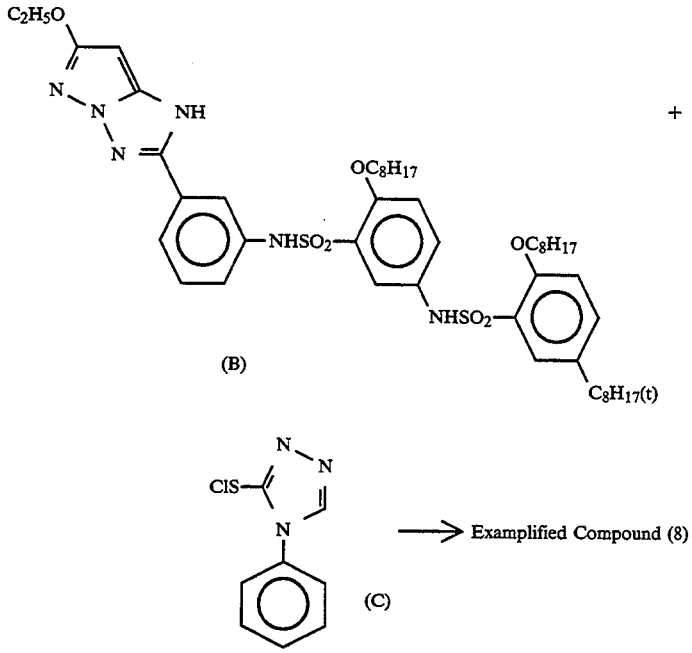

4.4 g (0.025 mol) of 4-phenyl-3-mercapto-1,2,4-triazole were added to 50 ml of dichloromethane, and the mixture was stirred under cooling by water at 18° C. 2.2 ml (0.027 mol) of sulfuryl chloride were added dropwise in the resultant solution over 10 minutes, and the mixture was stirred for 15 minutes. The dichloromethane was distilled off under reduced pressure to obtain a compound (C) as pale yellow crystals. 15.0 g (0.017 mol) of a compound (B) were added to 300 ml of N,N-dimethylformamide, and the mixture was stirred at room temperature. The crystals of the previously synthesized compound (C) were added in portions to the resultant solution several times over one hour. After left to stand overnight, the resultant solution was added with 150 ml of ethylacetate and 150 ml of water, and subjected to exraction. The organic layer was washed with a saturated aqueous sodium bicarbonate solution twice and a saturated aqueous sodium chloride solution once, and dried over anhydrous magnesium sulfate. The resultant organic layer was concentrated, and the obtained oily product was developed through a silica gel column chromatography (eluent: chloroform/ethylacetate) to obtain the exemplified compound (8) as a glassy solid. The obtained glassy solid was dissolved in 20 ml of ethylacetate under heating, the resultant solution was added with 40 ml of hexane, and the mixture was left to stand. The precipitated crystals were filtered out to obtain 13.8 g (yield 77%) of the exemplified compound (8) as colorless crystals. The melting point was 158° to 162° C.

$^1$H-NMR spectrum (200 MHz, $CDCl_3$) δ13.89 (brs, 1H), 8.39 (s, 1H), 7.65 (d, 1H, J=2.3 Hz), 7.6–7.3 (m, 11H), 7.2–7.0 (m, 3H), 6.77 (m, 2H), 4.1–3.9 (m, 7H), 1.84 (m, 4H), 1.6–1.3 (m, 31H), 0.86 (m, 6H), 0.46 (s, 9H).

Synthesis Example 3 [Synthesis of exemplified compound (10)]

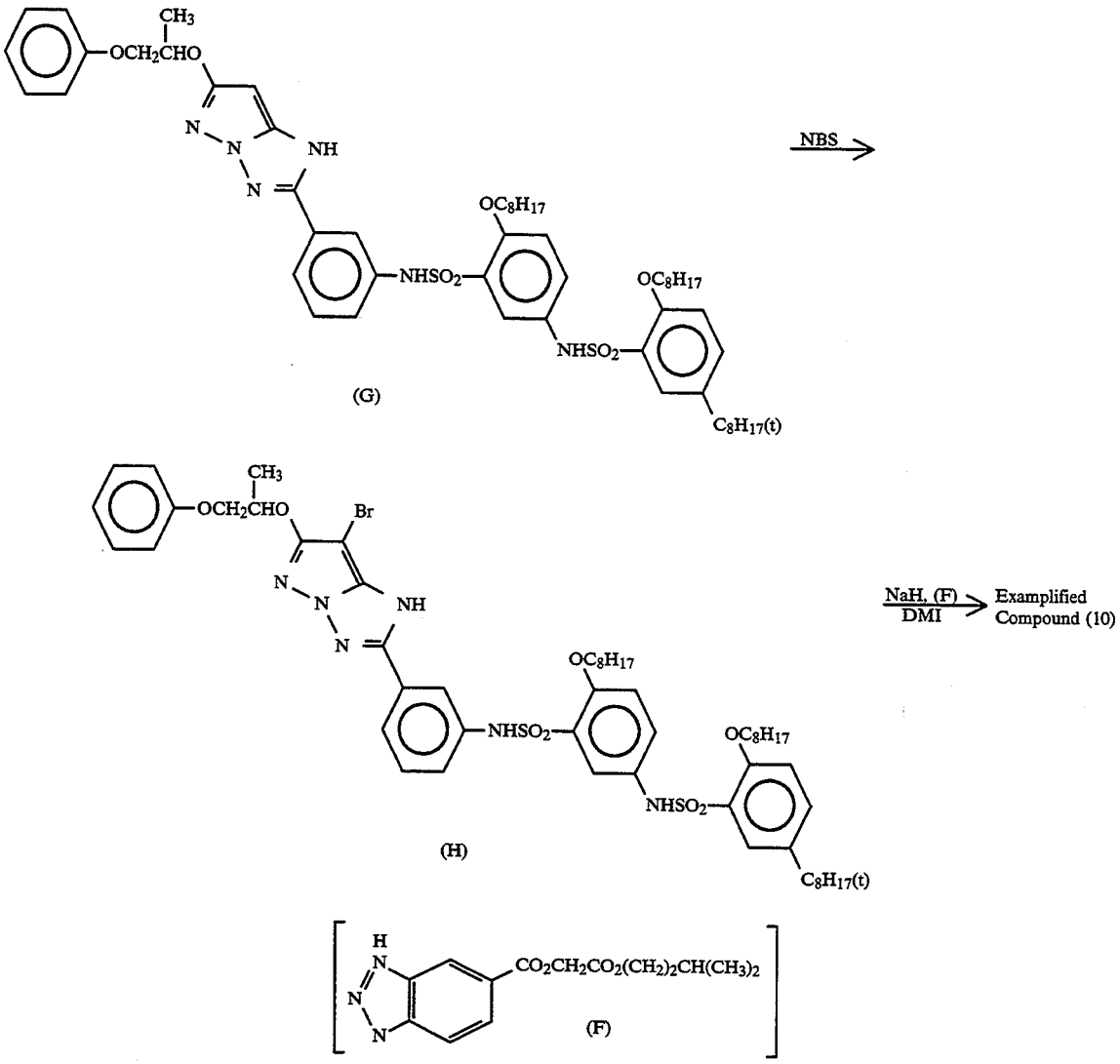

25.0 g (23.7 mmol) of an intermediate (G) were dissolved in 150 ml of chloroform, and the solution was cooled in a water bath under stirring. 4.18 g (23.5 mmol) of N-bromosuccinimide were added to the resultant solution, and the mixture was stirred for 25 minutes. After washed with 100 ml of water twice, the resultant reaction mixture was dried over anhydrous magnesium sulfate and concentrated to obtain an intermediate (H). 2.96 g (74.1 mmol) of sodium hydride (dispersed in mineral oil, content 60 wt %) were added to 80 ml of 1,3-dimethylimidazolidin-2-one (DMI), and the mixture was cooled in an ice-water bath under stirring. 21.6 g (74.1 mmol) of an intermediate (F) were gradually added to the resultant solution over 20 minutes. After removed from the ice-water bath, the resultant mixture was stirred for 10 minutes and added with a solution prepared by dissolving the previously synthesized intermediate (H) into 140 ml of DMI. The mixture was stirred at 45° C. for 0.5 hour and further at 55° C. for 1.5 hours. The reaction mixture was cooled, added with 400 ml of ethylacetate and 500 ml of water, and subjected to extraction. The organic layer was washed with 300 ml of a saturated aqueous sodium bicarbonate solution twice, 300 ml of dilute hydrochloric acid once, and 300 ml of a saturated aqueous sodium chloride solution. After dried over anhydrous magnesium sulfate, the organic layer was concentrated and purified through a silica gel column chromatography (eluent: a solvent mixture of hexane/ethylacetate) to obtain 16.2 g (yield 50%) of the exemplified compound (10) as a pale yellow-orange-colored glassy solid.

Mass spectrum (FAB, Negative) m/e=1,300 ([M-H]−)

Synthesis Example 4 [Synthesis of exemplifed compound (24)]

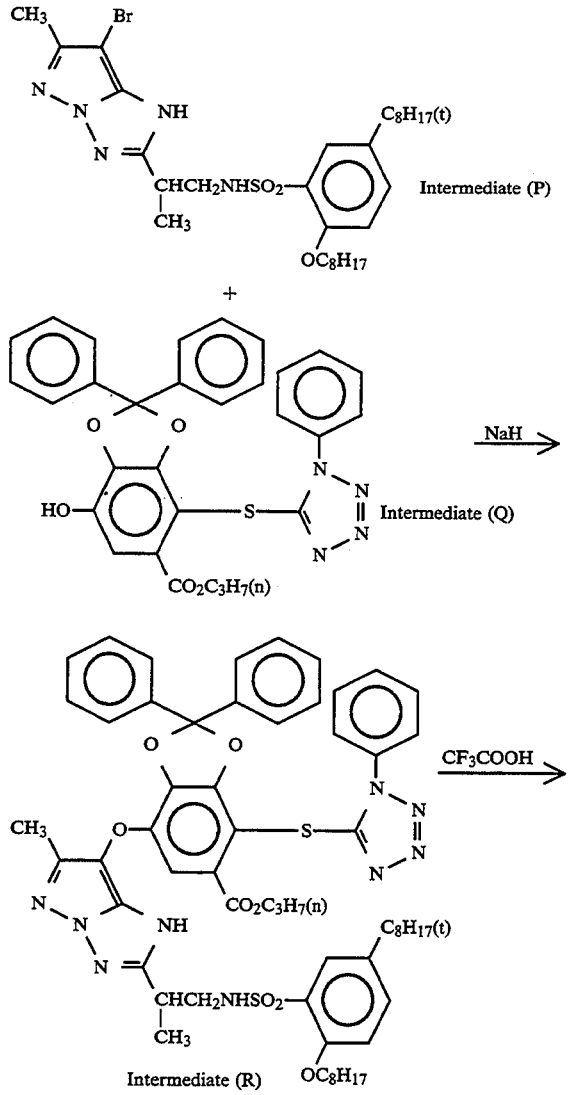

Examplified Compound (24)

Synthesis of intermediate (R)

6.00 g of sodium hydride (dispersed in mineral oil, content 60 wt %) were added to 150 ml of 1,3-dimethyl-2-imidazolidone, and the mixture was cooled in a water bath under stirring. 82.9 g of an intermediate (Q) were added in portions to the resultant solution several times over about 10 minutes, and the mixture was removed from the water bath and stirred for 10 minutes. 31.9 g of an intermediate (P) were added to the resultant solution, and the mixture was stirred for 10 minutes at room temperature. Thereafter, the resultant solution was heated up to 120° to 130° C. and stirred for about one hour. After the heating was ceased and the solution was cooled to room temperature, the solution was added with 400 ml of ethylacetate, 400 ml of water and 6 ml of concentrated hydrochloric acid, and was subjected to extraction. The organic layer was washed with 400 ml of water and 400 ml of a saturated aqueous sodium chloride solution twice, and dried over anhydrous magnesium sulfate. The resultant organic layer was concentrated under reduced pressure, and the residue was purified through a silica gel column chromatography (eluent: a solvent mixture of hexane/ethylacetate) to obtain 18.7 g (34%) of an intermediate (R) as an amorphous solid.

Synthesis of exemplified compound (24)

14.4 g of the intermediate (R) were dissolved in 45 ml of trifluoroacetic acid. 2.25 ml of water were added to the resultant solution, and the mixture was stirred at 50° C. for 16 hours. The resultant solution was cooled, added with 200 ml of ethylacetate and 200 ml of water, and was subjected to extraction. The organic layer was washed with 150 ml of a saturated aqueous sodium bicarbonate solution twice and 150 ml of a saturated aqueous sodium chloride solution once. The resultant organic layer was dried over anhydrous sodium sulfate and concentrated under reduced pressure. The residue was purified through a silica gel column chromatography (eluent: a solvent mixture of hexane/ethylacetate/ethanol) to obtain 8.1 g (66%) of the exemplified compound (24) as an amorphous solid.

$^1$H-NMR spectrum ($CDCl_3$) δ11.5 (br), 7.84 (d, 1H), 7.9–7.6 (br), 7.50 (m, 6H), 6.94 (d, 1H), 6.84 (brs, 1H), 5.75 (br, 1H), 4.10 (m, 4H), 3.18 (m, 3H), 2.08 (brs, 3H), 1.9–1.2 (m, 25H), 0.80 (m, 6H), 0.70 (s, 9H).

Although compounds represented by Formula (MI) of the present invention can be added to any layer, they are preferably added to green-sensitive emulsion layers and/or their adjacent layers, or interlayers. These compounds may be used singly or in combination of two or more of them. The compounds can also be used in combination with a compound other than the present invention, which reacts with one or two molecules of the oxidized form of a developing agent to release a development inhibitor or a precursor thereof. When the compound other than the present invention is used in the same layer as the compounds of the present invention, the ratio of its addition amount is 1 to 200 mol %, preferably 5 to 100 mol % with respect to 1 mol of the compounds of the present invention. When the compound other than the present invention is added to layers different from those of the compounds of the present invention, the ratio of its addition amount can be arbitrarily selected. In this case, however, the addition amount is $1\times10^{-4}$ to 1 mol % per mol of a silver halide in the same or adjacent layer.

The total addition amount of compounds represented by Formula (MI) of the present invention to the light-sensitive material is 0.001 to 0.85 g/m$^2$, preferably 0.005 to 0.65 g/m$^2$, and more preferably 0.02 to 0.45 g/m$^2$.

The compounds of the present invention can be added to the light-sensitive material in the same manner as conventional coupler-dispersing methods to be described later.

The acylacetamide-type yellow coupler for use in the present invention, in which the acyl group is represented by Formula (YI), will be described in more detail below.

The acylacetamide-type yellow coupler of the present invention is preferably represented by Formula (YII) below:

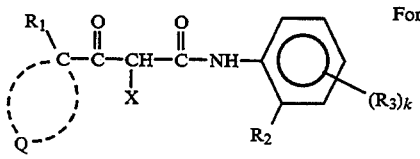

Formula (YII)

where $R_1$ represents a monovalent substituent except for a hydrogen atom; Q represents a nonmetallic atomic group required to form, together with C, a 3- to 5-membered hydrocarbon ring or a 3- to 5-membered heterocyclic ring containing at least one heteroatom selected from N, S, O, and P in its ring; $R_2$ represents a hydrogen atom, a halogen atom (F, Cl, Br, or I; the same shall apply throughout the remainder of explanation of Formula (Y)), an alkoxy group, an aryloxy group, an alkyl group, or an amino group; $R_3$ represents a group substitutable on a benzene ring; X represents a hydrogen atom or a group (to be referred to as a split-off group hereinafter) which can split off upon a coupling reaction with the oxidized form of an aromatic primary amine developing agent; and k represents an integer from 0 to 4. If k is the plural number, a plurality of $R_3$'s may be identical or different. $R_1$ is preferably an organic moiety not containing a metal atom, and more preferably a hydrocarbon group which may have a substituent.

Examples of $R_3$ are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an aryloxysulfonyl group, an acyloxy group, a nitro group, a heterocyclic group, a cyano group, an acyl group, an acyloxy group, an alkylsulfonyloxy group, and an arylsulfonyloxy group. Examples of the split-off group area heterocyclic group which combines with the coupling active position at a nitrogen atom, an aryloxy group, an arylthio group, an acyloxy group, an alkylsulfonyloxy group, an arylsulfonyloxy group, a heterocyclic oxy group, a heterocyclic thio group, and a halogen atom.

When the substituent in Formula (YII) is an alkyl group or contains an alkyl group, this alkyl group means a straight-chain, branched, or cyclic alkyl group which may be substituted or may contain an unsaturated bond (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, or phenoxyethyl), unless otherwise specified.

When the substituent in Formula (YII) is an aryl group or contains an aryl group, this aryl group means a monocyclic or polycyclic aryl group which may be substituted (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, or 3,4-dichlorophenyl), unless otherwise specified.

When the substituent in Formula (YII) is a heterocyclic group or contains a heterocyclic group, this heterocyclic group means a 3- to 8-membered monocyclic or condensed-ring heterocyclic group which contains at least one heteroatom selected from O, N, S, P, Se, and Te in its ring and may be substituted (e.g., 2-furyl, 2-pyridyl, 4-pyridyl, 1-pyrazolyl, 1-imidazolyl, 1-benzotriazolyl, 2-benzotriazolyl, succinimide, phthalimide, or 1-benzyl-2,4-imidazolidinedione-3-yl), unless otherwise specified.

The substituents preferably used in Formula (YII) will be described below.

In Formula (YII), $R_1$ is preferably a halogen atom, a cyano group, a monovalent group which may be substituted and has a total number of carbon atoms (to be referred to as a C number hereinafter) of 1 to 30 (e.g., an alkyl group, an alkoxy group, or an alkylthio group), or a monovalent group which may be substituted and has a C number of 6 to 30 (e.g., an aryl group, an aryloxy group, or an arylthio group). Examples of substituents of these groups are a halogen atom, an alkyl group, an alkoxy group, a nitro group, an amino group, a carbonamido group, a sulfonamido group, and an acyl group.

In formula (YII), Q preferably represents a non-metallic atomic group required to form, together with C, a 3- to 5-membered hydrocarbon ring which may be substituted and has a C number of 3 to 30 or a 3- to 5-membered heterocyclic ring which may be substituted, contains at least one heteroatom selected from N, S, O, and P, and has a C number of 2 to 30. The ring that Q forms together with C may contain an unsaturated bond in its ring. Examples of the ring that Q forms together with C are a cyclopropane ring, a cyclobutane ring, a cyclopentane ring, a cyclopropene ring, a cyclobutene ring, a cyclopentene ring, an oxetane ring, an oxorane ring, a 1,3-dioxorane ring, a thiethane ring, a thiorane ring, and a pyrrolidine ring. Examples of the substituents thereof are a halogen atom, a hydroxyl group, an alkyl group, an aryl group, an acyl group, an alkoxy group, an aryloxy group, a cyano group, an alkoxycarbonyl group, an alkylthio group, and an arylthio group.

In Formula (YII), $R_2$ preferably represents a halogen atom; or an alkyl group having a C number of 1 to 30, an aryloxy group having a C number of 6 to 30, an alkoxy group having a C number of 1 to 30, or an amino group having a C number of 0 to 30, each of which may be substituted. Examples of the substituents are a halogen atom, an alkyl group, an alkoxy group, and an aryloxy group.

In Formula (YII), $R_3$ preferably represents a halogen atom; or an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamido group having a C number of 1 to 30, a sulfonamido group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, a ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30, each of which may be substituted. Examples of the substituents thereof are a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In Formula (YII), k preferably represents an integer of 1 or 2, and the substitution position of $R_3$ is preferably a meta or para position with respect to the acylacetamido group.

In Formula (YII), X preferably represents a heterocyclic group which combines with the coupling active position through a nitrogen atom, or an aryloxy group.

When X represents a heterocyclic group, X is preferably a 5- to 7-membered monocyclic or condensed-ring heterocyclic group which may be substituted. Examples of the heterocyclic group are succinimide, maleinimide, phthalimide, diglycolimide, pyrrole, pyrazole, imidazole, 1,2,4-triazole, tetrazole, indole, indazole, benzimidazole, benzotriazole, imidazolidin-2,4-dione, oxazolidin-2,4-dione, thiazolidin-2,4-dione, imidazolidin-2-one, oxazolidin-2-one, thiazolidin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one. These heterocyclic rings may be substituted.

Examples of the substituents of these heterocyclic rings are a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group.

When X represents an aryloxy group, X preferably represents an aryloxy group having a C number of 6 to 30, which may be substituted with a group selected from the substituents enumerated above for the case wherein X is a heterocyclic group. Preferable examples of the substituent for an aryloxy group are a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, and a cyano group.

The substituents particularly preferably used in Formula (YII) will be described below.

$R_1$ is particularly preferably an alkyl group having a C number of 1 to 30 (e.g., methyl, ethyl, n-propyl, n-butyl, isobutyl, n-octyl, n-dodecyl, phenoxymethyl, phenylthiomethyl, p-toluenesulfonylmethyl, benzyl, cyclohexylmethyl, or methoxyethyl), and most preferably an alkyl group having a C number of 1 to 4.

Q is particularly preferably a nonmetallic atomic group required to form a 3- to 5-membered hydrocarbon ring together with C. Examples of Q are an ethylene group, a trimethylene group, and a tetramethylene group, each of which may be substituted. Examples of the substituents thereof are an alkyl group, an alkoxy group, an aryl group, and a halogen atom.

Q is most preferably a substituted or unsubstituted ethylene group.

$R_2$ is particularly preferably a chlorine atom, a fluorine atom, an alkyl group having a C number of 1 to 6 (e.g., methyl, trifluoromethyl, ethyl, isopropyl, or t-butyl), an alkoxy group having a C number of 1 to 8 (e.g., methoxy, ethoxy, methoxyethoxy, butoxy, or hexadecyloxy), or an aryloxy group having a C number of 6 to 24 (e.g., phenoxy, p-tolyloxy, or p-methoxyphenoxy), and most preferably a chlorine atom, methoxy, or trifluoromethyl.

$R_3$ is particularly preferably a halogen atom, a cyano group, a trifluoromethyl group, an alkoxy group, an alkoxycarbonyl group, an aryloxycarbonyl group, a carbonamido group, a sulfonamido group, a carbamoyl group, or a sulfamoyl group, and most preferably a chlorine atom, an alkoxy group, an alkoxycarbonyl group, a sulfamoyl group, a carbonamido group, or a sulfonamido group.

X is particularly preferably a group represented by Formula (Y-1), (Y-2), or (Y-3) below:

Formula (Y-1)

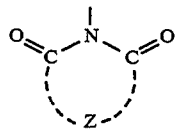

Formula (Y-2)

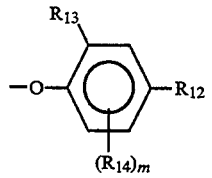

Formula (Y-3)

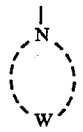

In Formula (Y-1), Z represents —O—$CR_4(R_5)$—, —S—$CR_4(R_5)$—, $NR_6$—$CR_4(R_5)$—, —$NR_6$—$NR_7$—, —$NR_6$—C—(O)—, —$CR_4(R_5)$—$CR_8(R_9)$—, or $CR_{10}$=$CR_{11}$—.

Each of $R_4$, $R_5$, $R_8$, and $R_9$ represents a hydrogen atom, an alkyl group, an aryl group, an alkoxy group, an aryloxy group, an alkylthio group, an arylthio group, an alkylsulfonyl group, an arylsulfonyl group, or an amino group, each of $R_6$ and $R_7$ represents a hydrogen atom, an alkyl group, an aryl group, an alkylsulfonyl group, an arylsulfonyl group, or an alkoxycarbonyl group, and each of $R_{10}$ and $R_{11}$ represents a hydrogen atom, an alkyl group, or an aryl group. $R_{10}$ and $R_{11}$ may combine to form a benzene ring. $R_4$ and $R_5$, $R_5$ and $R_6$, $R_6$ and $R_7$, or $R_4$ and $R_8$ may combine to form a ring (e.g., cyclobutane, cyclohexane, cycloheptane, cyclohexene, pyrrolidine, or piperidine).

Of heterocyclic groups represented by Formula (Y-1), the most preferable heterocyclic group is the one in which Z is —O—$CR_4(R_5)$—, $NR_6$—$CR_4(R_5)$, or $NR_6$—$NR_7$— in Formula (Y-1). The C number of a heterocyclic group represented by Formula (Y-1) is 2 to 30, preferably 4 to 20, and more preferably 5 to 16.

In Formula (Y-2), at least one of $R_{12}$ and $R_{13}$ is a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, or an acyl group, while the other one may be a hydrogen atom, an alkyl group, or an alkoxy group. $R_{14}$ represents a group having the same meaning as $R_{12}$ or $R_{13}$, and m represents an integer from 0 to 2. The C number of an aryloxy group represented by Formula (Y-2) is 6 to 30, preferably 6 to 24, and more preferably 6 to 15.

In Formula (Y-3), W represents a nonmetallic atomic group required to form, together with N, a pyrrole ring, pyrazole ring, an imidazole ring, or a triazole ring. A ring represented by Formula (Y-3) may have a substituent. Preferable examples of the substituent are a halogen atom, a nitro group, a cyano group, an alkoxycarbonyl group, an alkyl group, an aryl group, an amino group, an alkoxy group, an aryloxy group, and a carbamoyl group. The C number of a heterocyclic group represented by Formula (Y-3) is 2 to 30, preferably 2 to 24, and more preferably 2 to 16.

X is most preferably a group represented by Formula (Y-1).

A coupler represented by Formula (YII) may form dimers or polymers of a higher order by bonding with each other, directly or through a divalent or higher-valence group, at its substituent $R_1$, $R_2$, $R_3$, Q, or X. In this case, the number of carbon atoms may fall outside the range defined above for each substituent.

Practical examples of a yellow coupler represented by Formula (YII) are presented below.

Y-1

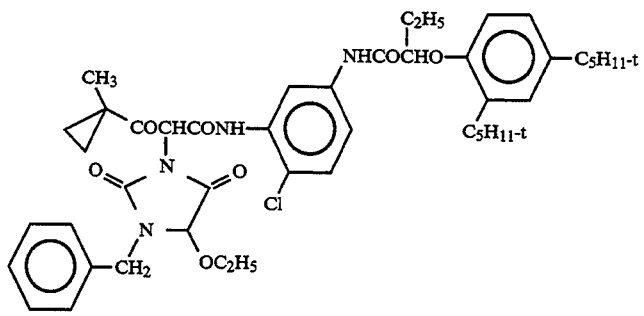

Y-2

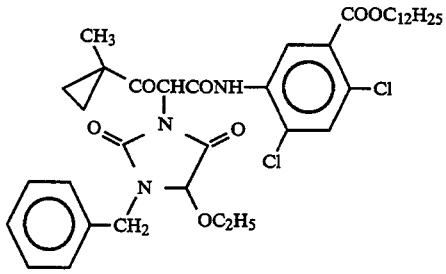

Y-3

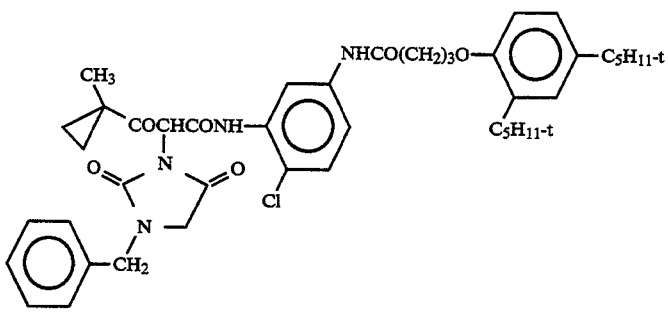

Y-4

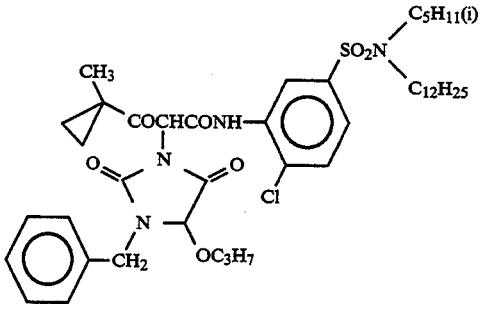

-continued
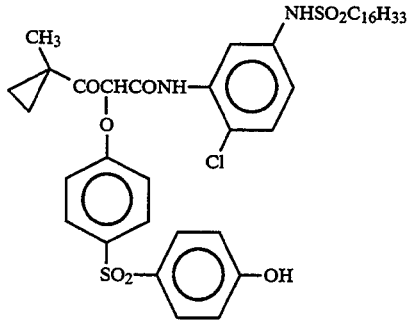
Y-5
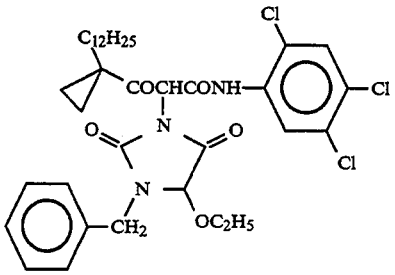
Y-6
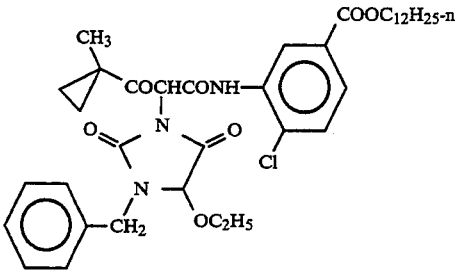
Y-7
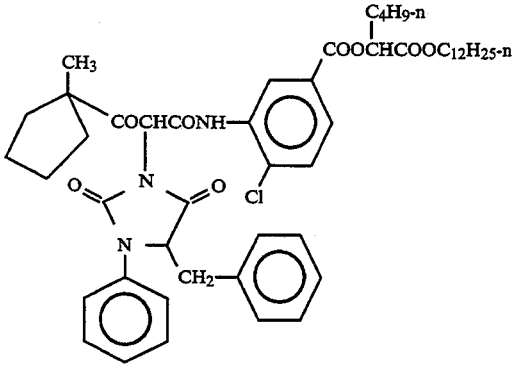
Y-8
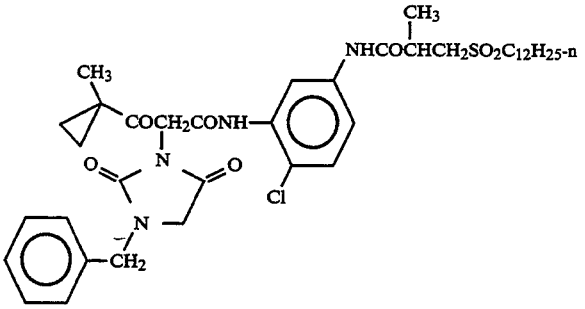
Y-9

-continued
Y-10
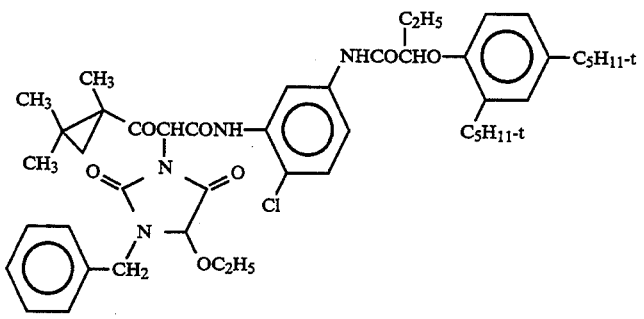
Y-11
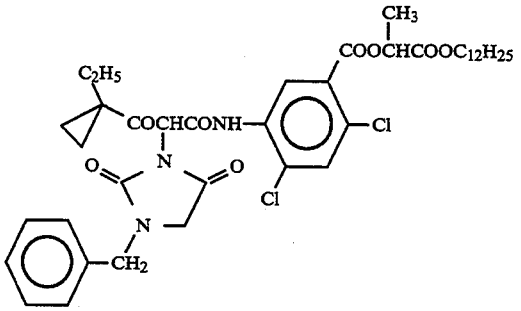
Y-12
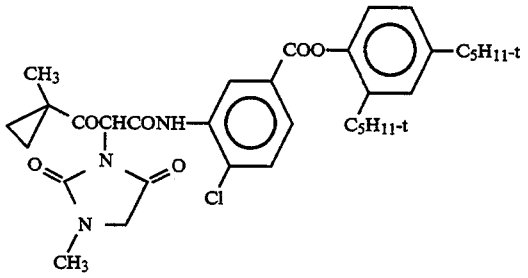
Y-13
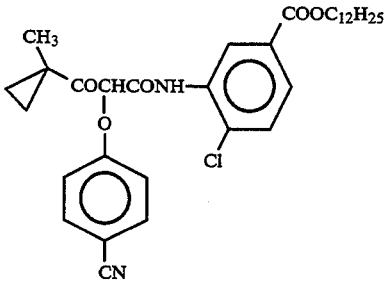
Y-14
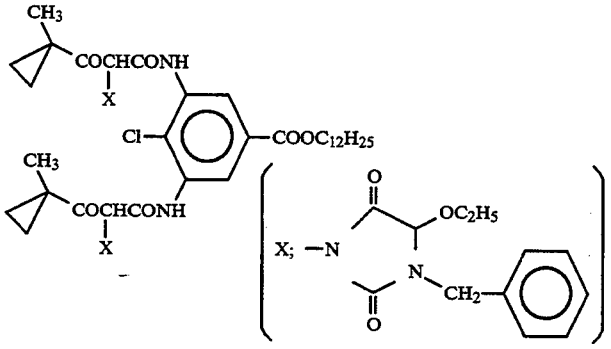

-continued
Y-15
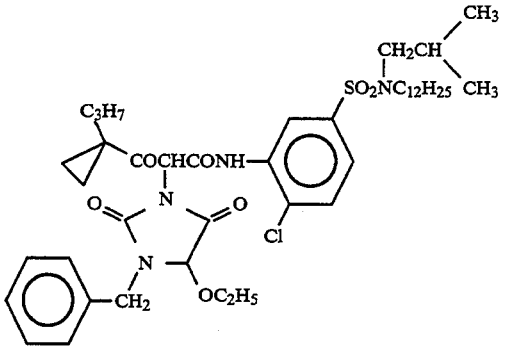
Y-16
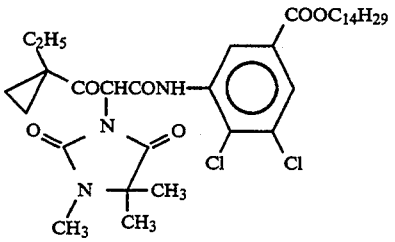
Y-17
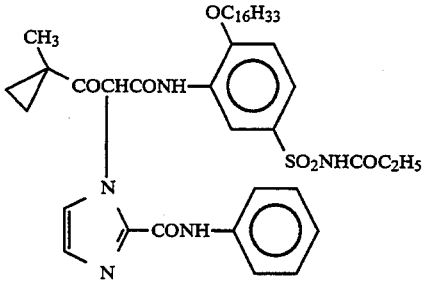
Y-18
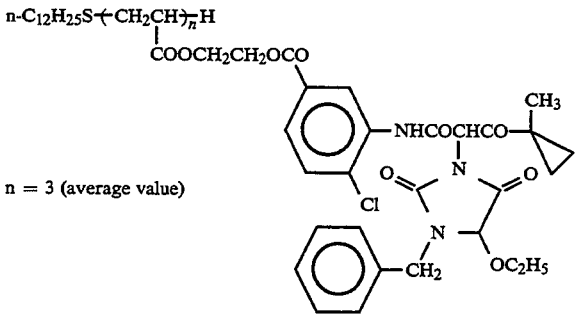
n = 3 (average value)
Y-19
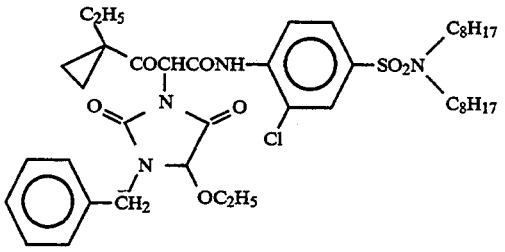

-continued
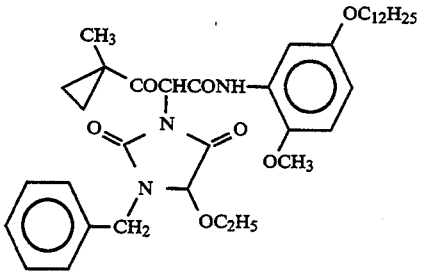
Y-20
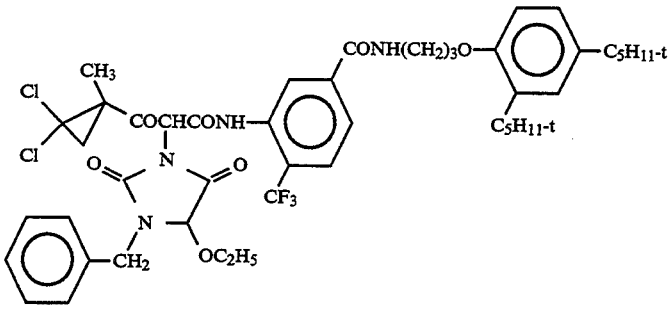
Y-21
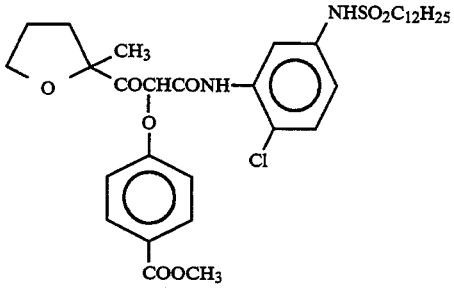
Y-22
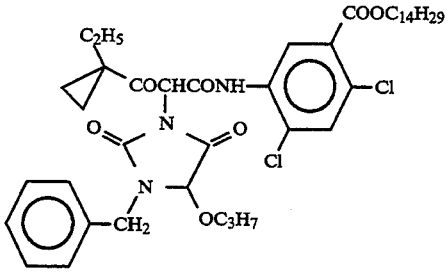
Y-23
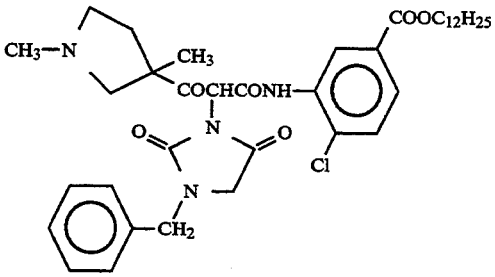
Y-24
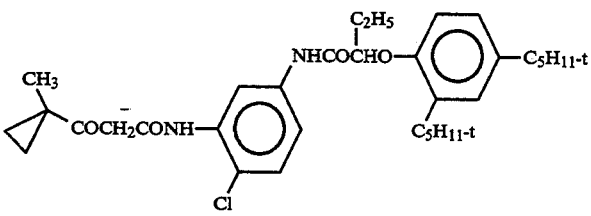
Y-25

-continued
Y-26
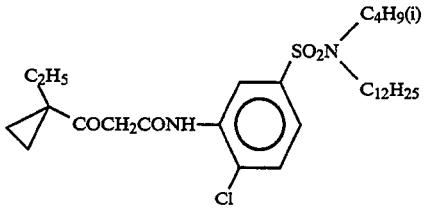
Y-27
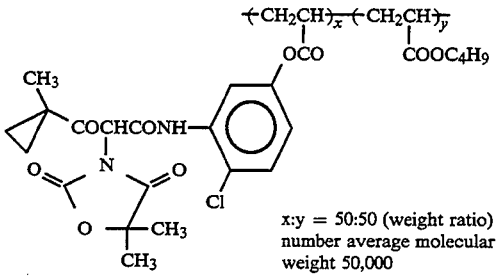
x:y = 50:50 (weight ratio)
number average molecular weight 50,000
Y-28
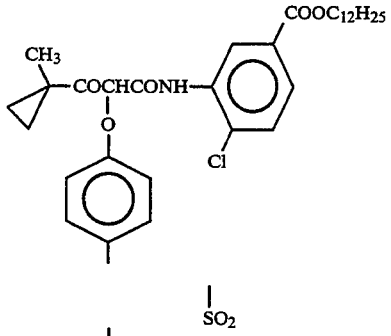
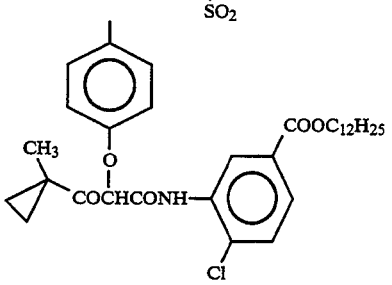
Y-29
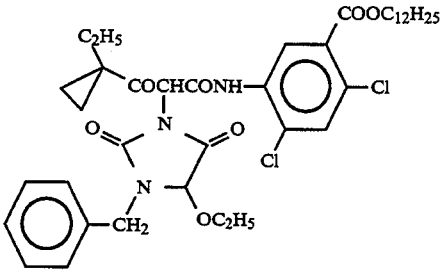
Y-30
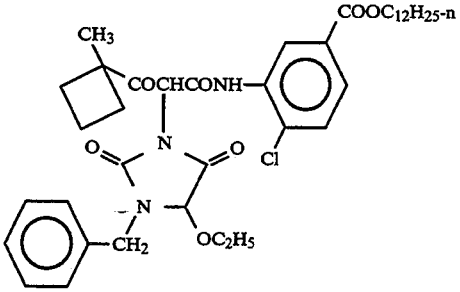

-continued

Y-31

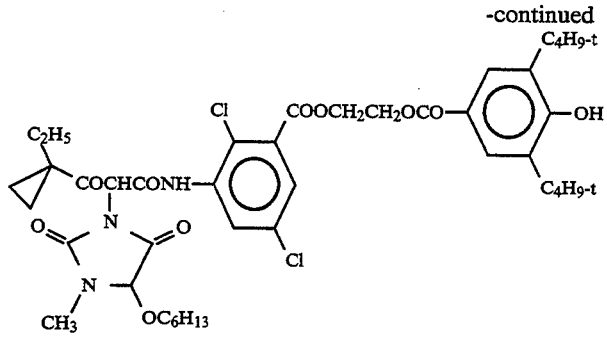

A yellow coupler represented by Formula (YII) can be synthesized by conventionally known synthesizing methods, e.g., the method described in European Patent Application (EP) 447,969A.

A coupler represented by Formula (YII) can be used in any layer of the light-sensitive material; i.e., the coupler can be used in any of light-sensitive layers (blue-, green-, and red-sensitive emulsion layers), non-light-sensitive layers (e.g., protective layers, yellow filter layers, interlayers, and antihalation layers). However, the coupler is preferably used in blue-sensitive emulsion layers or non-light-sensitive layers adjacent to the blue-sensitive emulsion layers.

The addition amount of a coupler represented by Formula (YII) is preferably 0.05 to 5.0 mmol/m$^2$, and more preferably 0.1 to 2.0 mmol/m$^2$.

When a coupler represented by Formula (YII) is used in light-sensitive layers, the molar ratio of the coupler to a silver halide is preferably 1:0.1 to 1:200, and more preferably 1:2 to 1:150. When the coupler is used in non-light-sensitive layers, the molar ratio of the coupler to a silver halide in an adjacent silver halide emulsion layer is preferably 1:2 to 1:200.

A coupler represented by Formula (YII) can be used singly or in combination with another yellow coupler (e.g., a benzoylacetanilide-type yellow coupler or a pivaloylacetanilide-type yellow coupler).

Yellow-colored cyan couplers preferably used in the present invention will be described below.

In the present invention, the yellow-colored cyan coupler means a cyan coupler which has an absorption peak between 400 nm and 500 nm in a visible absorption region of the coupler and couples with the oxidized form of an aromatic primary amine developing agent to form a cyan dye having an absorption peak between 630 nm and 750 nm in the visible absorption region.

Of the yellow-colored cyan couplers of the present invention, it is preferable to use a cyan coupler capable of releasing, upon the coupling reaction with the oxidized form of an aromatic primary amine developing agent, a compound moiety containing a water-soluble 6-hydroxy-2-pyridon-5-ylazo group, a water-soluble pyrazolon-4-ylazo group, a water-soluble 2-acylaminophenylazo group, or a water-soluble 2-sulfonamidophenylazo group.

The yellow-colored cyan couplers of the present invention are preferably represented by Formulas (CI) to (CIV) below:

Formula (CI)

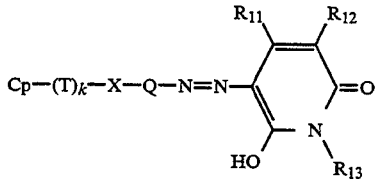

Formula (CII)

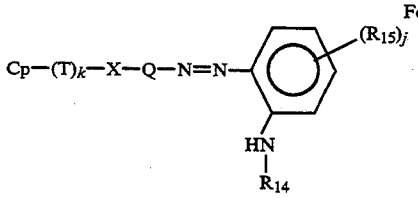

Formula (CIII)

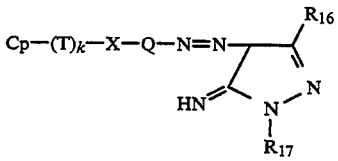

Formula (CIV)

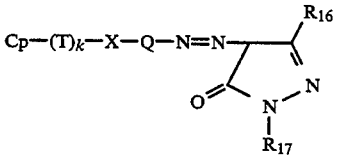

In Formulas (CI) to (CIV), Cp represents a cyan coupler moiety (T combines with its coupling position), T represents a timing group, k represents an integer of 0 or 1, X represents a divalent linking group which contains N, O, or S at which it combines with $(T)_k$, and combines with Q, and Q represents an arylene group or a divalent heterocyclic group.

In Formula (CI), each of $R_{11}$ and $R_{12}$ independently represents a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group, or an alkylsulfonyl group, and $R_{13}$ represents a hydrogen atom, an alkyl group, a cycloalkyl group, an aryl group, or a heterocyclic group. Note that at least one of T, X, Q, $R_{11}$, $R_{12}$, and $R_{13}$ contains a water-soluble group (e.g., hydroxyl, carboxyl, sulfo, amino, ammoniumyl, phosphono, phosphino, or hydroxylsulfonyloxy).

It is a common sense that the group in Formula (CI):

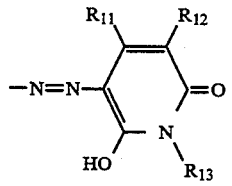

can take tautomer structures as illustrated below, and therefore, these tautomer structures are included in structures defined by Formula (CI) of the present invention:

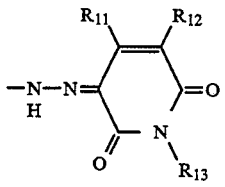

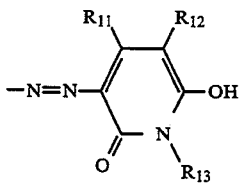

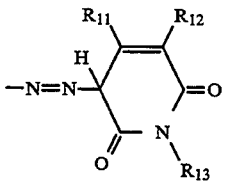

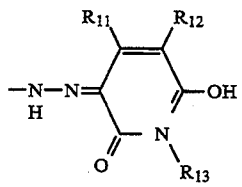

(when $R_{13}$ is a hydrogen atom)

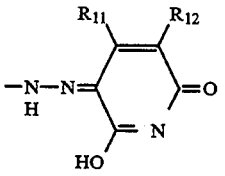

(when $R_{13}$ is a hydrogen atom)

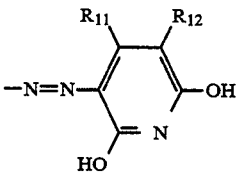

(when $R_{13}$ is a hydrogen atom)

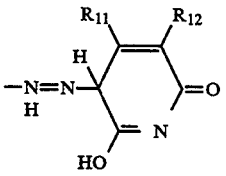

(when $R_{13}$ is a hydrogen atom)

In Formula (CII), $R_{14}$ represents an acyl; group or a sulfonyl group, $R_{15}$ represents a substitutable group, and j represents an integer from 0 to 4. If j is an integer of 2 or more, a plurality of $R_{15}$'s may be identical or different. Note that at least one of T, X, Q, $R_{14}$, and $R_{15}$ contains a water-soluble group (e.g., hydroxyl, carboxyl, sulfo, phosphono, phosphino, hydroxysulfonyloxy, amino, or ammoniumyl).

In Formulas (CIII) and (CIV), $R_{16}$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamido group, a sulfonamido group, or an alkylsulfonyl group, and $R_{17}$ represents a hydrogen atom, an alkyl group, a cycloalkyl group, an aryl group, or a heterocyclic group. Note that at least one of T, X, Q, $R_{16}$, and $R_{17}$ contains a water-soluble group (e.g., hydroxyl, carboxyl, sulfo, phosphono, phosphino, hydroxysulfonyloxy, amino, or ammoniumyl).

Also,

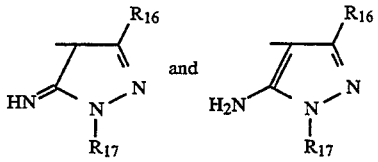

and

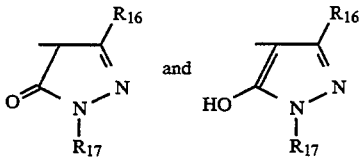

are in the relationship of a tautomer and therefore represent the same compound.

Compounds represented by Formulas (CI) to (CIV) will be described in more detail below.

Examples of the coupler moiety represented by Cp are known cyan coupler moieties (e.g., phenol-based and naphthol-based coupler moieties).

The timing group represented by T is a group which cleaves the bond with X after the bond with Cp is cleaved upon a coupling reaction between a coupler represented by one of Formulas (CI) to (CIV) and the oxidized form of an aromatic primary amine developing agent. This timing group is used for various purposes such as adjustment of the coupling reactivity, stabilization of the coupler, and adjustment of the release timing of X et. seq. Examples of the timing group are known linking groups presented by Formulas (T-1) to (T-7) below. In each group illustrated below, a symbol * combines with Cp, and a symbol ** combines with X:

(T-1)

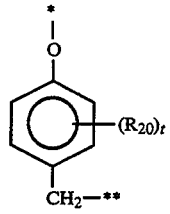

(T-2)

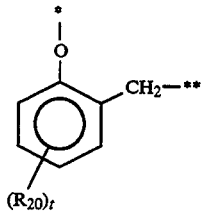

(T-3)

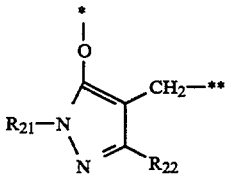

-continued (T-4)

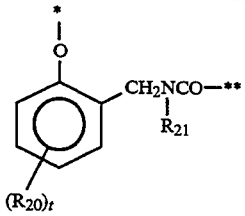

(T-5)

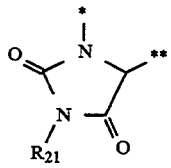

(T-6) *—$OCH_2$—**

(T-7)

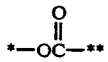

where $R_{20}$ represents a group substitutable on the benzene ring, $R_{21}$ is $R_{41}$ to be described below, $R_{22}$ represents a hydrogen atom or a substituent, and t represents an integer from 0 to 4. Examples of the substituents represented by $R_{20}$ and $R_{22}$ are $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, $R_{43}CO$—, $R_{41}COO$—, $R_{41}SO$—, nitro, $R_{43}(R_{44})NCON(R_{45})$—, cyano, $R_{41}OCON(R_{43})$—, $R_{43}OSO_2$—, $R_{43}(R_{44})N$—, $R_{43}(R_{44})NSO_2N(R_{45})$—, and groups shown below:

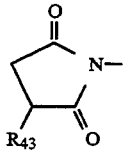

In the above formulas, $R_{41}$ represents an aliphatic group, an aromatic group, or a heterocyclic group, and each of $R_{43}$, $R_{44}$ and $R_{45}$ represents a hydrogen atom, an aliphatic group, an aromatic group, or a heterocyclic group.

In the above description, the aliphatic group is a saturated or unsaturated, chain or cyclic, straightchain or branched, substituted or unsubstituted aliphatic hydrocarbon group having 1 to 32, preferably 1 to 22 carbon atoms. Representative examples of the group are methyl, ethyl, propyl, isopropyl, butyl, (t)butyl, (i)butyl, (t)amyl, hexyl, cyclohexyl, 2-ethylhexyl, octyl, 1,1,3,3-tetramethylbutyl, decyl, dodecyl, hexadecyl, and octadecyl.

The aromatic group has 6 to 20 carbon atoms, and is preferably a substituted or unsubstituted phenyl group, or a substituted or unsubstituted naphthyl group.

The heterocyclic group is a substituted or unsubstituted, preferably 3- to 8-membered, heterocyclic group having 1 to 20, preferably 1 to 7 carbon atoms and containing a heteroatom selected from a nitrogen atom, an oxygen atom and a sulfur atom. Representative examples of the heterocyclic group are 2-pyridyl, 2-thienyl, 2-furyl, 1,3,4-thiadiazol-2-yl, 2,4-dioxo-1,3-imidazolidin-5-yl, 1,2,4-triazol-2-yl, and 1-pyrazolyl.

When the aliphatic hydrocarbon group, the aromatic group, and the heterocyclic group described above have substituents, representative examples of the substituents are a halogen atom, $R_{47}O$—, $R_{46}S$—, $R_{47}CON(R_{48})$—, $(R_{47})(R_{48})NCO$—, $R_{46}OCON(R_{47})$—, $R_{46}SO_2N(R_{47})$—, $(R_{47})(R_{48})NSO_2$—, $R_{46}SO_2$—, $R_{47}OCO$—, $(R_{47})(R_{48})NCON(R_{49})$—, a group having the same meaning as $R_{46}$, the following group:

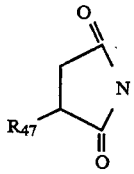

$R_{46}COO$—, $R_{47}OSO_2$—, a cyano group, and a nitro group. In these formulas, $R_{46}$ represents an aliphatic group, an aromatic group, or a heterocyclic group, and each of $R_{47}$, $R_{48}$, and $R_{49}$ represents an aliphatic group, an aromatic group, a heterocyclic group, or a hydrogen atom. The meanings of these aliphatic, aromatic, and heterocyclic groups are identical with those defined above.

k represents an integer of 0 or 1. In general, k is preferably 0, i.e., Cp preferably combines directly with X.

X is a divalent linking group which combines with Cp—$(T)_k$— by N, O, or S. Preferable examples of X are —O—, —S—, —OCO—, —OCO(O)—, —OCO(S)—, —OCONH—, —$SO_2$—, —$OSO_2NH$—; a heterocyclic group which combines with Cp—$(T)_k$— by N (e.g., a group derived from pyrrolidine, piperidine, morpholine, piperazine, pyrrole, pyrazole, imidazole, 1,2,4-triazole, benzotriazole, succinimide, phthalimide, oxazolidin-2,4-dione, imidazolidin-2,4-dione, or 1,2,4-triazolidin-3,5-dione), and a linking group which is a composite group of the above group with an alkylene group (e.g., methylene, ethylene, or propylene), a cylcoalkylene group (e.g., 1,4-cyclohexylene), an arylene group (e.g., o-phenylene or p-phenylene), a divalent heterocyclic group (e.g., a group derived from pyridine or thiophene), —CO—, —$SO_2$—, —COO—, —CONH—, —$SO_2NH$—, —$SO_2O$—, —NHCO—, —$NHSO_2$—, —NHCONH—, —$NHSO_2NH$— or —NHCOO—. X is more preferably represented by Formula (I) below:

*—$X_1$—$(L—X_2)_m$—** Formula (I)

where a symbol * represents the bonding position with Cp—$(T)_k$—, a symbol ** represents the bonding position with Q et. seq., $X_1$ represents —O— or —S—, L represents an alkylene group, $X_2$ represents —O—, —S—, —CO—, —$SO_2$—, —OCO—, —COO—, —NHCO—, —CONH—, —$SO_2NH$—, —$NHSO_2$—, —$SO_2O$—, —$OSO_2$—, —OCO(O)—, —OCONH—, —NHCOO—, —NHCONH—, —$NHSO_2NH$—, —OCO(S)—, —SCO(O)—, —$OSO_2NH$—, or —$NHSO_2O$—, and m represents an integer from 0 to 3. The total number of carbon atoms (to be referred to as the C number hereinafter) of X is preferably 0 to 12, and more preferably 0 to 8. X is most preferably —$OCH_2CH_2O$—.

Q represents an arylene group or a divalent heterocyclic group. If Q is an arylene group, this arylene group may be a condensed ring or have a substituent (e.g., a halogen atom, hydroxyl, carboxyl, sulfo, nitro, cyano, amino, ammonium, phosphono, phosphino, alkyl, cycloalkyl, aryl, carbonamido, sulfonamido, alkoxy, aryloxy, acyl, sulfonyl, carboxyl, carbamoyl, or sulfamoyl), and its C number is preferably 6 to 15, and more preferably 6 to 10. If Q is a divalent heterocyclic group, this heterocyclic group is a 3- to 8-membered, preferably 5- to 7-membered, monocyclic or condensed-ring heterocyclic group (e.g., a group derived from pyridine, thiophene, furan, pyrrole, pyrazole, imidazole, thiazole, oxazole, benzothiazole, benzoxazole, benzofuran, benzothiophene, 1,3,4-thiadiazole, indole, or quinoline) which contains at least one heteroatom selected from N, O, S, P, Se, and Te in its ring and may have a substituent (identical with the substituents when Q is an arylene group), and its C number is preferably 2 to 15, and more preferably 2 to 10. Q is most preferably a group represented by:

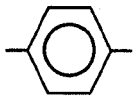

In the present invention, therefore, the most preferable $-(T)_k-X-Q-$ is a group represented by:

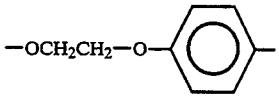

If $R_{11}$, $R_{12}$, or $R_{13}$ is an alkyl group, this alkyl group may be either straight-chain or branched, may contain an unsaturated bond, and may have a substituent (e.g., a halogen atom, hydroxyl, carboxyl, sulfo, phosphono, phosphine, cyano, alkoxy, aryl, alkoxycarbonyl, amino, ammoniumyl, acyl, carbonamido, sulfonamido, carbamoyl, sulfamoyl, or sulfonyl).

If $R_{11}$, $R_{12}$, or $R_{13}$ is a cycloalkyl group, this cycloalkyl group is a 3- to 8-membered cycloalkyl group which may have a bridging group, may contain an unsaturated bond, and may have a substituent (identical with the substituents when $R_{11}$, $R_{12}$, or $R_{13}$ is an alkyl group).

If $R_{11}$, $R_{12}$, or $R_{13}$ is an aryl group, this aryl group may be a condensed ring and may have a substituent (e.g., alkyl or cycloalkyl in addition to the substituents when $R_{11}$, $R_{12}$, or $R_{13}$ is an alkyl group). If $R_{11}$, $R_{12}$, or $R_{13}$ is a heterocyclic group, this heterocyclic group is a 3- to 8-membered (preferably 5-to 7-membered), monocyclic or condensed-ring heterocyclic group (e.g., imidazolyl, thienyl, pyrazolyl, thiazolyl, pyridyl, or quinolinyl) containing at least one heteroatom selected from N, S, O, P, Se, and Te in its ring, which may have a substituent (identical with the substituents when $R_{11}$, $R_{12}$, or $R_{13}$ is an aryl group).

In this case, a carboxyl group, a sulfo group, a phosphino group, and a phosphono group may include a carboxylate group, a sulfonate group, a phosphinate group, and a phosphonate group, respectively, and counter ions in this case are, for example, $Li^+$, $Na^+$, $K^+$, and ammonium.

$R_{11}$ is preferably a hydrogen atom, a carboxyl group, an alkyl group having a C number of 1 to 10 (e.g., methyl, t-butyl, sulfomethyl, 2-sulfoethyl, carboxymethyl, 2-carboxyethyl, 2-hydroxyethyl, benzyl, ethyl, or isopropyl), or an aryl group having a C number of 6 to 12 (e.g., phenyl, 4-methoxyphenyl, or 4-sulfophenyl), and most preferably a hydrogen atom, methyl, or carboxyl.

$R_{12}$ is preferably a cyano group, a carboxyl group, a carbamoyl group having a C number of 1 to 10, a sulfamoyl group having a C number of 0 to 10, a sulfo group, an alkyl group having a C number of 1 to 10 (e.g., methyl or sulfomethyl), a sulfonyl group having a C number of 1 to 10 (e.g., methylsulfonyl or phenylsulfonyl), a carbonamido group having a C number of 1 to 10 (e.g., acetamido or benzamido), or a sulfonamido group having a C number of 1 to 10 (e.g., methanesulfonamido or toluenesulfonamido), and most preferably a cyano group, a carbamoyl group, or a carboxyl group.

$R_{13}$ is preferably a hydrogen atom, an alkyl group having a C number of 1 to 12 (e.g., methyl, sulfomethyl, carboxymethyl, 2-sulfoethyl, 2-carboxyethyl, ethyl, n-butyl, benzyl, or 4-sulfobenzyl), or an aryl group having a C number of 6 to 15 (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, or 2,5-disulfophenyl), and more preferably an alkyl group having a C number of 1 to 7 or an aryl group having a C number of 6 to 10.

Practical examples of $R_{14}$ are an acyl group represented by Formula (II) and a sulfonyl group represented by Formula (III):

$R_{31}CO-$ Formula (II)

$R_{31}SO_2-$ Formula (III)

If $R_{31}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, or sulfonyl).

If $R_{31}$ is a cycloalkyl group, this cycloalkyl group is a 3- to 8-membered cycloalkyl group which may have a bridging group, an unsaturated bond, and a substituent (identical with the substituents when $R_{31}$ is an alkyl group).

If $R_{31}$ is an aryl group, this aryl group may be a condensed ring and have a substituent (e.g., alkyl or cycloalkyl in addition to the substituents when $R_{31}$ is an alkyl group).

If $R_{31}$ is a heterocyclic group, this heterocyclic group is a 3- to 8-membered (preferably 5- to 7-membered), monocyclic or condensed-ring heterocyclic group (e.g., imidazolyl, thienyl, pyrazolyl, thiazolyl, pyridine, or quinolinyl) containing at least one hetero atom selected from N, S, O, P, Se, and Te, which may have a substituent (identical with the substituents when $R_{31}$ is an aryl group).

In this case, a carboxyl group, a sulfo group, a phosphino group, and a phosphono group may include a carboxylate group, a sulfonate group, a phosphinate group, and a phosphonate group, respectively, and counter ions in this case are, for example, $Li^+$, $Na^+$, $K^+$, and ammonium.

$R_{31}$ is preferably an alkyl group having a C number of 1 to 10 (e.g., methyl, carboxymethyl, sulfoethyl, or cyanoethyl), a cycloalkyl group having a C number of 5 to 8 (e.g., cyclohexyl or 2-carboxycyclohexyl), or an aryl group having a C number of 6 to 10 (e.g., phenyl, 1-naphthyl, or 4-sulfophenyl), and most preferably an alkyl group having a C number of 1 to 3 or an aryl group having a C number of 6.

$R_{15}$ is a substitutable group, preferably an electron donor group, and most preferably $-NR_{32}R_{33}$ or —$OR_{34}$. The substitution position is preferably a 4-position. Each of $R_{32}$, $R_{33}$, and $R_{34}$ is a hydrogen atom, an alkyl group, a cycloalkyl group, an aryl group, or a heterocyclic group, like $R_{31}$. A ring may be formed between $R_{32}$ and $R_{33}$, and an alicyclic ring is preferable as the nitrogen heterocyclic ring formed.

j represents an integer from 0 to 4, preferably 1 or 2, and most preferably 1.

If $R_{16}$ or $R_{17}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, or sulfonyl).

If $R_{16}$ or $R_{17}$ is a cycloalkyl group, this cycloalkyl group is a 3- to 8-membered cycloalkyl group which may have a bridging group, an unsaturated bond, and a substituent (identical with the substituents when $R_{16}$ or $R_{17}$ is an alkyl group).

If $R_{16}$ or $R_{17}$ is an aryl group, this aryl group may be a condensed ring and have a substituent (e.g., alkyl or cycloalkyl in addition to the substituents when $R_{16}$ or $R_{17}$ is an alkyl group).

If $R_{16}$ or $R_{17}$ is a heterocyclic group, this heterocyclic group is a 3- to 7-membered (preferably 5- to 6-membered) monocyclic or condensed-ring heterocyclic group containing at least one heteroatom selected from N, S, O, P, Se, or Te in its ring (e.g., imidazolyl, thienyl, pyrazolyl, thiazolyl, pyridyl, or quinolinyl), which may have a substituent (identical with the substituents when $R_{16}$ or $R_{17}$ is an aryl group).

In this case, a carboxyl group, a sulfo group, a phosphino group, and a phosphono group may include a carboxylate group, a sulfonate group, a phosphinate group, and a phosphonate group, respectively, and counter ions in this case are, for example, $Li^+$, $Na^+$, $K^+$, and ammonium.

$R_{16}$ is preferably a cyano group, a carboxyl group, a carbamoyl group having a C number of 1 to 10, an alkoxycarbonyl group having a C number of 2 to 10, an aryloxycarbonyl group having a C number of 7 to 11, a sulfamoyl group having a C number of 0 to 10, a sulfo group, an alkyl group having a C number of 1 to 10 (e.g., methyl, carboxymethyl, or sulfomethyl), a sulfonyl group having a C number of 1 to 10 (e.g., methylsulfonyl or phenylsulfonyl), a carbonamido group having a C number of 1 to 10 (e.g., acetamido or benzamido), a sulfonamido group having a C number of 1 to 10 (e.g., methanesulfonamido or toluenesulfonamido), an alkyloxy group (e.g., methoxy or ethoxy), or an aryloxy group (e.g., phenoxy), and most preferably a cyano group, a carbamoyl group, an alkoxycarbonyl group, or a carboxyl group.

$R_{17}$ is preferably a hydrogen atom, an alkyl group having a C number of 1 to 12 (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, or 4-sulfobenzyl), or an aryl group having a C number of 6 to 15 (e.g., phenyl, 4-carboxyphenyl, 3-carboxyphenyl, 2,4-dicarboxyphenyl, 4-sulfophenyl, 3-sulfophenyl, 2,5-disulfophenyl, or 2,4-disulfophenyl), and more preferably an alkyl group having a C number of 1 to 7 or an aryl group having a C number of 6 to 10.

Practical examples of the yellow-colored cyan coupler of the present invention are presented below, but the present invention is not limited to these examples:

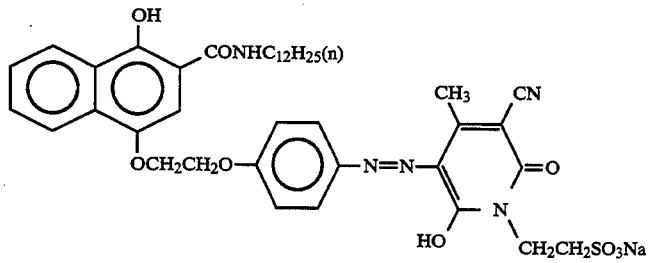

(YC-1)

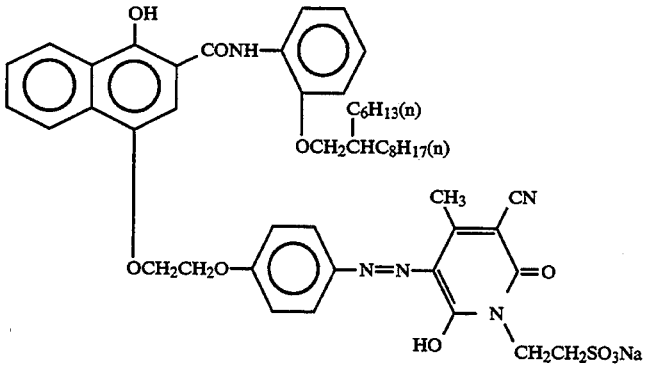

(YC-2)

-continued
(YC-3)
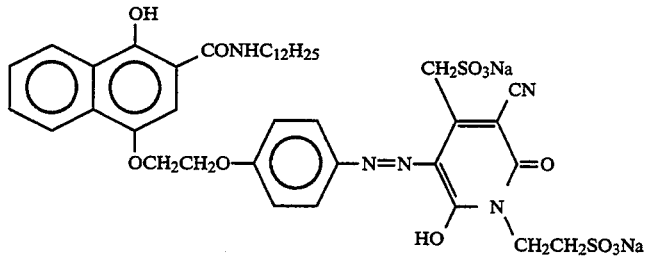
(YC-4)
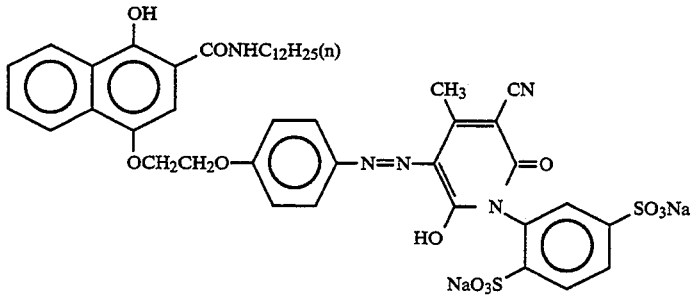
(YC-5)
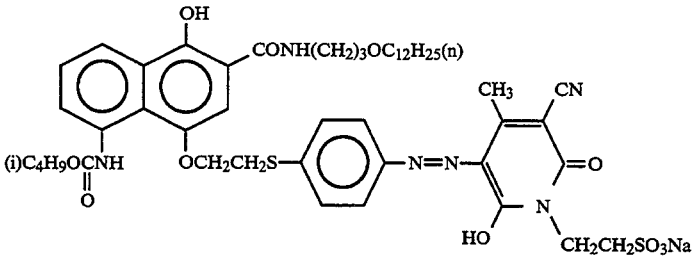
(YC-6)
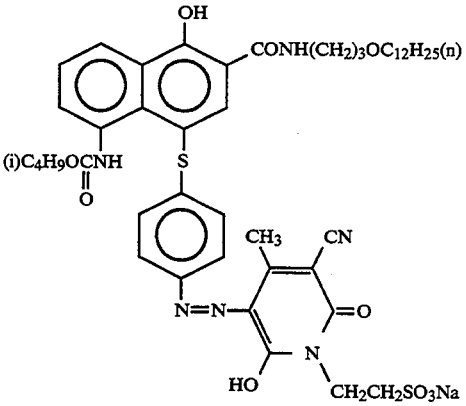
(YC-7)
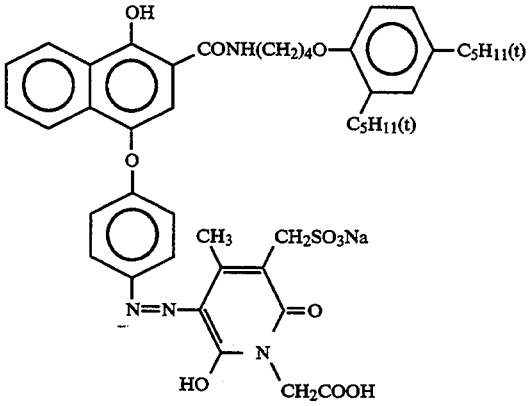

-continued
(YC-8)
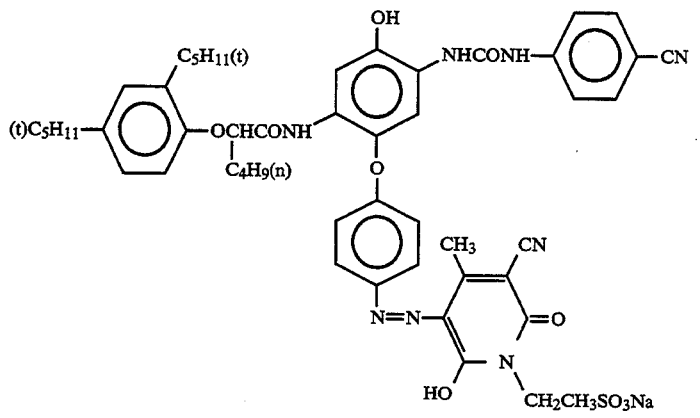
(YC-9)
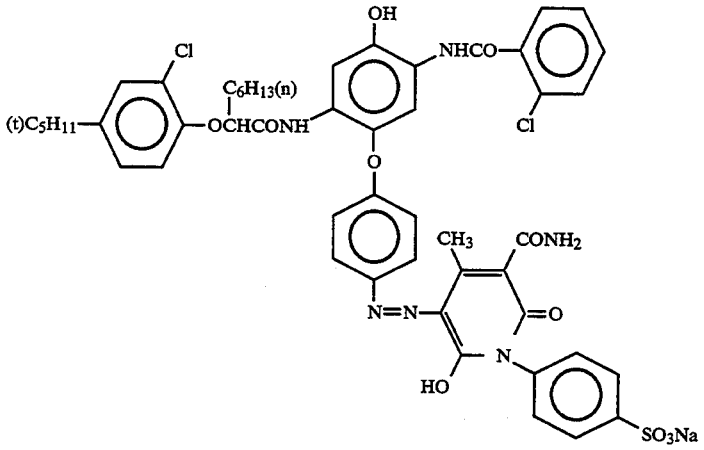
(YC-10)
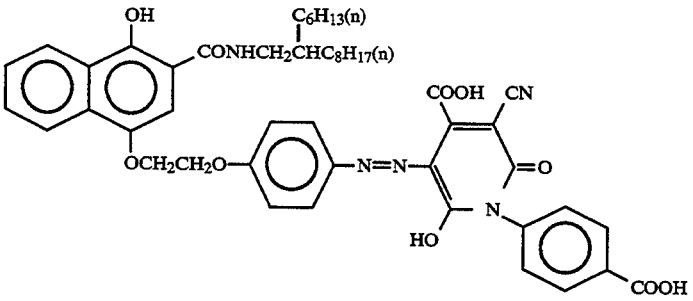
(YC-11)
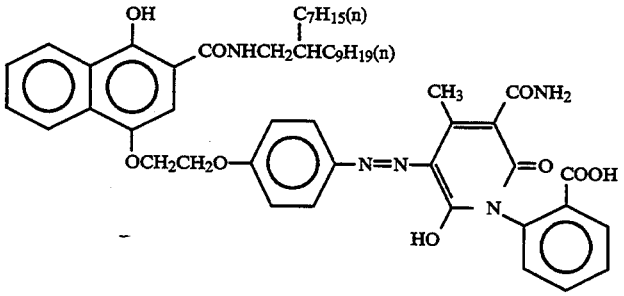

-continued
(YC-12)
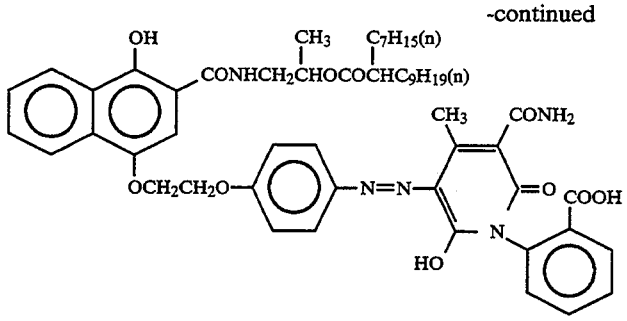
(YC-13)
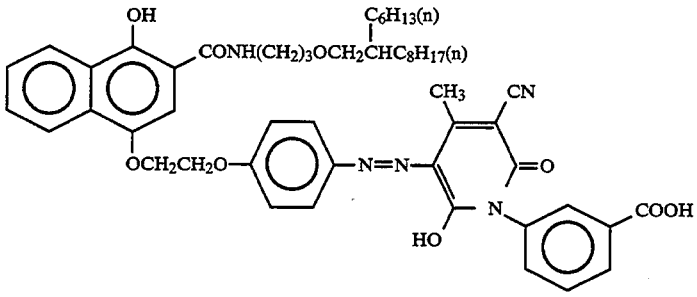
(YC-14)
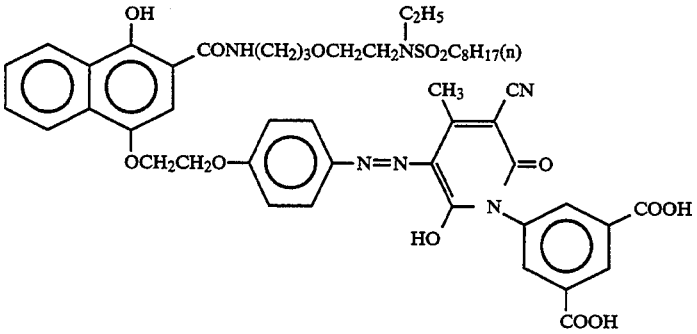
(YC-15)
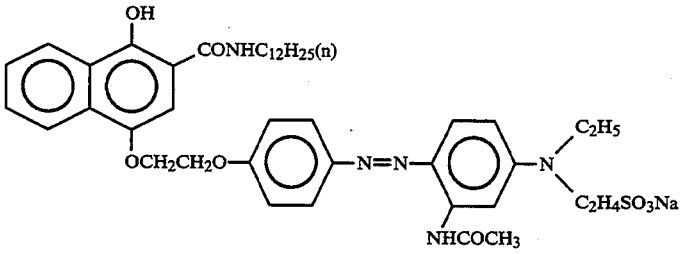
(YC-16)
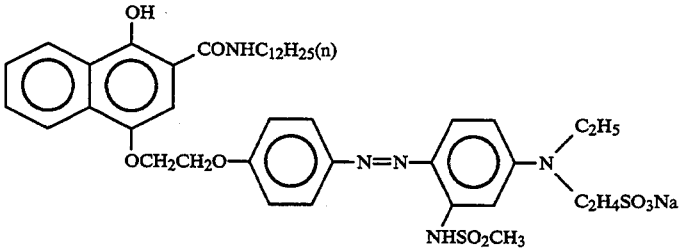
(YC-17)
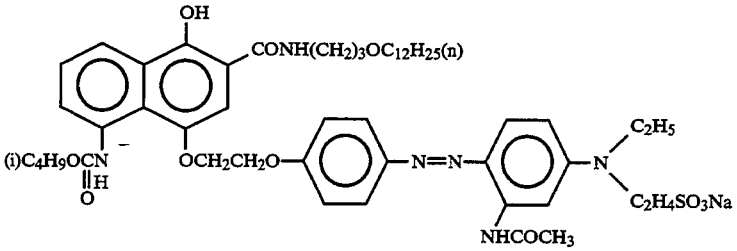

-continued
(YC-18)
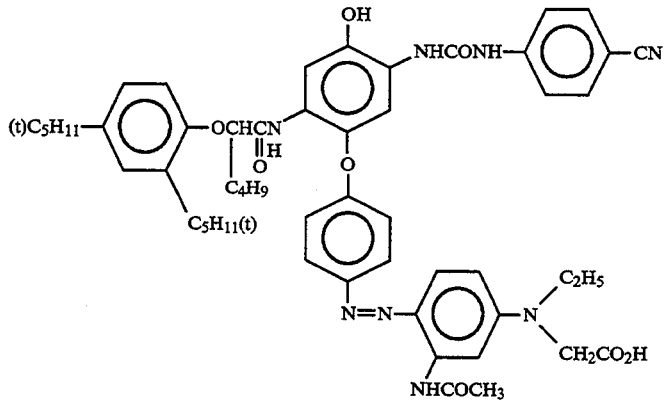
(YC-19)
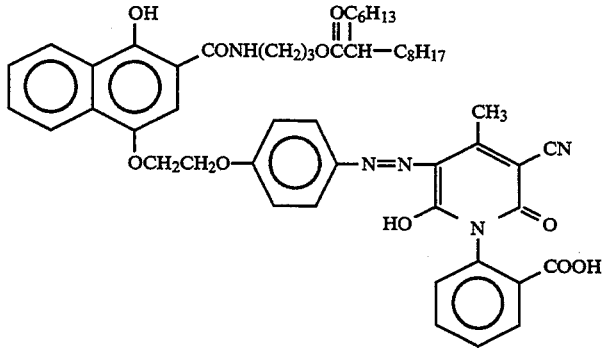
(YC-20)
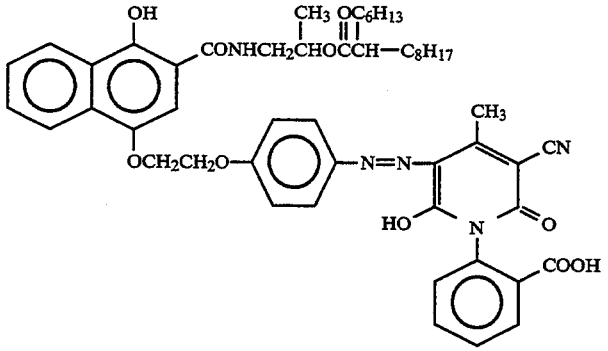
(YC-21)
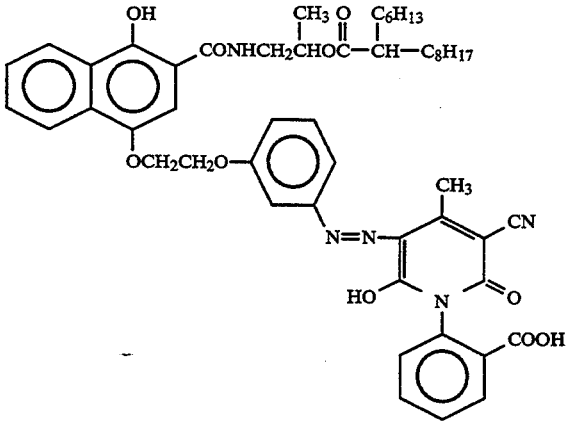

-continued
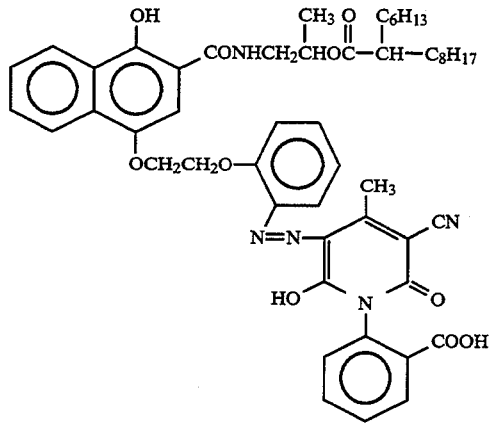
(YC-22)
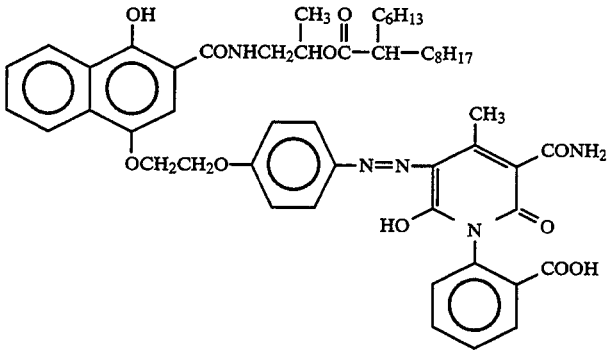
(YC-23)
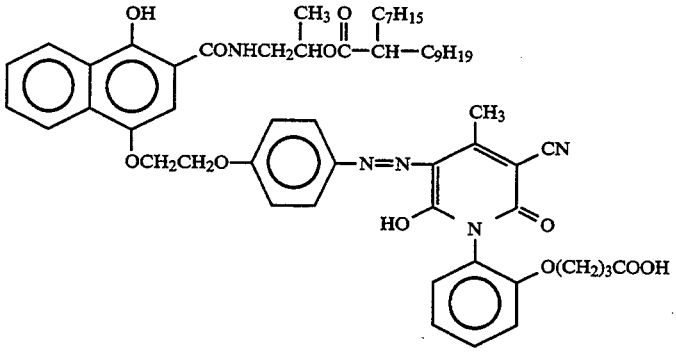
(YC-24)
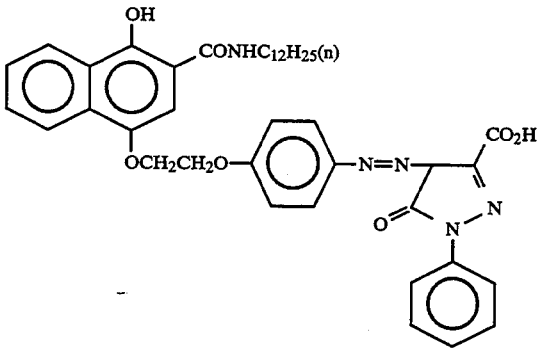
(YC-25)

-continued

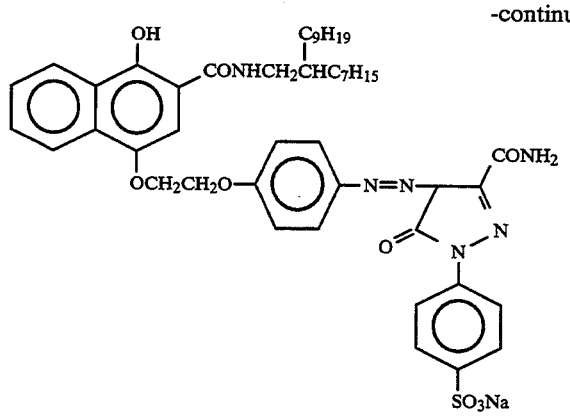

(YC-26)

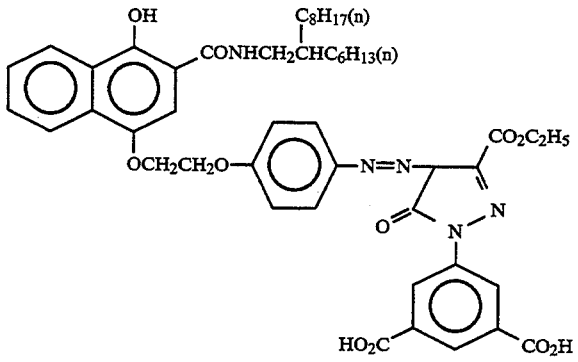

(YC-27)

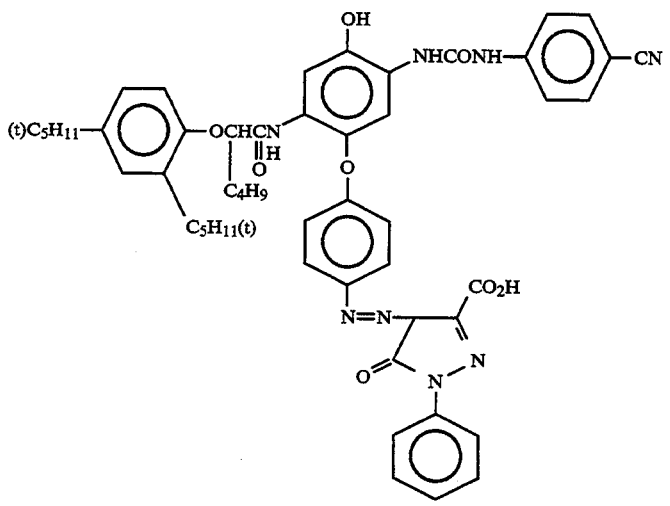

(YC-28)

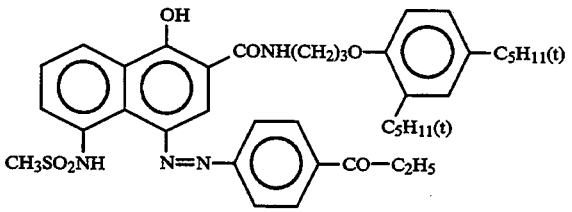

(YC-29)

A yellow-colored coupler represented by Formula (CI) of the present invention can be generally synthesized by a diazo-coupling reaction between a 6-hydroxy-2-pyridone and an aromatic diazonium salt or heterocyclic diazonium salt, which contains a coupler structure.

The former, i.e., a 6-hydroxy-2-pyridone can be synthesized by the methods described in, e.g., Krinsberg ed., "Heterocyclic Compound-Pyridine and Its Derivatives-Vol. 3" (published by Inter Science, 1962); J. Am. Chem. Soc., 1943, Vol. 65, p. 449; J. Chem. Tech. Biotechnol., 1986, Vol. 36, p. 410; Tetrahedron, 1966, Vol. 22, p. 445; and JP-B-61-52827 ("JP-B" means Published Examined Japanese Patent Application), West German Patents 2,162,612, 2,349,709, and 2,902,486, and U.S. Pat. No. 3,763,170.

The latter, i.e., a diazonium salt can be synthesized by the methods described in, e.g., U.S. Pat. Nos. 4,004,929 and 4,138,258, JP-A-61-72244, and JP-A-61-273543. The diazo-coupling reaction between a 6-hydroxy-2-pyridone and a diazonium salt can be performed in a solvent, such as methanol, ethanol, methylcellosolve, acetic acid, N,N-dimethylformamide, N,N-dimethylacetamide, tetrahydrofuran, dioxane, or water, or in a mixture of these solvents. In this case, it is possible to use, as a base, sodium acetate, potassium acetate, sodium carbonate, potassium carbonate, sodium bicarbonate, sodium hydroxide, potassium hydroxide, pyridine, triethylamine, tetramethylurea, or tetramethylguanidine. The reaction temperature is normally −78° C. to 60° C., and preferably −20° C. to 30° C.

The synthesis routes of the colored couplers of the present invention are presented below:

(Synthesis Exemple I) Synthesis of Exemplified Coupler (YC-1)

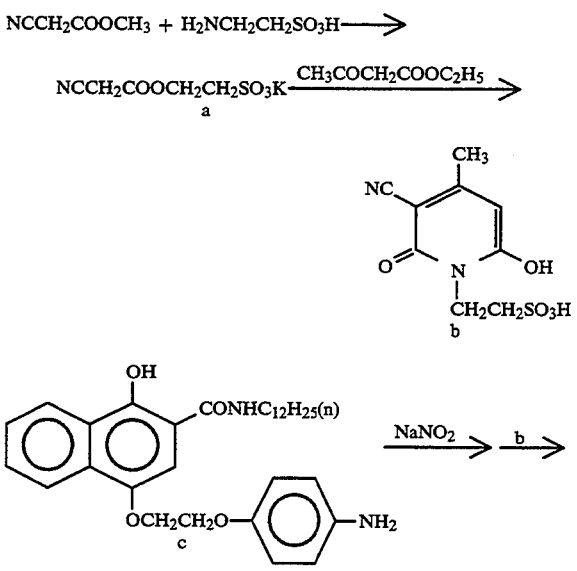

Exemplified Coupler (YC-1)

(Synthesis Exemple II) Synthesis of Exemplified Coupler (YC-2)

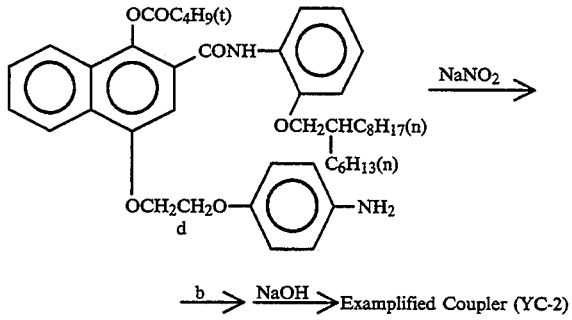

(Synthesis Exemple III) Synthesis of Exemplified Coupler (YC-13)

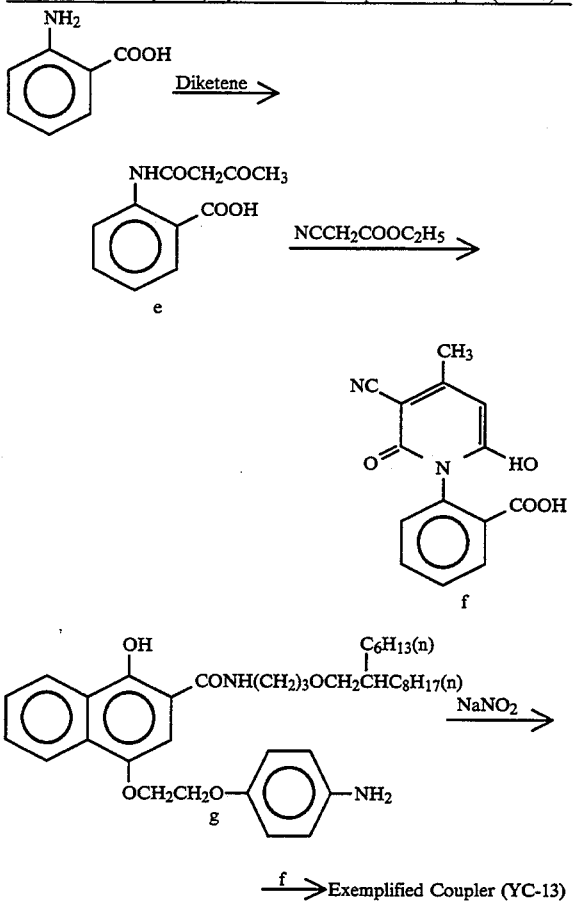

(Synthesis Exemple IV) Synthesis of Exemplified Coupler (YC-20)

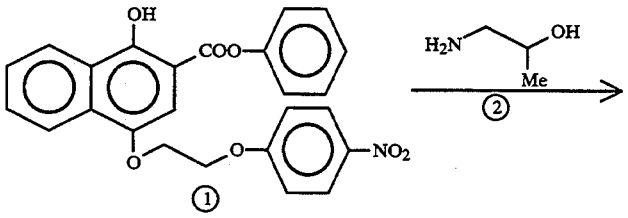

-continued (Synthesis Exemple IV) Synthesis of Exemplified Coupler (YC-20)

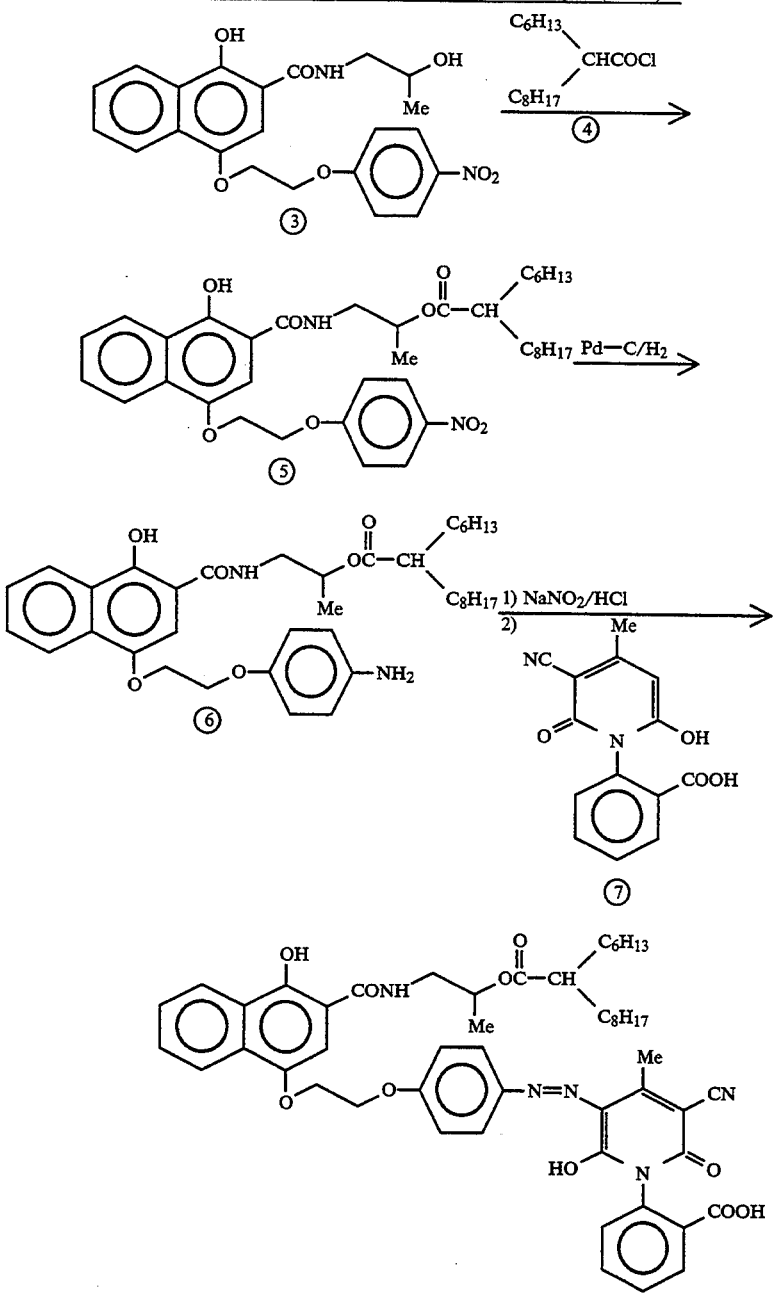

Exemplified Coupler (YC-20)

Yellow-colored cyan couplers represented by Formulas (CII) to (CIV) can be synthesized by the methods described in, e.g., JP-B-58-6939, JP-A-1-197563, and the patents cited above as the methods of synthesizing couplers represented by Formula (CI).

In the present invention, yellow-colored cyan couplers represented by Formulas (CI) and (CII) are more preferably used, and a yellow-colored cyan coupler represented by Formula (CI) is most preferably used.

The yellow-colored cyan couplers of the present invention are added to preferably light-sensitive silver halide emulsion layers or layers adjacent to these layers in the light-sensitive material, and most preferably to red-sensitive emulsion layers. The total addition amount thereof to the light-sensitive material is 0.005 to 0.30 $g/m^2$, preferably 0.02 to 0.20 $g/m^2$, and more preferably 0.03 to 0.15 $g/m^2$.

The yellow-colored cyan couplers of the present invention can be added in the same manner as ordinary couplers as will be described later.

Techniques and inorganic and organic materials usable in the color photographic light-sensitive material of the present invention are described in the following portions of EP 436,938A2 and the patents cited below.

1. Layer arrangements: page 146, line 34 to page 147, line 25
2. Silver halide emulsions: page 147, line 26 to page 148, line 12
3. Yellow couplers: page 137, line 35 to page 146, line 33, and page 149, lines 21 to 23

4. Magenta couplers: page 149, lines 24 to 28; EP 421,453A1, page 3, line 5 to page 25, line 55
5. Cyan couplers: page 149, lines 29 to 33; EP 432,804A2, page 3, line 28 to page 40, line 2
6. Polymer couplers: page 149, lines 34 to 38; EP 435,334A2, page 113, line 39 to page 123, line 37
7. Colored couplers: page 53, line 42 to page 137, line 34, and page 149, lines 39 to 45
8. Other functional couplers: page 7, line 1 to page 53, line 41, and page 149, line 46 to page 150, line 3; EP 435,334A2, page 3, line 1 to page 29, line 50
9. Antiseptic and mildewproofing agents: page 150, lines 25 to 28
10. Formalin scavengers: page 149, lines 15 to 17
11. Other additives: page 153, lines 38 to 47; EP 421,453A1, page 75, line 21 to page 84, line 56, and page 27, line 40 to page 37, line 40
12. Dispersion methods: page 150, lines 4 to 24
13. Supports: page 150, lines 32 to 34
14. Thickness and physical properties of film: page 150, lines 35 to 49
15. Color development process: page 150, line 50 to page 151, line 47
16. Desilvering process: page 151, line 48 to page 152, line 53
17. Automatic developing machine: page 152, line 54 to page 153, line 2
18. Washing/stabilizing process: page 153, lines 3 to 37

EXAMPLE 1

Layers having the compositions presented below were coated on a subbed triacetylcellulose film support to make a sample 101 as a multilayered color light-sensitive material.

(Compositions of light-sensitive layers)

The main materials used in the individual layers are classified as follows.

ExC: Cyan coupler
ExM: Magenta coupler
ExY: Yellow coupler
ExS: Sensitizing dye
UV: Ultraviolet absorbent
HBS: High-boiling organic solvent
H: Gelatin hardener The number corresponding to each component indicates the coating amount in units of g/m$^2$. The coating amount of a silver halide is represented by the amount of silver. The coating amount of each sensitizing dye is represented in units of mols per mol of a silver halide in the same layer.

| (Sample 101) | |
|---|---|
| 1st layer (Antihalation layer) | |
| Black colloidal silver | silver 0.18 |
| Gelatin | 1.40 |
| ExM-1 | 0.18 |
| ExF-1 | $2.0 \times 10^{-3}$ |
| 2nd layer (Interlayer) | |
| Emulsion G | silver 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| 3rd layer (Low-speed red-sensitive emulsion layer) | |
| Emulsion A | silver 0.25 |

-continued

| (Sample 101) | |
|---|---|
| Emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| ExC-7 | 0.020 |
| UV-1 | 0.070 |
| UV-2 | 0.050 |
| UV-3 | 0.070 |
| HBS-1 | 0.060 |
| Gelatin | 0.87 |
| 4th layer (Medium-speed red-sensitive emulsion layer) | |
| Emulsion D | silver 0.80 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.20 |
| ExC-2 | 0.050 |
| ExC-4 | 0.20 |
| Yellow-colored cyan coupler (YC-20) | 0.06 |
| ExC-7 | 0.015 |
| UV-1 | 0.070 |
| UV-2 | 0.050 |
| UV-3 | 0.070 |
| Gelatin | 1.30 |
| 5th layer (High-speed red-sensitive emulsion layer) | |
| Emulsion E | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.097 |
| ExC-2 | 0.010 |
| ExC-3 | 0.065 |
| ExC-6 | 0.020 |
| HBS-1 | 0.22 |
| HBS-2 | 0.10 |
| Gelatin | 1.63 |
| 6th layer (Interlayer) | |
| Cpd-1 | 0.040 |
| HBS-1 | 0.020 |
| Gelatin | 0.80 |
| 7th layer (Low-speed green-sensitive emulsion layer) | |
| Emulsion C | silver 0.30 |
| ExS-4 | $2.6 \times 10^{-5}$ |
| ExS-5 | $1.8 \times 10^{-4}$ |
| ExS-6 | $6.9 \times 10^{-4}$ |
| ExM-1 | 0.021 |
| ExM-2 | 0.20 |
| ExM-3 | 0.030 |
| ExM-6 | 0.075 |
| HBS-1 | 0.10 |
| HBS-3 | 0.010 |
| Gelatin | 0.63 |
| 8th layer (Medium-speed green-sensitive emulsion layer) | |
| Emulsion D | silver 0.55 |
| ExS-4 | $2.2 \times 10^{-5}$ |
| ExS-5 | $1.5 \times 10^{-4}$ |
| ExS-6 | $5.8 \times 10^{-4}$ |
| ExM-2 | 0.082 |
| ExM-3 | 0.018 |
| ExM-6 | 0.042 |
| HBS-1 | 0.16 |
| HBS-3 | $8.0 \times 10^{-3}$ |
| Gelatin | 0.50 |
| 9th layer (High-speed green-sensitive emulsion layer) | |
| Emulsion E | silver 1.55 |
| ExS-4 | $4.6 \times 10^{-5}$ |
| ExS-5 | $1.0 \times 10^{-4}$ |
| ExS-6 | $3.9 \times 10^{-4}$ |
| ExC-1 | 0.015 |
| ExM-1 | 0.013 |
| ExM-4 | 0.065 |
| ExM-5 | 0.019 |
| HBS-1 | 0.30 |
| Gelatin | 1.54 |
| 10th layer (Yellow filter layer) | |

-continued (Sample 101)

| | |
|---|---|
| Yellow colloidal silver | silver 0.035 |
| Cpd-1 | 0.080 |
| HBS-1 | 0.030 |
| Gelatin | 0.95 |
| 11th layer (Low-speed blue-sensitive emulsion layer) | |
| Emulsion C | silver 0.18 |
| ExS-7 | $8.6 \times 10^{-4}$ |
| ExY-1 | 0.042 |
| ExY-2 | 0.72 |
| HBS-1 | 0.28 |
| Gelatin | 1.10 |
| 12th layer (Medium-speed blue-sensitive emulsion layer) | |
| Emulsion D | silver 0.40 |
| ExS-7 | $7.4 \times 10^{-4}$ |
| ExC-7 | $7.0 \times 10^{-3}$ |
| ExY-2 | 0.15 |
| HBS-1 | 0.050 |
| Gelatin | 0.78 |
| 13th layer (High-speed blue-sensitive emulsion layer) | |
| Emulsion F | silver 0.70 |
| ExS-7 | $2.8 \times 10^{-4}$ |
| ExY-2 | 0.20 |
| HBS-1 | 0.070 |
| Gelatin | 0.69 |
| 14th layer (1st protective layer) | |
| Emulsion G | silver 0.20 |
| UV-4 | 0.11 |
| UV-5 | 0.17 |
| HBS-1 | $5.0 \times 10^{-2}$ |
| Gelatin | 1.00 |
| 15th layer (2nd protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |

-continued (Sample 101)

| | |
|---|---|
| S-1 | 0.20 |
| Gelatin | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

The emulsions used are shown in Table 1 below.

TABLE 1

| | Average AgI content (mol %) | Average grain size (μm) | Variation coefficient (%) relating to grain size | Diameter/ thickness ratio | Silver amount ratio [core/intermediate/ shell] (AgI content) | Grain structure/shape |
|---|---|---|---|---|---|---|
| Emulsion A | 4.0 | 0.45 | 27 | 1 | (1/3)(13/1) | Double structure octahedral grain |
| Emulsion B | 8.9 | 0.70 | 14 | 1 | (3/7)(25/2) | Double structure octahedral grain |
| Emulsion C | 2.0 | 0.55 | 25 | 7 | — | Uniform structure tabular grain |
| Emulsion D | 9.0 | 0.65 | 25 | 6 | (12/59/29)(0/11/8) | Triple structure tabular grain |
| Emulsion E | 9.0 | 0.85 | 23 | 5 | (8/59/33)(0/11/8) | Triple structure tabular grain |
| Emulsion F | 14.5 | 1.25 | 25 | 3 | (37/63)(34/3) | Double structure tabular grain |
| Emulsion G | 1.0 | 0.07 | 15 | 1 | — | Uniform structure fine grain |

In Table 1, (1) The emulsions A to F were subjected to reduction sensitization during grain preparation by using thiourea dioxide and thiosulfonic acid in accordance with the Examples in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the Examples in EP 443,453A.

(3) The preparation of tabular grains was performed by using low-molecular weight gelatin in accordance with the Examples in JP-A-1-158426.

(4) Dislocation lines as described in EP 443,453A were observed in tabular grains and regular crystal grains having a grain structure when a high-voltage electron microscope was used.

The compounds used in Example 1 are illustrated below.

ExC-1

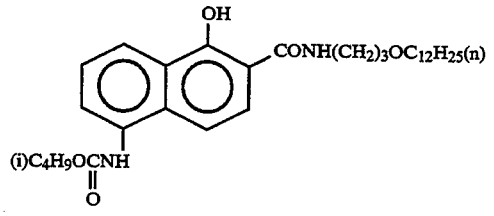

-continued
ExC-2
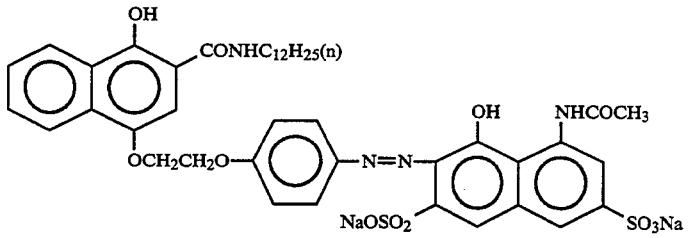
ExC-3
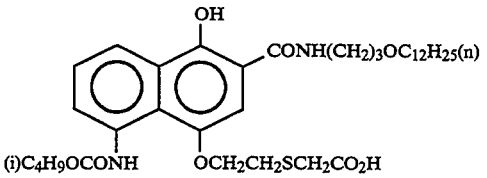
ExC-4
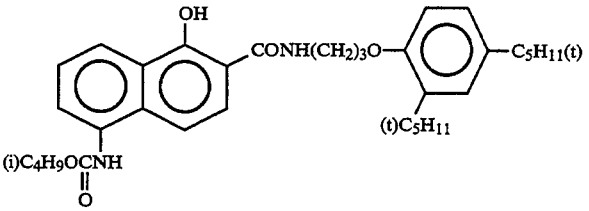
ExC-6
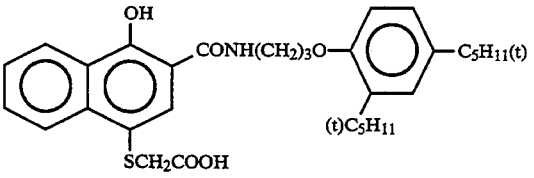
ExC-7
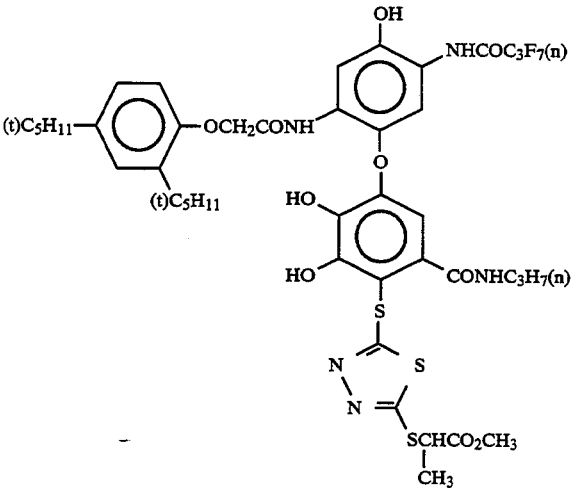

-continued
ExM-1
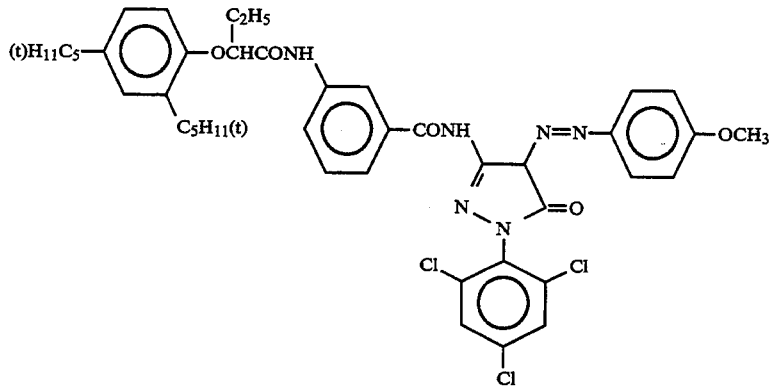
ExM-2
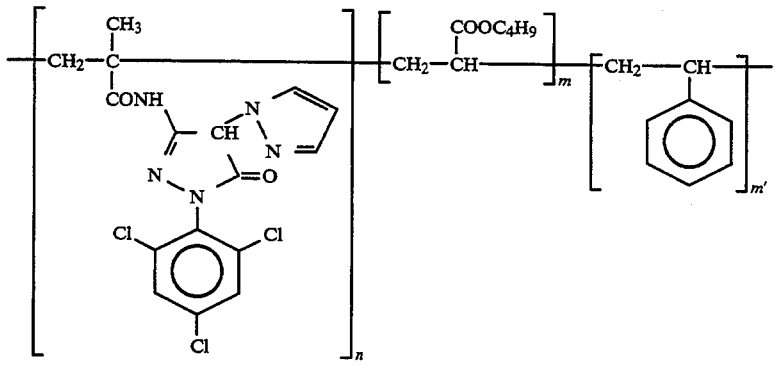
n = 50
m = 25
m' = 25
mol. wt. about 20,000
ExM-3
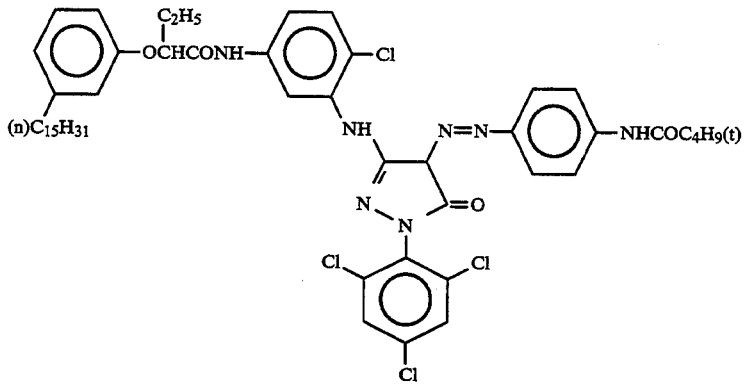
ExM-4
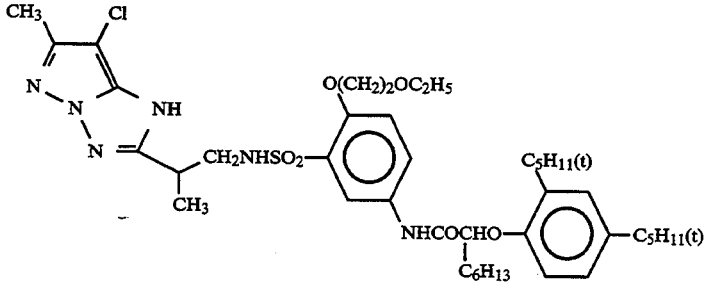

-continued
(ExM-5
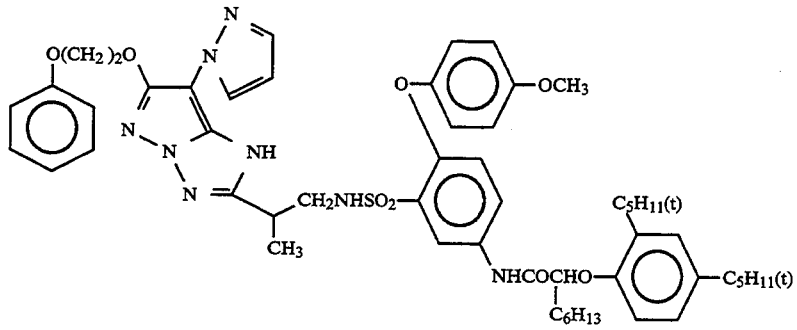
ExM-6
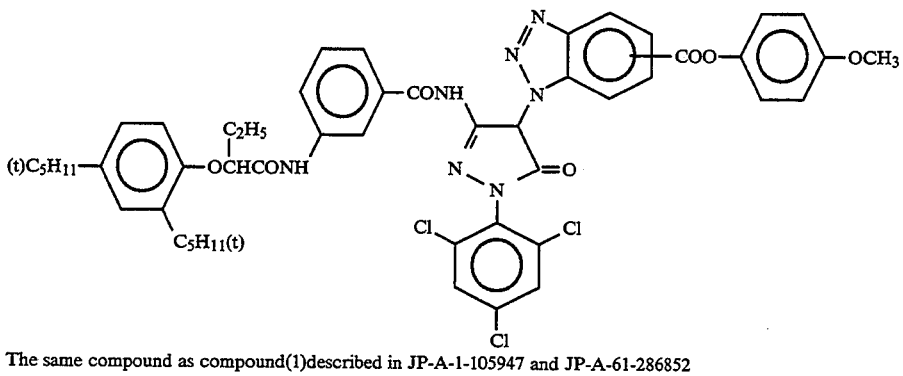
The same compound as compound(1)described in JP-A-1-105947 and JP-A-61-286852
ExY-1
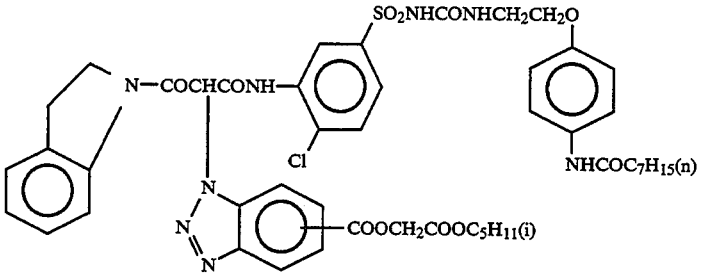
ExY-2
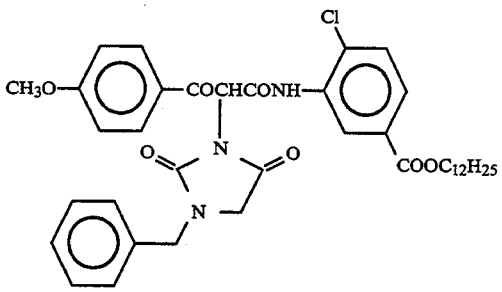
The same compound as coupler(Y-24) described in JP-A-2-154256 and coupler(Y-1) described in JP-A-63-228151 and JP-A-62-166334
Cpd-1
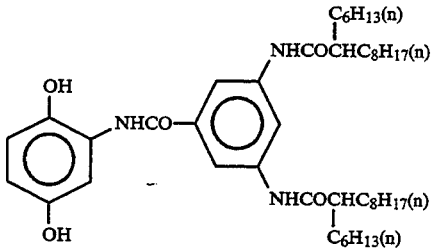
UV-1
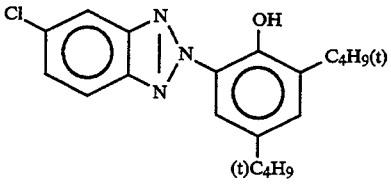

-continued
UV-2
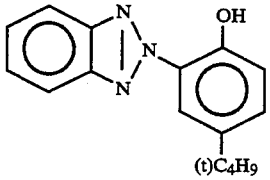
UV-3
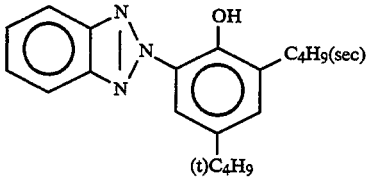
UV-4
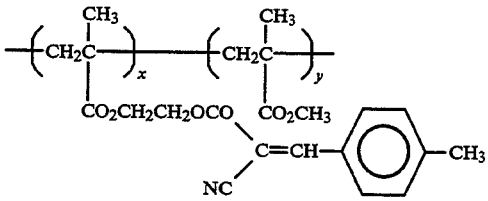
x:y = 70:30 (wt %)
UV-5
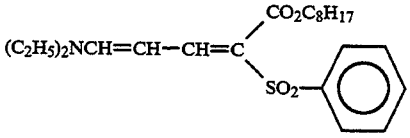
tricresyl phosphate HBS-1
Di-n-butylphthalate HBS-2
HBS-3
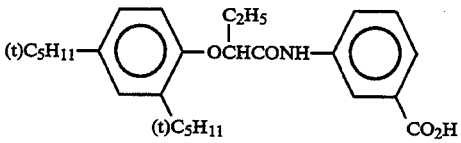
ExF-1
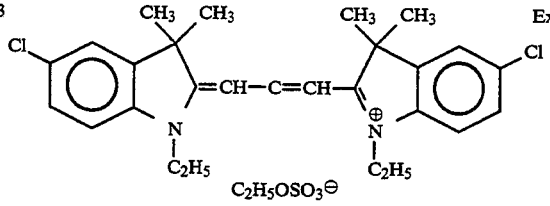
ExS-1
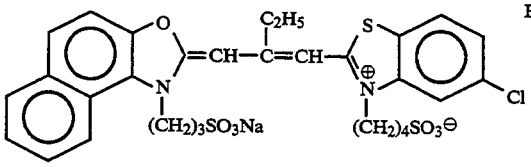
ExS-2
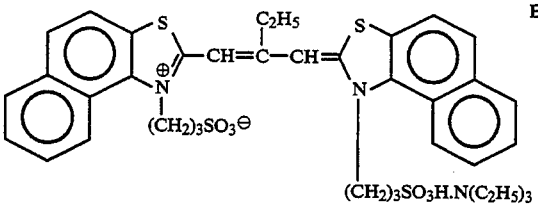
ExS-3
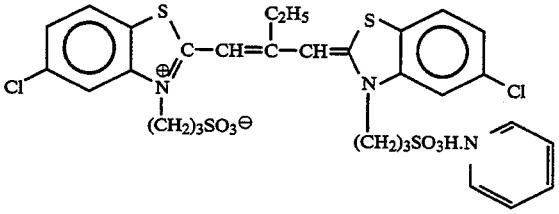
ExS-4
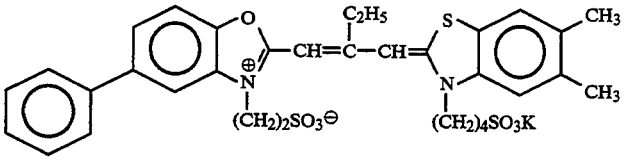
ExS-5
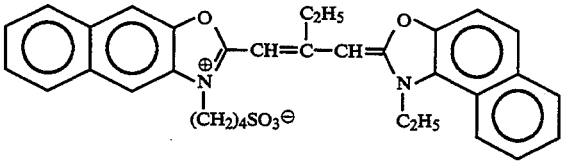
ExS-6
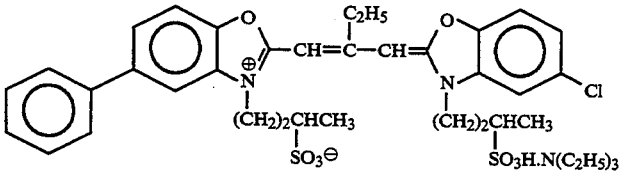

-continued
ExS-7
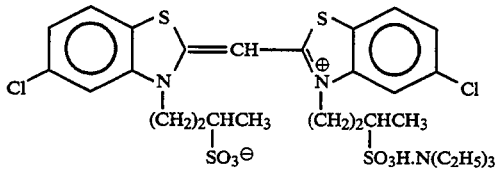
S-1
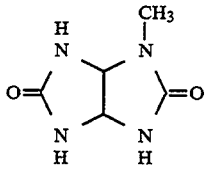
H-1
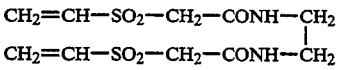
B-1
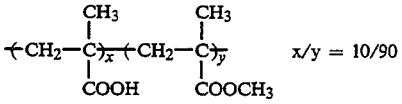
x/y = 10/90
B-2
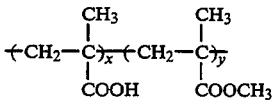
x/y = 40/60
B-3
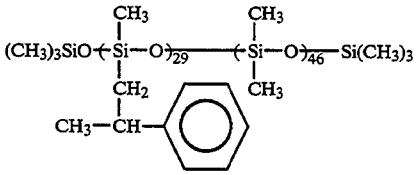
B-4
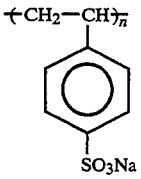
B-5
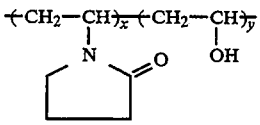
x/y = 70/30
B-6
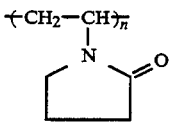
(mol. wt. about 10,000)
W-1
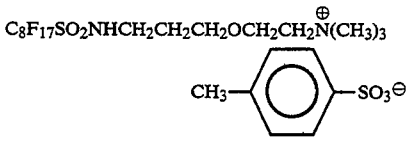
W-2
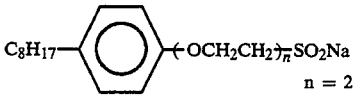
n = 2 to 4
W-3
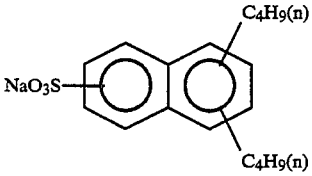
F-1
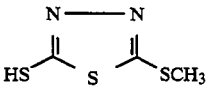
F-2
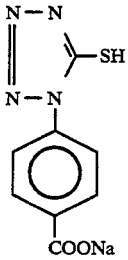
F-3
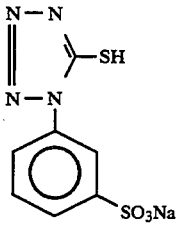
F-4
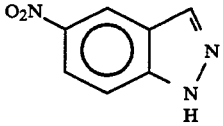
F-5
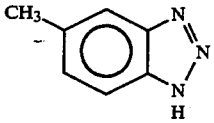
F-6
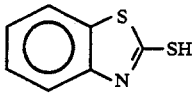

-continued

F-7

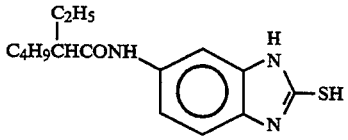

F-8

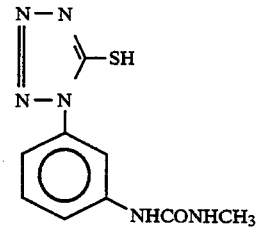

F-9

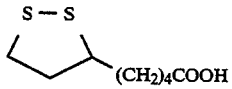

F-10

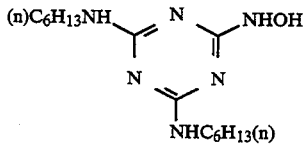

F-11

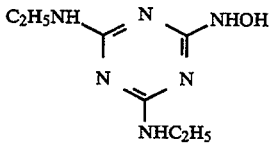

F-12

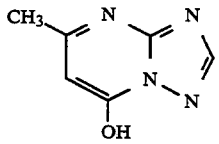

F-13

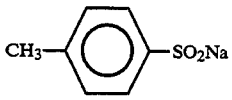

F-14

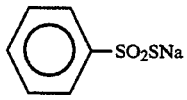

F-15

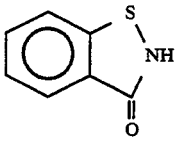

F-16

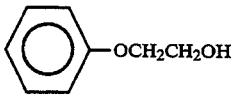

F-17

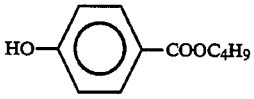

RSY-1

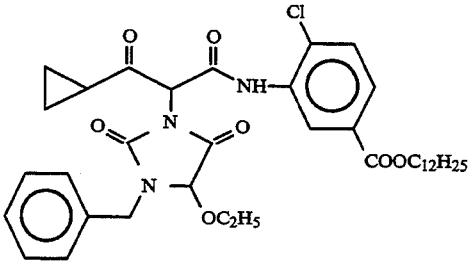

A coupler similar to coupler (19) described in JP-A-47-26133

RSY-2

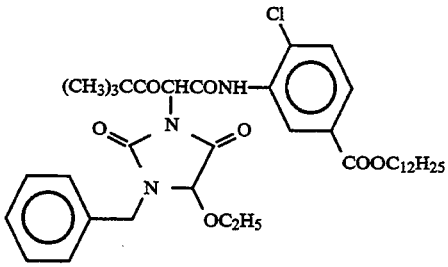

The same coupler as coupler(Y-29)described in JP-A-2-154256 and coupler(Y-2) described in JP-A-63-210927

(Samples 102–117)

Samples 102 to 117 were made by replacing ExM-6 in the 7th and 8th layers and ExY-2 in the 11th, 12th, and 13th layers of the sample 101 as shown in Table 2 below.

(Samples 118–120)

Samples 118, 119, and 120 were made by removing the yellow-colored cyan coupler (YC-20) in the 4th layers of the samples 115, 116, and 117 and adding equal molar quantities of ExC-1 in place of the coupler, respectively.

In this case, the amounts of the DIR compound used in the 7th and 8th layers and those of the yellow coupler used in the 11th, 12th, and 13th layers were controlled such that the same gamma value (gradient of a straight line connecting a point of fog density +0.2 and a point of fog density +1.0) was obtained for each of these samples when the samples were subjected to imagewise exposure with white light, color development to be described later, and density measurement through a blue filter.

(Evaluation of color reproduction)

In evaluating color reproduction, even if fidelity is improved by focusing attention on one certain color, it is often degraded if attention is focused on another color. Therefore, color reproduction must be evaluated totally by evaluating all hues at the same time. A Pointer method (M. R. POINTER; J. Photographic Science 34, 81–90, 1986) is known as an objective and quantitative method in evaluating the color reproduction of a reflecting printed image.

The present inventors performed evaluation of the color reproduction of the samples of the present invention as follows in accordance with the above Pointer method.

The samples were used to photograph a Macbeth color checker chart under artificial daylighting obtained by a photoflood lamp with a Wratten 80B filter, and developed under the conditions to be described later. The resultant images were printed from these films onto Fujicolor FA paper. In this case, the printing density was controlled such that the densities (measured by an X-rite densitometer) of red, green, and blue of the fourth medium gray according to the status A coincided with the densities of the original chart. The reflecting prints thus obtained and the original chart were measured by using a color analyzer (Hitachi Ltd.) to obtain U', V', and Y of each color chip, and these obtained values were converted into values of hue, croma, and lightness. The difference between the color chip of the original chart and that of each test sample was determined in accordance with the Pointer method, thereby obtaining a hue index, a croma index, and a lightness index. The closer the index to 100, the closer the factor indicated by that index to that of the color chip of the original chart.

The color reproduction was evaluated for the samples 101 to 120 by the method described above. Table 2 shows the results of the hue index and croma index which are particularly important in color reproduction.

(Evaluation of sharpness)

By using a conventional MTF (Modulation Transfer Function) method, the MTF value at yellow image 25 cycles/mm upon white light exposure was obtained for each of the samples 101 to 120. The results are summarized in Table 3 below.

(Evaluation of yellow coupler color forming properties) The samples 101 to 120 were subjected to imagewise exposure with white light at a color temperature of 4,800° K. through a blue filter and then to the color development to be described later. Thereafter, the yellow density of each sample was measured at an exposure amount of 5 CMS, and the obtained density ($D_B$) was taken as a measure of yellow coupler color-forming properties. The results are summarized in Table 3 below.

(Evaluation of storage stability)

After two pieces of each of the samples 101 to 120 were subjected to white imagewise exposure at the same time, one of the two pieces was stored in a freezer (condition A) for 14 days, and the other one was stored at a temperature of 50° C. and a relative humidity of 65% (condition B) for 14 days. Thereafter, these two sample pieces were subjected to development to be described later. The variation ($\Delta S_{0.5}$) of the condition B with respect to the condition A was obtained for the relative sensitivity represented by the logarithm of the reciprocal of an exposure amount at which a magenta density (fog+0.5) was obtained. The obtained variation is listed in Table 3 as a measure of storage stability.

(Evaluation of dye stability)

The samples 101 to 120 were subjected to step-wedge exposure with white light and the development to be described below, and stored at a temperature of 80° C. and a relative humidity of 70% for seven days. A dye change rate was calculated from an average of changes in each of yellow and magenta dye densities between fog density+1.0 and 2.0 obtained before and after the storage. The calculated dye change rate is listed in Table 3 as a measure of dye stability. The closer the dye change rate to 0, the better the dye stability.

The development was performed in accordance with the following method by using an automatic developing machine.

(Processing Method)

| Step | Time | Temperature | Quantity of replenisher | Tank volume |
|---|---|---|---|---|
| Color development | 3 min. 15 sec. | 38° C. | 22 ml | 20 l |
| Bleaching | 3 min. 00 sec. | 38° C. | 25 ml | 40 l |
| Washing | 30 sec. | 24° C. | 1,200 ml | 20 l |
| Fixing | 3 min. 00 sec. | 38° C. | 25 ml | 30 l |
| Washing (1) | 30 sec. | 24° C. | Counter flow piping from (2) to (1) | 10 l |
| Washing (2) | 30 sec. | 24° C. | 1,200 ml | 10 l |
| Stabilization | 30 sec. | 38° C. | 25 ml | 10 l |
| Drying | 4 min. 20 sec. | 55° C. | | |

The quantity of replenisher is represented by a value per meter of a 35-mm wide sample.

The compositions of the processing solutions will be presented below.

| | Tank solution (g) | Replenisher (g) |
|---|---|---|
| (Color developing solution) | | |
| Diethylenetriamine-pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.3 |
| Potassium iodide | 1.5 mg | — |
| Hydroxylamine sulfate | 2.4 | 2.8 |
| 4-(N-ethyl-N-β-hydroxyethylamino)-2-methylaniline sulfate | 4.5 | 6.2 |
| Water to make | 1.0 l | 1.0 l |
| pH | 10.05 | 10.15 |
| (Bleaching solution) | | |
| Ammonium Ferric ethylenediamine-tetraacetate trihydrate | 100.0 | 120.0 |
| Disodium ethylene-diaminetetraacetate | 10.0 | 11.0 |
| 3-mercapto-1,2,4-triazole | 0.08 | 0.09 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing solution) | | |
| Disodium ethylene-diaminetetraacetate | 0.5 | 0.7 |
| Ammonium sulfite | 20.0 | 22.0 |
| Aqueous ammonium thiosulfate solution (700 g/l) | 290.0 ml | 320.0 ml |
| Water to make | 1.0 l | 1.0 l |
| pH | 6.7 | 7.0 |

| (Stabilizing solution) | Common for tank solution/replenisher (g) |
|---|---|
| Sodium p-toluenesulfinate | 0.03 |

-continued

| | |
|---|---|
| Polyoxyethylene-p-monononylphenylether (average polymerization degree = 10) | 0.2 |
| Disodium ethylenediaminetetraacetate | 0.05 |
| 1,2,4-triazole | 1.3 |
| 1,4-bis(1,2,4-triazol-l-ylmethyl)-piperazine | 0.75 |
| Water to make | 1.0 l |
| pH | 8.5 |

TABLE 2

| Sample No. | Compound of present invention used | | | Color reproduction | |
|---|---|---|---|---|---|
| | DIR compound[1)] | Yellow coupler[2)] | Yellow-colored cyan couple[3)] | Hue index | Croma index |
| 101 (Comparative example) | ExM-6 | ExY-2 | YC-20 | 79 | 77 |
| 102 (Comparative example) | " | RSY-1 | " | 78 | 76 |
| 103 (Comparative example) | " | RSY-2 | " | 78 | 70 |
| 104 (Comparative example) | " | Y-1 | " | 82 | 80 |
| 105 (Comparative example) | " | Y-11 | " | 83 | 82 |
| 106 (Comparative example) | " | Y-19 | " | 82 | 81 |
| 107 (Comparative example) | (3)[4)] | ExY-2 | " | 84 | 83 |
| 108 (Comparative example) | " | RSY-1 | " | 83 | 81 |
| 109 (Comparative example) | " | RSY-2 | " | 82 | 74 |
| 110 (Present invention) | " | Y-1 | " | 90 | 91 |
| 111 (Present invention) | " | Y-11 | " | 91 | 92 |
| 112 (Present invention) | (3)[4)] | Y-19 | YC-20 | 91 | 93 |
| 113 (Present invention) | (5) | Y-1 | " | 89 | 90 |
| 114 (Present invention) | (23) | " | " | 93 | 92 |
| 115 (Present invention) | (10) | " | " | 94 | 93 |
| 116 (Present invention) | (21) | " | " | 92 | 93 |
| 117 (Present invention) | (24) | " | " | 93 | 94 |
| 118 (Present invention) | (10) | " | — | 89 | 88 |
| 119 (Present invention) | (21) | " | — | 88 | 87 |
| 120 (Present invention) | (24) | " | — | 88 | 88 |

[1)]The DIR compound used in the 7th and 8th layers.
[2)]The yellow coupler used in the 11th, 12th, and 13th layers.
[3)]The yellow-colored cyan coupler used in the 4th layer.
[4)]A compound identical with the compound (20) described in JP-A-2-154256.

TABLE 3

| Sample No. | MTF value (BL) | Color-forming properties ($D_B$) | Storage stability ($\Delta S_{0.5}$) | Dye change rate (%) | |
|---|---|---|---|---|---|
| | | | | Yellow | Magenta |
| 101 (Comparative example) | 0.85 | 2.35 | −0.18 | −34 | +25 |
| 102 (Comparative example) | 0.84 | 2.04 | −0.24 | −39 | +30 |
| 103 (Comparative example) | 0.80 | 1.93 | −0.16 | −15 | +21 |
| 104 (Comparative example) | 0.86 | 2.47 | −0.09 | −6 | +17 |
| 105 (Comparative example) | 0.87 | 2.49 | −0.08 | −3 | +18 |
| 106 (Comparative example) | 0.87 | 2.51 | −0.08 | −2 | +16 |
| 107 (Comparative example) | 0.90 | 2.39 | −0.03 | −33 | +8 |
| 108 (Comparative example) | 0.90 | 2.10 | −0.07 | −40 | +10 |
| 109 (Comparative example) | 0.88 | 1.99 | −0.04 | −17 | +6 |
| 110 (Present invention) | 0.94 | 2.53 | −0.01 | −5 | +2 |
| 111 (Present invention) | 0.93 | 2.55 | +0.01 | −3 | +3 |
| 112 (Present invention) | 0.91 | 2.58 | −0.04 | −2 | +3 |
| 113 (Present invention) | 0.90 | 2.52 | −0.03 | −5 | +2 |
| 114 (Present invention) | 0.95 | 2.54 | −0.03 | −5 | +3 |
| 115 (Present invention) | 0.96 | 2.54 | −0.01 | −6 | +2 |
| 116 (Present invention) | 0.97 | 2.53 | ±0 | −6 | +4 |
| 117 (Present invention) | 0.98 | 2.54 | ±0 | −5 | +2 |
| 118 (Present invention) | 0.92 | 2.52 | −0.02 | −5 | +4 |
| 119 (Present invention) | 0.93 | 2.52 | −0.01 | −5 | +3 |
| 120 (Present invention) | 0.93 | 2.51 | −0.01 | −4 | +3 |

As is apparent from Table 2, the samples of the present invention were superior to the samples using the conventional DIR compounds or yellow couplers in both hue and croma, indicating a good color reproduction.

In addition, Table 3 reveals that each sample of the present invention was excellent in sharpness represented by the MTF value and caused only a small photographic performance variation (relative sensitivity variation) during storage, indicating a high storage stability. Furthermore, the yellow coupler of the present invention largely improved the dye stability of a yellow image while maintaining satisfactory color-forming properties compared to conventional yellow couplers. It was also found that the combination of the yellow coupler of the present invention and the DIR compound of the invention greatly improved the dye stability of a magenta image. In addition, it was found that the use of the yellow-colored cyan coupler of the present invention allowed color reproduction and sharpness to achieve more preferable results.

EXAMPLE 2

Layers having the following compositions were formed on a subbed triacetylcellulose film support to make a multilayered color light-sensitive material, a sample 201.

(Compositions of light-sensitive layers)

The coating amount of each of a silver halide and colloidal silver is represented by a silver amount in units of g/m$^2$, and that of each of a coupler, an additive, and gelatin is represented in units of g/m$^2$. The coating amount of a sensitizing dye is represented by the number of moles per mole of a silver halide in the same layer. Note that symbols representing additives have the following meanings. Note also that an additive having a plurality of effects is represented by one of them.

UV; ultraviolet absorbent, Solv; high-boiling organic solvent, ExF; dye, ExS; sensitizing dye, ExC; cyan coupler, ExM; magenta coupler, ExY; yellow coupler, Cpd; additive.

| | |
|---|---|
| 1st layer (Antihalation layer) | |
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-11 | $1.0 \times 10^{-2}$ |
| ExF-12 | $4.0 \times 10^{-2}$ |
| ExF-13 | $5.0 \times 10^{-3}$ |
| Cpd-6 | $1.0 \times 10^{-3}$ |
| 2nd layer (Low-speed red-sensitive emulsion layer) | |
| Silver bromoiodide emulsion (AgI = 4.0 mole %, uniform AgI type, equivalent-sphere diameter = 0.4 μm, variation coefficient of equivalent-sphere diameter = 30%, tabular grain, diameter/thickness ratio = 3.0) coating silver amount | 0.35 |
| Silver bromoiodide emulsion (AgI = 6.0 mole %, internally high AgI type with core/shell ratio of 1:2, equivalent-sphere diameter = 0.45 μm, variation coefficient of equivalent-sphere diameter = 23%, tabular grain, diameter/thickness ratio = 2.0) coating silver amount | 0.18 |
| Gelatin | 0.77 |
| ExS-11 | $2.4 \times 10^{-4}$ |
| ExS-12 | $1.4 \times 10^{-4}$ |
| ExS-15 | $2.3 \times 10^{-4}$ |
| ExS-17 | $4.1 \times 10^{-6}$ |
| ExC-11 | $9.0 \times 10^{-2}$ |
| ExC-12 | $2.0 \times 10^{-2}$ |
| ExC-13 | $4.0 \times 10^{-2}$ |
| ExC-14 | $2.0 \times 10^{-2}$ |
| ExC-15 | $8.0 \times 10^{-2}$ |
| Yellow-colored cyan coupler (YC-12) | $2.0 \times 10^{-2}$ |
| ExC-19 | $1.0 \times 10^{-2}$ |
| 3rd layer (Medium-speed red-sensitive emulsion layer) | |
| Silver bromoiodide emulsion (AgI = 6.0 mole %, internally high AgI type with core/shell ratio of 1:2, equivalent-sphere diameter = 0.65 μm, variation coefficient of equivalent-sphere diameter = 23%, tabular grain, diameter/thickness ratio = 2.0) coating silver amount | 0.65 |
| Gelatin | 1.46 |
| ExS-11 | $2.4 \times 10^{-4}$ |
| ExS-12 | $1.4 \times 10^{-4}$ |
| ExS-15 | $2.4 \times 10^{-4}$ |
| ExS-17 | $4.3 \times 10^{-6}$ |
| ExC-11 | 0.19 |
| ExC-12 | $1.0 \times 10^{-2}$ |
| ExC-13 | $2.5 \times 10^{-2}$ |
| ExC-14 | $1.6 \times 10^{-2}$ |
| ExC-15 | 0.19 |
| Yellow-colored cyan coupler (YC-12) | $2.0 \times 10^{-2}$ |
| ExC-17 | $3.0 \times 10^{-2}$ |
| ExC-18 | $1.0 \times 10^{-2}$ |
| ExC-19 | $3.0 \times 10^{-2}$ |
| 4th layer (High-speed red-sensitive emulsion layer) | |
| Silver bromoiodide emulsion (AgI = 9.3 mole %, multiple structure grain with core/shell ratio of 3:4:2, AgI contents from inside = 24, 0, and 6 mole %, equivalent-sphere diameter = 0.75 μm, variation coefficient of equivalent-sphere diameter = 23%, tabular grain, diameter/thickness ratio = 2.5) coating silver amount | 0.90 |
| Gelatin | 1.38 |
| ExS-11 | $2.0 \times 10^{-4}$ |
| ExS-12 | $1.1 \times 10^{-4}$ |
| ExS-15 | $1.9 \times 10^{-4}$ |
| ExS-17 | $1.4 \times 10^{-5}$ |
| ExC-11 | $8.0 \times 10^{-2}$ |
| ExC-14 | $9.0 \times 10^{-2}$ |
| Yellow-colored cyan coupler (YC-12) | $2.0 \times 10^{-2}$ |
| ExC-19 | $1.0 \times 10^{-2}$ |
| Solv-1 | 0.40 |
| Solv-2 | 0.15 |
| 5th layer (Interlayer) | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| 6th layer (Low-speed green-sensitive emulsion layer) | |
| Silver bromoiodide emulsion (AgI = 4.0 mole %, uniform AgI type, equivalent-sphere diameter = 0.45 μm, variation coefficient of equivalent-sphere diameter = 15%, tabular grain, diameter/thickness ratio = 4.0) coating silver amount | 0.13 |
| Gelatin | 0.31 |
| ExS-13 | $1.0 \times 10^{-4}$ |
| ExS-14 | $3.1 \times 10^{-4}$ |
| ExS-15 | $6.4 \times 10^{-5}$ |
| ExM-11 | 0.14 |
| ExM-17 | $2.1 \times 10^{-2}$ |
| Solv-1 | 0.09 |
| Solv-4 | $7.0 \times 10^{-3}$ |
| 7th layer (Medium-speed green-sensitive emulsion layer) | |
| Silver bromoiodide emulsion (AgI = 4.0 mole %, uniform AgI type, equivalent-sphere diameter = 0.65 μm, variation coefficient of equivalent-sphere diameter = 18%, tabular grain, diameter/thickness ratio = 4.0) coating silver amount | 0.31 |
| Gelatin | 0.54 |
| ExS-13 | $2.7 \times 10^{-4}$ |
| ExS-14 | $8.2 \times 10^{-4}$ |
| ExS-15 | $1.7 \times 10^{-4}$ |
| ExM-11 | 0.28 |
| ExM-17 | $7.2 \times 10^{-2}$ |
| ExY-11 | $5.4 \times 10^{-2}$ |
| Solv-1 | 0.23 |
| Solv-4 | $1.8 \times 10^{-2}$ |
| 8th layer (High-speed green-sensitive emulsion layer) | |
| Silver bromoiodide emulsion (AgI = 9.8 mole %, multiple structure grain with silver amount ratio of 3:4:2, AgI contents from inside = 24, 0, and 3 mole %, equivalent-sphere diameter = 0.81 μm, variation coefficient of equivalent-sphere diameter = 23%, multiple twinned crystal tabular grain, diameter/thickness ratio = 2.5) coating silver amount | 0.49 |
| Gelatin | 0.61 |
| ExS-14 | $4.3 \times 10^{-4}$ |
| ExS-15 | $8.6 \times 10^{-5}$ |
| ExS-18 | $2.8 \times 10^{-5}$ |
| ExM-15 | $1.0 \times 10^{-2}$ |
| ExM-16 | $3.0 \times 10^{-2}$ |
| ExY-11 | $0.5 \times 10^{-2}$ |
| ExC-11 | $0.8 \times 10^{-2}$ |
| ExC-14 | $2.5 \times 10^{-3}$ |
| Solv-1 | 0.12 |
| Cpd-8 | $1.0 \times 10^{-2}$ |
| 9th layer (Interlayer) | |
| Gelatin | 0.56 |
| Cpd-1 | $4.0 \times 10^{-2}$ |
| Polyethylacrylate latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| 10th layer (Donor layer having interlayer effect on | |

-continued

| | |
|---|---|
| red-sensitive layer) | |
| Silver bromoiodide emulsion (AgI = 8.0 mole %, internally high AgI type grain with core/shell ratio of 1:2, equivalent-sphere diameter = 0.72 μm, variation coefficient of equivalent-sphere diameter = 28%, multiple twinned crystal tabular grain, diameter/thickness ratio = 2.0) | 0.67 |
| coating silver amount | |
| Silver bromoiodide emulsion (AgI = 10.0 mole %, internally high AgI type grain with core/shell ratio of 1:3, equivalent-sphere diameter = 0.40 μm, variation coefficient of equivalent-sphere diameter = 15%, regular crystal grain) | 0.22 |
| coating silver amount | |
| Gelatin | 0.87 |
| ExS-13 | $6.7 \times 10^{-4}$ |
| ExM-14 | 0.16 |
| Solv-1 | 0.30 |
| 11th layer (Yellow filter layer) | |
| Yellow colloidal silver | $9.0 \times 10^{-2}$ |
| Gelatin | 0.84 |
| Cpd-2 | 0.13 |
| Solv-1 | 0.13 |
| Cpd-1 | $2.5 \times 10^{-2}$ |
| Cpd-6 | $2.0 \times 10^{-3}$ |
| H-1 | 0.25 |
| 12th layer (Low-speed blue-sensitive emulsion layer) | |
| Silver bromoiodide emulsion (AgI = 9.0 mole %, multiple structure grain, equivalent-sphere diameter = 0.70 μm, variation coefficient of equivalent-sphere diameter = 20%, tabular grain, diameter/thickness ratio = 7.0, grains found to have 10 or more dislocation lines upon observation by 200-kv transmission electron microscope account for 50% or more of all grains) | 0.50 |
| coating silver amount | |
| Silver bromoiodide emulsion (AgI = 2.5 mole %, uniform AgI type, equivalent-sphere diameter = 0.50 μm, variation coefficient of equivalent-sphere diameter = 30%, tabular grain, diameter/thickness ratio = 6.0) | 0.30 |
| coating silver amount | |
| Gelatin | 2.18 |
| ExS-16 | $9.0 \times 10^{-4}$ |
| ExC-12 | 0.10 |
| ExY-12 | 0.05 |
| ExY-13 | 1.20 |
| Solv-1 | 0.54 |
| 13th layer (High-speed blue-sensitive emulsion layer) | |
| Silver bromoiodide emulsion (AgI = 10.0 mole %, internally high AgI type grain, equivalent-sphere diameter = 1.2 μm, variation coefficient of equivalent-sphere diameter = 25%, multiple twinned crystal tabular grain, diameter/thickness ratio = 2.0) | 0.40 |
| coating silver amount | |
| Gelatin | 0.59 |
| ExS-16 | $2.6 \times 10^{-4}$ |
| ExY-12 | $1.0 \times 10^{-2}$ |
| ExY-15 | 0.20 |
| ExC-11 | $1.0 \times 10^{-2}$ |
| Solv-1 | $9.0 \times 10^{-2}$ |
| 14th layer (1st protective layer) | |
| Fine grain silver bromoiodide emulsion (AgI = 2.0 mole %, uniform AgI type, equivalent-sphere diameter = 0.07 μm) | 0.12 |
| coating silver amount | |
| Gelatin | 0.63 |
| UV-4 | 0.11 |
| UV-5 | 0.18 |
| Solv-5 | $2.0 \times 10^{-2}$ |
| Polyethylacrylate latex | $9.0 \times 10^{-2}$ |
| 15th layer (2nd protective layer) | |
| Fine grain silver bromoiodide emulsion (AgI = 2.0 mole %, uniform AgI type, equivalent-sphere diameter = 0.07 μm) | 0.36 |
| coating silver amount | |
| Gelatin | 0.85 |
| B-11 (diameter 2.0 μm) | $8.0 \times 10^{-2}$ |
| B-12 (diameter 2.0 μm) | $8.0 \times 10^{-2}$ |
| B-13 | $2.0 \times 10^{-2}$ |
| W-14 | $2.0 \times 10^{-2}$ |
| H-1 | 0.18 |

In addition to the above components, the sample thus manufactured had been added with 1,2-benzisothiazolin-3-one (200 ppm on average with respect to gelatin), n-butyl-p-hydroxybenzoate (about 1,000 ppm on average with respect to gelatin), and 2-phenoxyethanol (about 10,000 ppm on average with respect to gelatin). The sample also contained B-14, B-15, B-16, F-11, F-12, F-13, F-14, F-15, F-16, F-17, F-18, F-19, F-20, F-21, F-22, iron salt, lead salt, gold salt, platinum salt, iridium salt, and rhodium salt.

Each layer was added with surfactants W-11, W-12, and W-13 as coating aids or emulsion dispersants in addition to the above components.

The chemical structures of the compounds used in Example 2 are presented below.

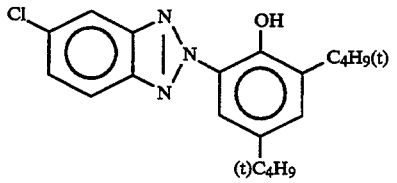

UV-1

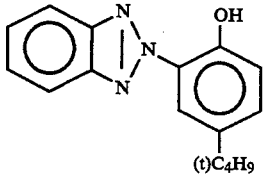

UV-2

-continued
UV-3
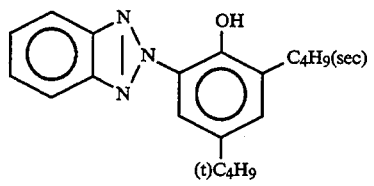
UV-4
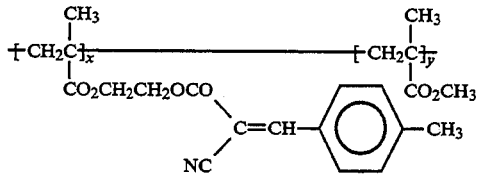
x:y = 70:30 (wt %)
UV-5
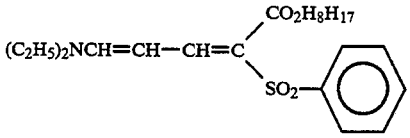
Solv-1
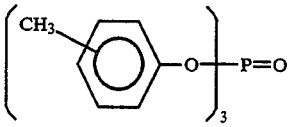
Solv-2
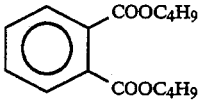
Solv-4
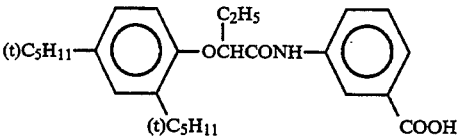
Solv-5
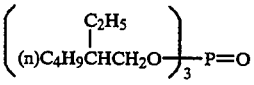
ExF-11
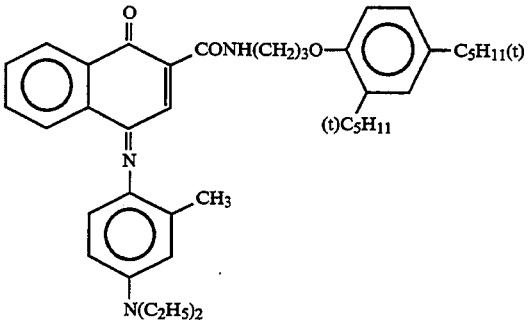

-continued
ExF-12
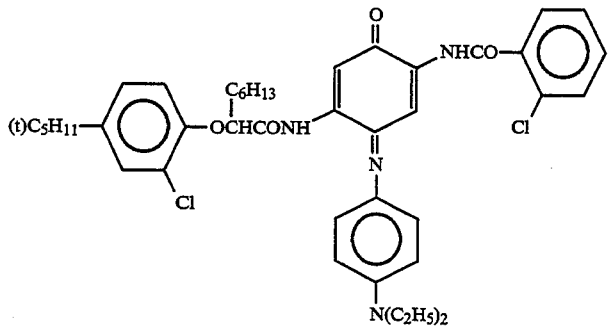
ExF-13
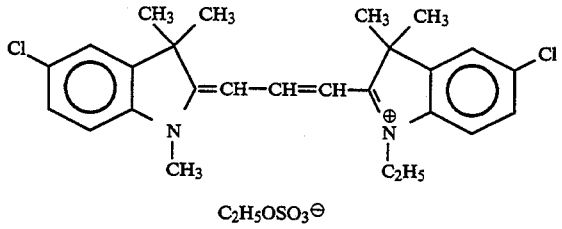
ExC-11
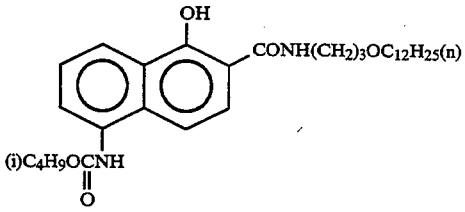
ExC-12
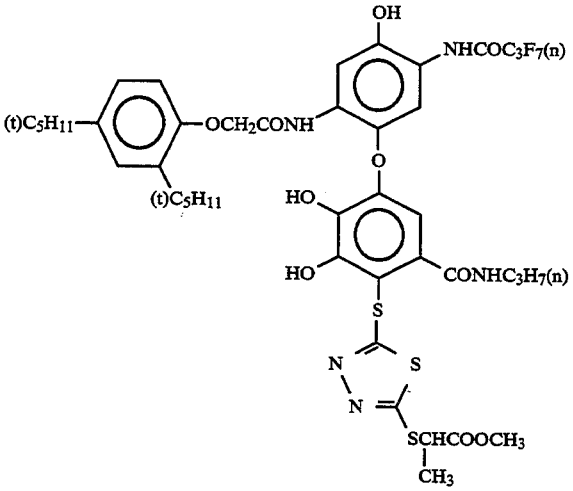
ExC-13
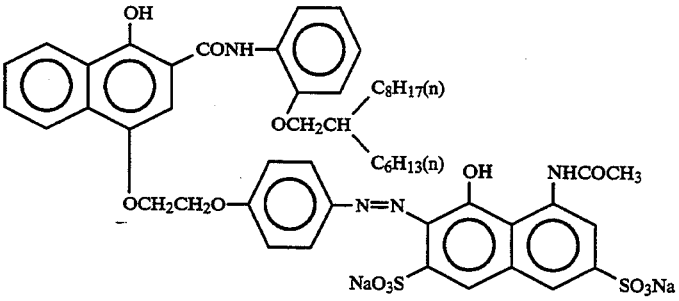

-continued
ExC-14
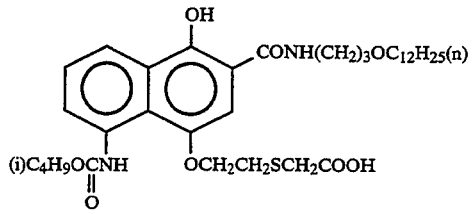
ExC-15
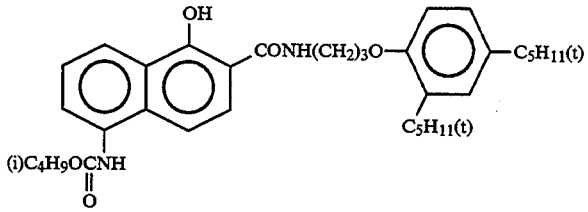
ExC-17
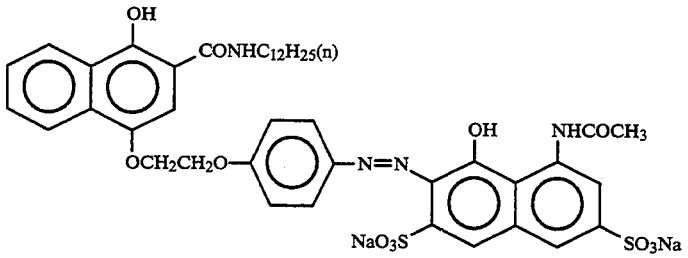
ExC-18
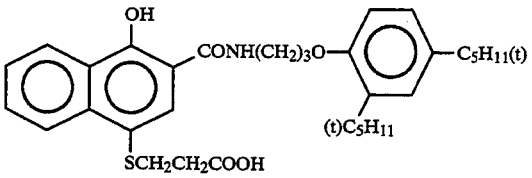
ExC-19
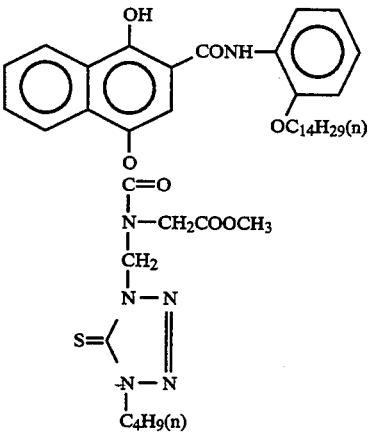

-continued
ExM-11
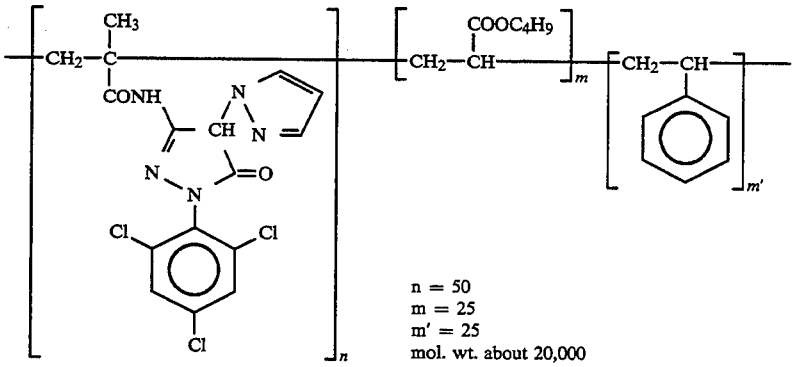
ExM-14
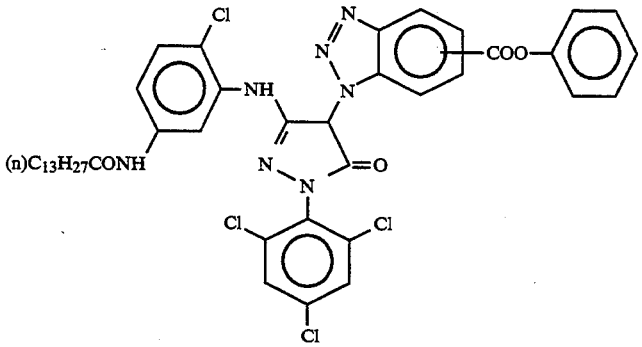
The same compound as the compound(49)described in for example, JP-A-1-105947
ExM-15
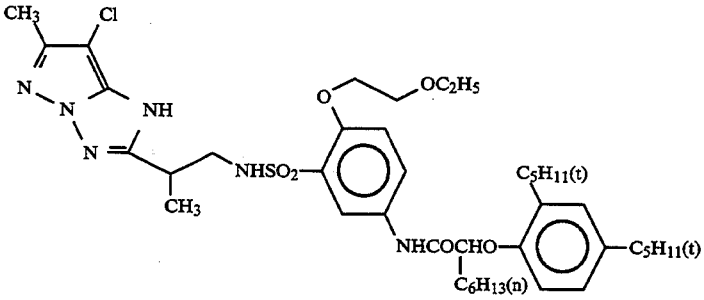
ExM-16
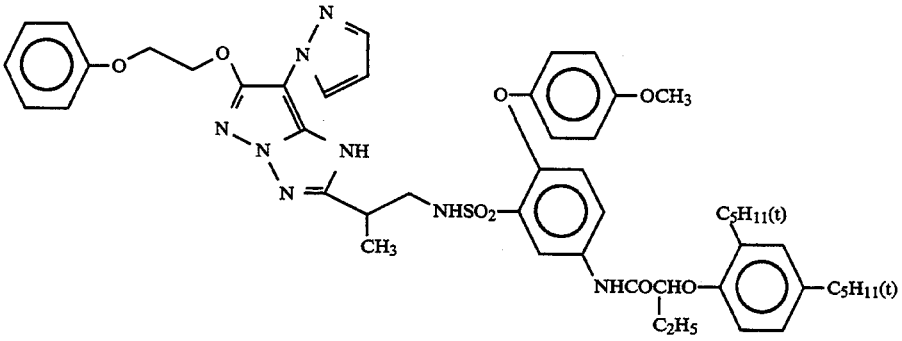

-continued
ExM-17
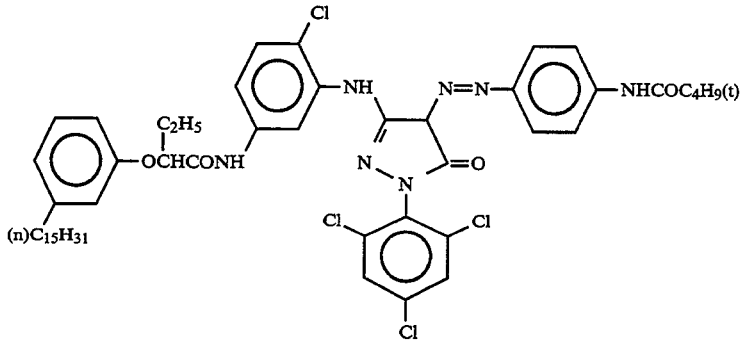
ExY-11
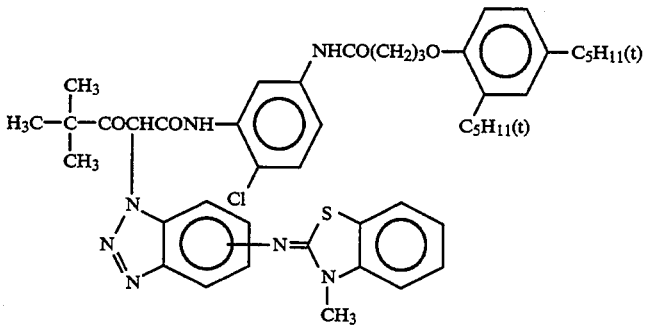
ExY-12
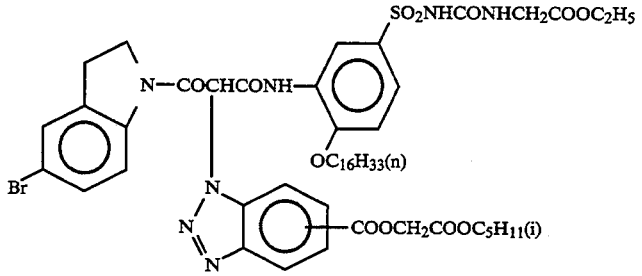
ExY-13
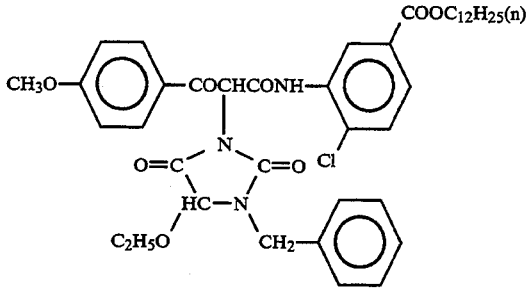
The same coupler as the coupler(ExY-15)described in JP-A-2-154256, the coupler(EX-9)described in JP-A-1-105947 or the coupler(C-9) described in JA-A-61-286852
Cpd-1
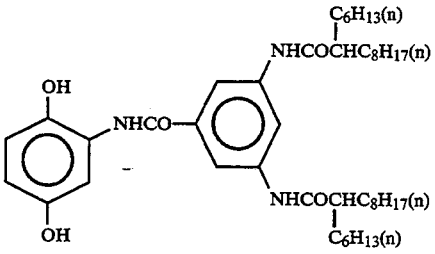

-continued
Cpd-2
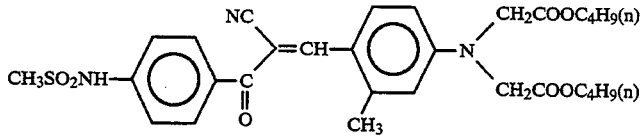
Cpd-6
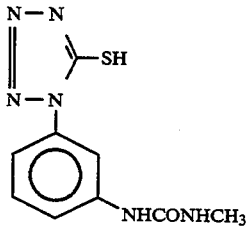
Cpd-8
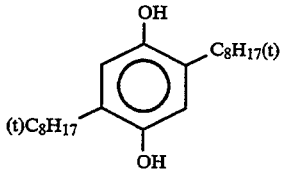
H-1
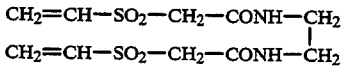
W-11
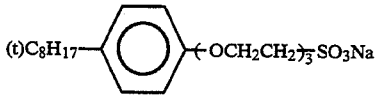
W-12
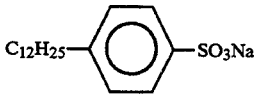
W-13
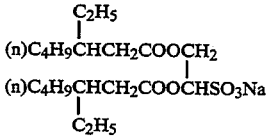
W-14
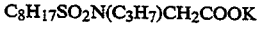
ExS-11
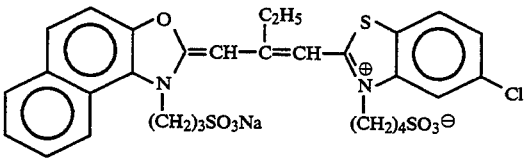
ExS-12
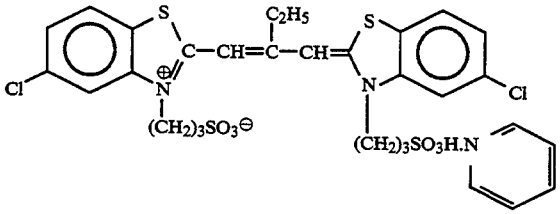
ExS-13
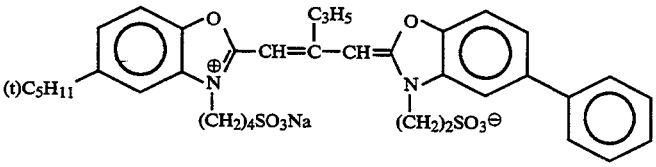

-continued
ExS-14
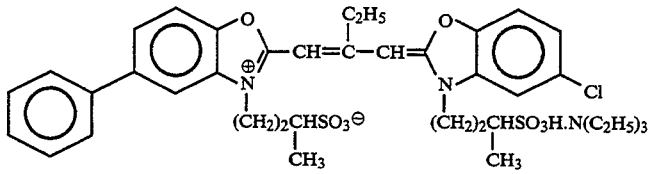
ExS-15
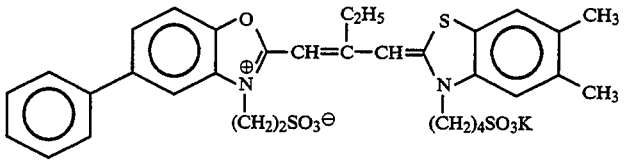
ExS-16
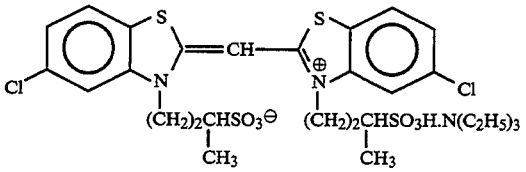
ExS-17
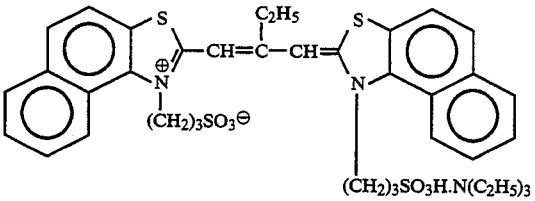
ExS-18
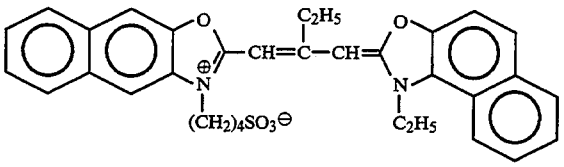
F-11
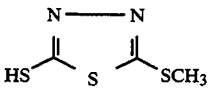
F-12
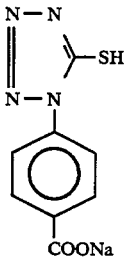
F-13
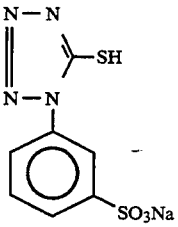

-continued
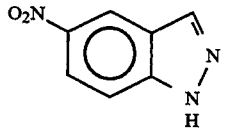
F-14
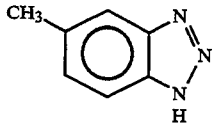
F-15
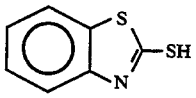
F-16
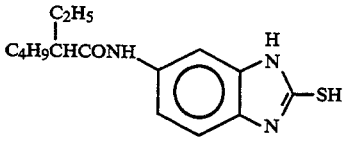
F-17
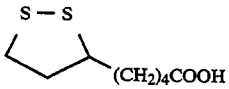
F-18
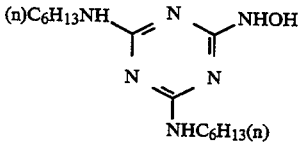
F-19
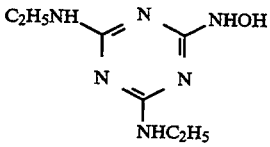
F-20
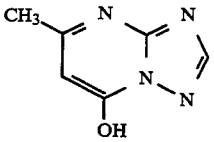
F-21
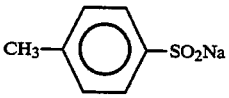
F-22
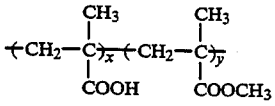
x/y = 10/90
B-11
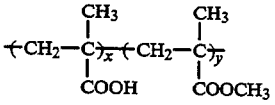
x/y = 40/60
B-12
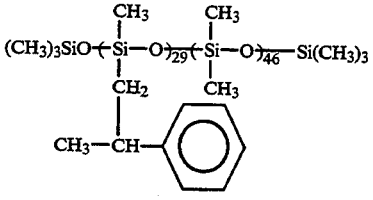
B-13

-continued
B-14
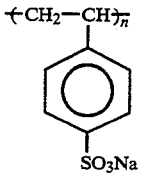
B-15
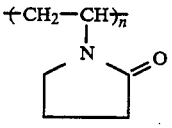
(mol. wt. about 10,000)
B-16
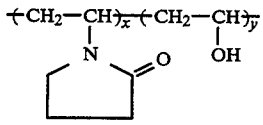
x/y = 70/30
RSM-1
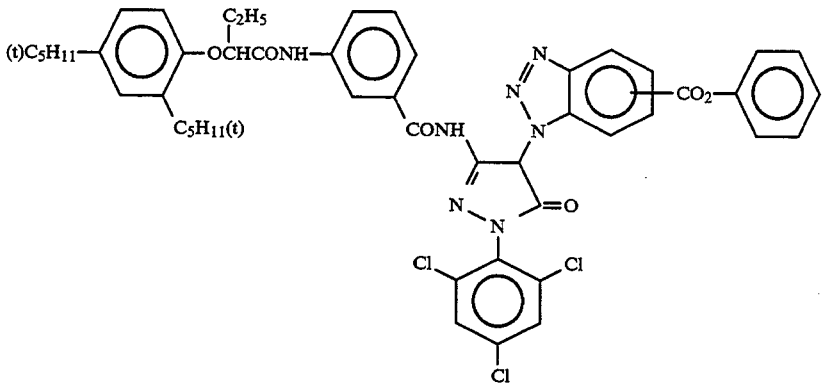
The same compound as the compound(D'-9) described n JP-A-63-228151, and the compound (D-23) described in JP-A-62-166334
RSM-2
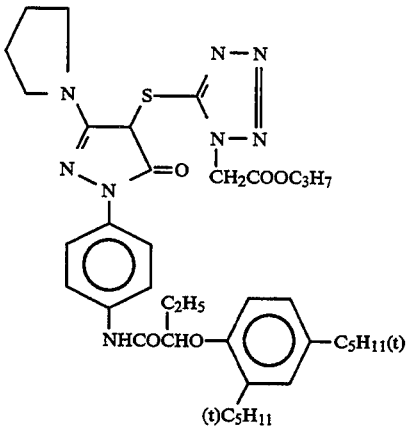
A compound identical to the compound(19) described in JP-A-2-154256, or similar to the compound(8)described in JP-A-1-105947, the compound(C-10)described in JP-A-63-210927 or the compound(D-55) described in JP-A-62-166334
RSY-3
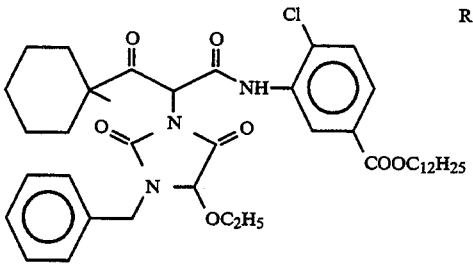
A coupler similer to the coupler(30) described in U.S. Pat. No. Re. 27,848

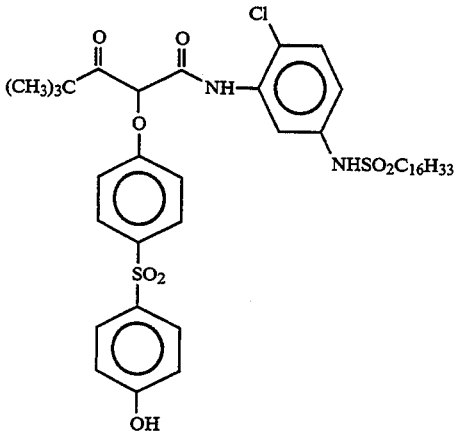

RYS-4

A coupler the same as the coupler defined in claim 10 of U.S. Pat. No. 3,933,501 and the coupler(Y-14)described in JP-A-63-210927, and similor to the coupler(Y-17)described in JP-A-50-36125

(Samples 202–219)

Samples 202 to 219 were made by replacing ExM-14 in the 10th layer and ExY-13 in the 12th and 13th layers of the sample 101 as shown in Table 4 below.

(Samples 220–222)

Samples 220, 221, and 222 were made by removing the yellow-colored cyan coupler (YC-12) in the 2nd, 3rd, and 4th layers of the samples 217, 218, and 219 and adding equal molar quantities of ExC-11 in place of the coupler, respectively.

As in the making of the samples in Example 1, the amount of the DIR compound used in the 10th layer and those of the yellow coupler used in the 12th and 13th layers were controlled such that the gammas were substantially constant.

The samples 201 to 222 thus formed were subjected to evaluations of color reproduction, sharpness, yellow coupler color forming properties, storage stability, and dye stability following the same procedures as in Example 1. The results are summarized in Tables 4 and 5 below.

The development was performed in accordance with the following method by using an automatic developing machine.

(Processing method)

| Step | Time | Temperature | Quantity of replenisher | Tank volume |
|---|---|---|---|---|
| Color development | 3 min. 15 sec. | 38° C. | 45 ml | 10 l |
| Bleaching | 1 min. 00 sec. | 38° C. | 20 ml | 4 l |
| Bleach-fixing | 3 min. 15 sec. | 38° C. | 30 ml | 8 l |
| Washing (1) | 40 sec. | 35° C. | Counter flow piping from (2) to (1) | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

The quantity of replenisher is represented by a value per meter of a 35-mm wide sample.

The compositions of the processing solutions will be presented below.

(Color developing solution)

| | Tank solution (g) | Replenisher (g) |
|---|---|---|
| Diethylenetriamine-pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |

(Bleaching solution)

| | Common for tank solution/ replenisher (g) |
|---|---|
| Ammonium ferric ethylenediamine-tetraacetate dehydrate | 120.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Ammonia water (27%) | 15.0 ml |
| water to make | 1.0 l |
| pH | 6.3 |

(Bleach-fixing solution)

| | Tank solution (g) | Replenisher (g) |
|---|---|---|
| Ammonium ferric ethylenediamine tetraacetate dehydrate | 50.0 | — |
| Disodium ethylene-diaminetetraacetate | 5.0 | 2.0 |
| Sodium sulfite | 12.0 | 20.0 |
| Aqueous ammonium thiosulfate solution (700 g/l) | 240.0 ml | 400.0 ml |
| Ammonia water (27%) | 6.0 ml | — |
| Water to make | 1.0 l | 1.0 l |
| pH | 7.2 | 7.3 |

(Washing solution)

Tap water was passed through a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution fell within the range of 6.5 to 7.5.

(Stabilizing solution)

| | Common for tank solution/ replenisher (g) |
|---|---|
| Sodium p-toluenesulfinate | 0.03 |
| Polyoxyethylene-p-monononylphenylether (average polymerization degree = 10) | 0.2 |
| Disodium ethylene-diaminetetraacetate | 0.05 |
| 1,2,4-triazole | 1.3 |
| 1,4-bis(1,2,4-triazol-1-ylmethyl)-piperazine | 0.75 |
| Water to make | 1.0 l |

-continued (Stabilizing solution)

| | |
|---|---|
| pH | 8.5 |

TABLE 4

| Sample No. | Compound of present invention used: DIR compound[1)] | Yellow coupler[2)] | Yellow-colored cyan couple[3)] | Color reproduction: Hue index | Color reproduction: Croma index |
|---|---|---|---|---|---|
| 201 (Comparative example) | ExM-14 | ExY-13 | YC-12 | 86 | 84 |
| 202 (Comparative example) | RSM-1 | " | " | 85 | 82 |
| 203 (Comparative example) | RSM-2 | " | " | 82 | 80 |
| 204 (Comparative example) | (18)4) | " | " | 90 | 88 |
| 205 (Comparative example) | (26) | " | " | 89 | 86 |
| 206 (Comparative example) | (13) | " | " | 92 | 89 |
| 207 (Comparative example) | (14) | " | " | 93 | 90 |
| 208 (Comparative example) | (29) | " | " | 92 | 90 |
| 209 (Comparative example) | (9) | RSY-3 | " | 90 | 87 |
| 210 (Comparative example) | " | RSY-4 | " | 91 | 85 |
| 211 (Present invention) | " | Y-4 | " | 96 | 95 |
| 212 (Present invention) | " | Y-15 | " | 97 | 94 |
| 213 (Present invention) | (9) | Y-29 | YC-12 | 98 | 95 |
| 214 (Comparative example) | ExM-14 | Y-4 | " | 89 | 86 |
| 215 (Comparative example) | RSM-1 | " | " | 88 | 86 |
| 216 (Comparative example) | RSM-2 | " | " | 86 | 85 |
| 217 (Present invention) | (14) | Y-29 | " | 98 | 97 |
| 218 (Present invention) | (19) | " | " | 97 | 95 |
| 219 (Present invention) | (29) | " | " | 97 | 96 |
| 220 (Present invention) | (14) | " | — | 93 | 92 |
| 221 (Present invention) | (19) | " | — | 91 | 90 |
| 222 (Present invention) | (29) | " | — | 92 | 92 |

[1)]The DIR compound used in the 10th layer.
[2)]The yellow coupler used in the 12th and 13th layers.
[3)]The yellow-colored cyan coupler used in the 2nd, 3rd, and 4th layers.
[4)]A compound identical with the compound (22) described in JP-A-2-154256.

Common for tank solution/ replenisher (g)

TABLE 5

| Sample No. | MTF value (BL) | Color-forming properties ($D_B$) | Storage stability ($\Delta S_{0.5}$) | Dye change rate (%): Yellow | Dye change rate (%): Magenta |
|---|---|---|---|---|---|
| 201 (Comparative Example) | 0.93 | 2.70 | −0.20 | −45 | +41 |
| 202 (Comparative Example) | 0.92 | 2.70 | −0.19 | −44 | +39 |
| 203 (Comparative Example) | 0.89 | 2.69 | −0.37 | −44 | +37 |
| 204 (Comparative Example) | 0.98 | 2.72 | −0.10 | −45 | +12 |
| 205 (Comparative Example) | 0.97 | 2.70 | −0.12 | −44 | +10 |
| 206 (Comparative Example) | 0.99 | 2.73 | −0.08 | −43 | +9 |

TABLE 5-continued

| Sample No. | MTF value (BL) | Color-forming properties ($D_B$) | Storage stability ($\Delta S_{0.5}$) | Dye change rate (%) Yellow | Magenta |
|---|---|---|---|---|---|
| 207 (Comparative Example) | 0.99 | 2.71 | −0.07 | −42 | +9 |
| 208 (Comparative Example) | 0.98 | 2.72 | −0.08 | −45 | +11 |
| 209 (Comparative Example) | 0.97 | 2.22 | −0.09 | −38 | +8 |
| 210 (Comparative Example) | 0.96 | 2.47 | −0.10 | −31 | +7 |
| 211 (Present Invention) | 1.04 | 2.84 | −0.03 | −4 | +1 |
| 212 (Present Invention) | 1.03 | 2.81 | −0.01 | −3 | ±0 |
| 213 (Present Invention) | 1.03 | 2.79 | −0.02 | −3 | −1 |
| 214 (Comparative Example) | 0.96 | 2.82 | −0.09 | −4 | +11 |
| 215 (Comparative Example) | 0.95 | 2.80 | −0.08 | −4 | +9 |
| 216 (Comparative Example) | 0.93 | 2.80 | −0.14 | −3 | +13 |
| 217 (Present Invention) | 1.07 | 2.82 | ±0 | −3 | ±0 |
| 218 (Present Invention) | 1.05 | 2.80 | −0.01 | −2 | +2 |
| 219 (Present Invention) | 1.08 | 2.81 | −0.01 | −3 | +3 |
| 220 (Present Invention) | 1.02 | 2.83 | −0.01 | −4 | +1 |
| 221 (Present Invention) | 1.00 | 2.80 | −0.02 | −4 | +2 |
| 222 (Present Invention) | 1.04 | 2.81 | −0.02 | −5 | +2 |

As is apparent from the Tables 4 and 5, similar to the results of Example 1, the samples of the present invention were excellent in color reproduction, sharpness, storage stability, yellow coupler color-forming properties, and dye stability. It was also found that the use of the yellow-colored cyan coupler of the present invention permitted the effects of the present invention to achieve more preferable results.

In addition, it was found that the samples of Example 2 of the present invention in which the 10th layer (donor layer having an interlayer effect on red-sensitive layers) was arranged were superior to the samples of Example 1 of the present invention in color reproduction.

EXAMPLE 3

(Making of sample 301)

A sample 301 was made following the same procedures as for the sample 201 except that 0.04 g/m$^2$ of the conventional yellow coupler ExY-13 was added to the 10th layer of the sample 201 and the addition amount of ExY-13 to the 12th layer was reduced to 1.18 g/m$^2$. In this case, the oil phase and the water phase to be presented below were dissolved and mixed together and emulsified at 8,000 rpm by using a high-speed impeller dissolver to prepare an emulsion (emulsion A), and the addition of the yellow coupler ExY-13 to the 10th layer was performed by using this emulsion immediately after the emulsification.

| (Oil phase) | |
|---|---|
| ExM-14 | 60.0 g |
| ExY-13 | 15.0 g |
| Solv-1 | 112.5 g |
| Ethylacetate | 100 ml |
| (Water phase) | |
| Gelatin | 100.0 g |
| W-11 | 1.0 g |
| W-12 | 1.0 g |
| Water | 1,000 ml |

(Making of samples 302–305)

Samples 302 to 304 were made following the same procedures as for the sample 301 except that ExM-14 and ExY-13 in the 10th layer and ExY-13 in the 12th and 13th layers of the sample 301 were replaced by equal molar quantities as shown in Table 6. Note that the emulsion used in the 10th layer was prepared following the same procedures as for the emulsion A except that the DIR compound and the yellow coupler used were changed as shown in Table 6 below.

The samples 301 to 305 thus obtained were subjected to evaluations of color reproduction, sharpness, and dye stability following the same procedures as in Example 2. The obtained results, together with the evaluation results of the samples 201, 207, and 217 as comparative samples for checking the effect of adding the yellow coupler to the 10th layer, are summarized in Table 6. In addition, evaluation was performed for the sharpness of samples made by adding the emulsion to the 10th layer immediately after the emulsification of the emulsion and that of samples made by using the emulsion aged at room temperature for 30 days after the preparation. The evaluation results are also summarized in Table 6. The emulsions of the comparative samples were also prepared following the same procedures as for the emulsion A.

TABLE 6

| Sample No. | Compound used in 10th layer: DIR compound[1] | Compound used in 10th layer: Yellow coupler[2] | Yellow Coupler[3] used in 12th and 13th layers | Color reproduction: Hue index | Color reproduction: Croma index | Dye change rate: Yellow | Dye change rate: Magenta | MTF value (BL): Immediately after emulsification[4] | MTF value (BL): After aging[5] |
|---|---|---|---|---|---|---|---|---|---|
| 301 (Comparative Example) | ExM-14 | ExY-13 | ExY-13 | 89 | 82 | −48 | +55 | 0.92 | 0.59 |
| 302 (Comparative Example) | " | Y-29 | " | 90 | 83 | −45 | +42 | 0.93 | 0.67 |
| 303 (Comparative Example) | (14) | ExY-13 | " | 95 | 88 | −49 | +12 | 0.98 | 0.70 |
| 304 (Present Invention) | " | Y-29 | Y-29 | 99 | 98 | −4 | +1 | 1.10 | 1.08 |
| 201 (Comparative Example) | ExM-14 | — | ExY-13 | 86 | 84 | −45 | +41 | 0.93 | 0.63 |
| 207 (Comparative Example) | (14) | — | " | 93 | 90 | −42 | +9 | 0.99 | 0.90 |
| 217 (Present Invention) | " | — | Y-29 | 98 | 97 | −3 | ±0 | 1.07 | 1.00 |

[1]The compound added in place of ExM-14 of the 10th layer.
[2]The yellow coupler added in place of ExM-13 of the 10th layer.
[3]The yellow coupler added in place of ExM-13 of the 12th and 13th layers.
[4]The sample made by using an emulsion immediately after emulsification in the 10th layer.
[5]The sample made by using an emulsion aged for 30 days after emulsification in the 10 the layer.

Table 6 reveals that the sample 304 containing both the DIR compound of the present invention and the yellow coupler of the present invention in the 10th layer had an effect of improving color reproduction represented by the hue index and the croma index compared to the sample 217 not containing the yellow coupler. By contrast, in the samples 301 and 303 also containing the conventional yellow coupler, the saturation was reduced although the hue was improved, as compared with the samples 201 and 207, respectively. In the samples in which the conventional yellow coupler or the conventional DIR compound was added to the 10th layer, degradation in dye stability represented by the dye change rate was undesirably significant. From the comparison between the MTF value of the sample made by using the emulsion immediately after the emulsification and that of the sample made by using the emulsion aged after the emulsification, it was found that an unexpected effect of remarkably improving the stability with time of the emulsion was achieved only when the emulsification was performed in the presence of both the DIR compound of the present invention and the yellow coupler of the present invention.

The samples 304 and 217 of the present invention were used to photograph a Macbeth color checker chart and a model holding flowers in her hands under a tungsten light source whose color temperature was adjusted to 4,800° K. using a filter, and developed following the same procedures as in Example 2. The obtained negative films were printed on color paper (Fujicolor FA paper) to obtain pictures enlarged by 6.8 times. Each of the obtained pictures had a high saturation and a good hue, and especially the sample 304 was superior to the others in reproduction of yellow-green.

As described above, the present invention makes possible to provide a light-sensitive material excellent in color reproduction, sharpness, color forming properties, storage stability, and dye stability.

What is claimed is:

1. A silver halide color photographic light-sensitive material comprising at least one light-sensitive silver halide emulsion layer on a support, wherein at least one of said light-sensitive silver halide emulsion layers contains at least one compound represented by Formula (MI) below, and at least one layer of said silver halide color photographic light-sensitive material contains at least one acylacetamide yellow coupler having an acyl group represented by Formula (YI) below:

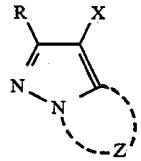

Formula (MI)

where R represents a hydrogen atom or a substituent, Z represents a nonmetallic atomic group required to form a 5-membered azole ring which contains two to four nitrogen atoms, and may have a substituent; and X represents a group which is split off upon a coupling reaction with the oxidized form of a developing agent to form a development inhibitor or a precursor of a development inhibitor, or a group which reacts with another molecule of the oxidized form of a developing agent after split off and forms a development inhibitor or a precursor of a development inhibitor;

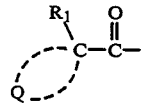

Formula (YI)

where $R_1$ represents a monovalent group; and Q represents a nonmetallic atomic group required to form, together with C, a 3- to 5-membered hydrocarbon ring or a 3- to 5-membered heterocyclic ring having at least one hetero atom selected from the group consisting of N, O, S, and P in the ring, $R_1$ is not a hydrogen atom and does not combine with Q to form a ring, said light-sensitive sensitive material further comprising a yellow-colored cyan coupler.

2. The light-sensitive material according to claim 1, wherein the yellow-colored cyan coupler is present in a red-sensitive emulsion layer.

3. The light-sensitive material according to claim 1, wherein said yellow-colored cyan coupler is a cyan coupler capable of releasing, upon coupling with an oxidized form of an aromatic primary amine developing agent, a compound moiety containing a water-soluble soluble 6-hydroxy-2-pyridon-5-ylazo group, a water-soluble 6-pyrazolon-4-ylazo group, a water-soluble 5-aminopyrazol-4-ylazo group, a water-soluble acylaminophenylazo group, or a water-soluble 2-sulfonamido group.

4. The light-sensitive material according to claim 3, containing at one least compound represented by Formula (MI) and at least one acylacetamide yellow coupler having an acyl group represented by Formula (YI) in the same light-sensitive layer.

5. The light-sensitive material according to claim 1, wherein X in Formula (MI) is represented by Formula (X-1) below:

$$-\{(L_1)_a-(B)_m\}_p-(L_2)_n-DI \qquad \text{Formula (X-1)}$$

where $L_1$ represents a group which cleaves the bond on the right side (the bond with $(B)_m$) of $L_1$ in Formula (X-1) after the bond on the left side is cleaved, B represents a group which reacts with the oxidized form of a developing agent to cleave the bond on the right side of B in Formula (X-1), $L_2$ represents a group which cleaves the bond on the right side (the bond with DI) of $L_2$ in Formula (X-1) after the bond on the left side is cleaved, DI represents a development inhibitor, each of a, m, and n represents 0 or 1, p represents an integer from 0 to 2, and if p is the plural number, the p number of $(L_1)_a-(B)_m$'s may be identical or different.

6. The light-sensitive material according to claim 5, wherein Formula (X-1) is represented by Formula (X-2), (X-3), or (X-4) below:

$$-(L_1)-(B)-DI \qquad \text{Formula (X-2)}$$

$$-(L_2)-DI \qquad \text{Formula (X-3)}$$

$$-DI \qquad \text{Formula (X-4)}$$

where $L_1$, $L_2$, B, and DI have the same meanings as $L_1$, $L_2$, B, and DI in Formula ( X-1).

7. The light-sensitive material according to claim 1, wherein the compound of Formula (MI) is represented by Formula (P-2) or (P-3) below:

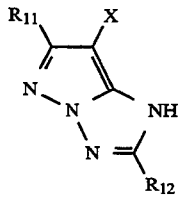

(P-2)

-continued

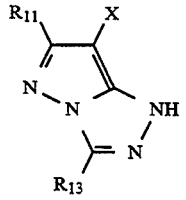

(P-3)

where each of $R_{11}$, $R_{12}$ and $R_{13}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxycarbonylamino group, an imido group, a heterocyclicthio group, a sulfinyl group, a phosphonyl group, an aryloxycarbonyl group, an acyl group, or an azolyl group; $R_{11}$ may be a divalent group to form a bis-form of the compound; and wherein X is represented by Formula (X-1) below:

$$-\{(L_1)_a-(B)_m\}_p-(L_2)_n-DI \qquad \text{Formula (X-1)}$$

where $L_1$ represents a group which cleaves the bond on the right side (the bond with $(B)_m$) of $L_1$ in Formula (X-1) after the bond on the left side is cleaved, B represents a group which reacts with the oxidized form of a developing agent to cleave the bond on the right side of B in Formula (X-1), $L_2$ represents a group which cleaves the bond on the right side (the bond with DI) of $L_2$ in Formula (X-1) after the bond on the left side is cleaved, DI represents a development inhibitor, each of a, m, and n represents 0 or 1, p represents an integer from 0 to 2, and if p is the plural number, the p number of $(L_1)_a-(B)_m$'s may be identical or different.

8. The light-sensitive material according to claim 1, wherein said yellow coupler is represented by Formula (YII) below:

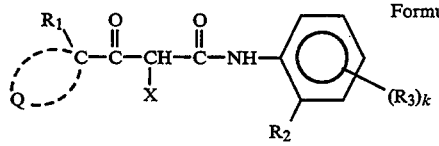

Formula (YII)

where $R_1$ represents a monovalent substituent except for a hydrogen atom; Q represents a nonmetallic atomic group required to form, together with C, a 3- to 5-membered hydrocarbon ring or a 3- to 5-membered heterocyclic ring containing at least one heteroatom selected from N, S, O, and P in its ring; $R_2$ represents a hydrogen atom, a halogen atom, an alkoxy group, an aryloxy group, an alkyl group, or an amino group; $R_3$represents a group substitutable on a benzene ring; X represents a hydrogen atom or a group which can split off upon a coupling reaction with the oxidized form of an aromatic primary amine developing agent; k represents an integer from 0 to 4, and if k is the plural number, a plurality of $R_3$'s may be identical or different.

9. The light-sensitive material according to claim 8, wherein Q in Formula (YII) is a substituted or unsubstituted ethylene group.

10. The light-sensitive material according to claim 8, wherein X in Formula (YII) is represented by Formula (Y-1), (Y-2), or (Y-3) below:

Formula (Y-1)

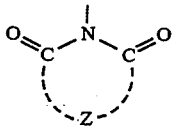

Formula (Y-2)

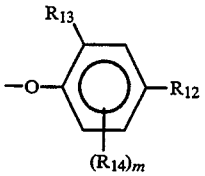

Formula (Y-3)

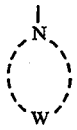

where in Formula (Y-1), Z represents —O—$CR_4(R_5)$—, —S—$CR_4(R_5)$—, $NR_6$—$CR_4(R_5)$—, —$NR_6$—$NR_7$—, —$NR_6$—C—(O)—, —$CR_4(R_5)$—$CR_8(R_9)$—, or $CR_{10}$=$CR_{11}$—, each of $R_4$, $R_5$, $R_8$, and $R_9$ represents a hydrogen atom, an alkyl group, an aryl group, an alkoxy group, an aryloxy group, an alkylthio group, an arylthio group, an alkylsulfonyl group, an arylsulfonyl group, or an amino group, each of $R_6$ and $R_7$ represents a hydrogen atom, an alkyl group, an aryl group, an alkylsulfonyl group, an arylsulfonyl group, or an alkoxycarbonyl group, and each of $R_{10}$ and $R_{11}$ represents a hydrogen atom, an alkyl group, or an aryl group, $R_{10}$ and $R_{11}$ may combine to form a benzene ring, and $R_4$ and $R_5$, $R_5$ and $R_6$, $R_6$ and $R_7$, or $R_4$ and $R_8$ may combine to form a ring;

in Formula (Y-2), at least one of $R_{12}$ and $R_{13}$ is a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, or an acyl group, while the other one may be a hydrogen atom, an alkyl group, or an alkoxy group, $R_{14}$ represents a group having the same meaning as $R_{12}$ or $R_{13}$, and m represents an integer from 0 to 2; and in Formula (Y-3), W represents a nonmetallic atomic group required to form, together with N, a pyrrole ring, pyrazole ring, an imidazole ring, or a triazole ring, each of which may have a substituent.

11. The light-sensitive material according to claim 10, wherein X in Formula (YII) is represented by Formula (Y-1).

12. The light-sensitive material according to claim 3, wherein said yellow-colored cyan coupler is represented by Formula (CI), (CII) (CIII) or (CIV) below:

Formula (CI)

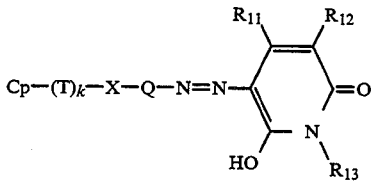

Formula (CII)

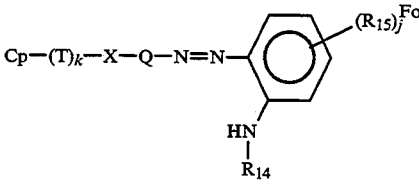

Formula (CIII)

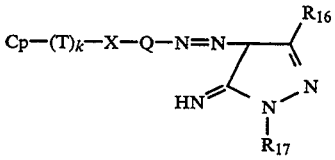

Formula (CIV)

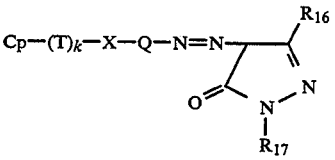

where Cp represents a cyan coupler moiety, with T combining with its coupling position; T represents a timing group; k represents an integer of 0 or 1; X represents a divalent linking group which contains N, O, or S at which it combines with $(T)_k$, and connects with Q; and Q represents an arylene group or a divalent heterocyclic group;

in Formula (CI), each of $R_{11}$ and $R_{12}$ independently represents a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group, or an alkylsulfonyl group, and $R_{13}$ represents a hydrogen atom, an alkyl group, a cycloalkyl group, an aryl group, or a heterocyclic group, and at least one of T, X, Q, $R_{11}$, $R_{12}$, and $R_{13}$ contains a water-soluble group;

in Formula (CII), $R_{14}$ represents an acyl group or a sulfonyl group, $R_{15}$ represents a substitutable group, j represents an integer from 0 to 4, if j is an integer of 2 or more, a plurality of $R_{15}$'s may be identical or different, and at least one of T, X, Q, $R_{14}$, and $R_{15}$ contains a water-soluble group; and in Formulas (CIII) and (CIV), $R_{16}$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamido group, a sulfonamido group, or an alkylsulfonyl group, $R_{17}$ represents a hydrogen atom, an alkyl group, a cycloalkyl group, an aryl group, or a heterocyclic group, and at least one of T, X, Q, $R_{16}$, and $R_{17}$ contains a water-soluble group.

13. The light-sensitive material according to claim 7, wherein $R_{11}$ is selected from the group consisting of a hydrogen atom, an alkyl group, an aryl group, an alkylthio group, a ureido group and an acylamino group.

14. The light-sensitive material according to claim 7, wherein $R_2$ is selected from the group consisting of a hydrogen atom, an aryl group, an aryl group, a heterocyclic group, an alkoxycarbonyl group, a carbamoyl group, a sulfamoyl group, a sulfinyl group, an acyl group and an a cyano group.

15. The light-sensitive material according to claim 7, wherein $R_{13}$ is a hydrogen atom, an alkyl group, an aryl group, a heterocyclic group, an alkoxy group, an aryloxy group, an alkylthio group, an arylthio group, an alkoxycarbonyl group, a carbamoyl group and an acyl group.

16. The light-sensitive material according to claim 7, wherein Formula (X-1) is represented by Formula (X-2), (X-3), or (X-4) below:

$$-(L_1)-(B)-DI \qquad \text{Formula (X-2)}$$

$$-(L_2)-DI \qquad \text{Formula (X-3)}$$

$$-DI \qquad \text{Formula (X-4)}$$

where $L_1$, $L_2$, B, and DI have the same meanings as $L_1$, $L_2$, B, and DI in Formula (X-1).

17. The light-sensitive material according to claim 8, wherein $R_1$ is an organic moiety not containing a metal atom.

18. The light-sensitive material according to claim 8, wherein $R_2$ is selected from the group consisting of a halogen atom, an alkyl group, an aryl group, an alkoxy group and an amino group.

19. The light-sensitive material according to claim 8, wherein $R_3$ is selected from the group consisting of a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group an aryloxysulfonyl group, an acyloxy group, a nitro group, a heterocyclic group, a cyano group, an acyl group, an acyloxy group, an alkylsulfonyloxy group and an arylsulfonyloxy group.

20. The light-sensitive material according to claim 8, wherein X is a heterocyclic group which combines with the coupling active position through a nitrogen atom, or X is an aryloxy group.

21. The light-sensitive material according to claim 1, containing at least one compound represented by Formula (MI) and at least one acylacetamide yellow coupler having an acyl group represented by Formula (YI) in the same light-sensitive layer.

* * * * *